US010625519B2

(12) United States Patent
Kobayashi et al.

(10) Patent No.: US 10,625,519 B2
(45) **Date of Patent: *Apr. 21, 2020**

(54) INK JET RECORDING METHOD, ULTRAVIOLET-RAY CURABLE INK, AND INK JET RECORDING APPARATUS

(71) Applicant: Seiko Epson Corporation, Tokyo (JP)

(72) Inventors: Yoshihiro Kobayashi, Matsumoto (JP); Yusuke Mizutaki, Shiojiri (JP); Toshio Kumagai, Shiojiri (JP); Masaaki Ando, Matsumoto (JP); Hiroaki Kida, Matsumoto (JP); Kaoru Koike, Matsumoto (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/886,407

(22) Filed: Feb. 1, 2018

(65) Prior Publication Data

US 2018/0154658 A1 Jun. 7, 2018

Related U.S. Application Data

(63) Continuation of application No. 14/856,092, filed on Sep. 16, 2015, now Pat. No. 9,884,487, which is a (Continued)

(30) Foreign Application Priority Data

Apr. 25, 2012 (JP) ..... 2012-099995
Apr. 27, 2012 (JP) ..... 2012-102537
(Continued)

(51) Int. Cl.
*B41J 11/00* (2006.01)
*B41J 2/175* (2006.01)
(Continued)

(52) U.S. Cl.
CPC ..... *B41J 11/002* (2013.01); *B41J 2/17509* (2013.01); *B41J 2/2107* (2013.01); *B41M 7/0081* (2013.01)

(58) Field of Classification Search
CPC ... B41J 2/01; B41J 2/211; B41J 2/1433; B41J 2/17; B41J 2/17593; B41J 2/2107;
(Continued)

(56) References Cited

U.S. PATENT DOCUMENTS 2,692,256 A 10/1954 Bauer
4,303,924 A 12/1981 Young, Jr.
(Continued)

FOREIGN PATENT DOCUMENTS

CN 102381023 A 3/2012
EP 0 997 508 A1 5/2000
(Continued)

OTHER PUBLICATIONS

[No Author Listed] BASF Product Brochure (no date available), Coatings that stay looking good: BASF performance additive. (online) Retrieved by examiner Jun. 26, 2014, <URL: http://www.basf.com/group/corporate/us/en/literature-document:Brand+Chimassorb-Brochure--Coatings+that+stay+looking+good+BASF+performance+additives-English.pdf>, 32 pages.
(Continued)

*Primary Examiner* — Manish S Shah
(74) *Attorney, Agent, or Firm* — Workman Nydegger

(57) ABSTRACT

An ink jet recording method includes ejecting an ultraviolet-ray curable ink of which a viscosity at 28° C. is 8 mPa·s or more from a head to a recording medium, and curing the ultraviolet-ray curable ink attached to the recording medium, wherein, in the ejecting of the ultraviolet-ray curable ink, the ultraviolet-ray curable ink is heated such that a temperature of the ejected ultraviolet-ray curable ink
(Continued)

becomes 28° C. to 40° C., and a viscosity of the ultraviolet-ray curable ink at the temperature is 15 mPa·s or less.

12 Claims, 3 Drawing Sheets

Related U.S. Application Data continuation of application No. 13/853,120, filed on Mar. 29, 2013, now Pat. No. 10,029,483.

(30) Foreign Application Priority Data

Nov. 13, 2012 (JP) ..... 2012-249034
Nov. 14, 2012 (JP) ..... 2012-250030

(51) Int. Cl.
*B41J 2/21* (2006.01)
*B41M 7/00* (2006.01)

(58) Field of Classification Search
CPC ..... B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 11/0015; B41J 11/002; B41J 2/161; B41J 2/1623; B41J 2202/00; B41J 2202/03; B41J 2/14201; B41J 2/045; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; B41M 5/0011; B41M 5/0017; B41M 5/0047; B41M 7/00; B41M 7/0072; B41M 5/52; B41M 5/5218
See application file for complete search history.

(56) References Cited

U.S. PATENT DOCUMENTS 4,577,205 A 3/1986 Shibata et al.
5,266,106 A 11/1993 Breton
5,275,646 A 1/1994 Marshall et al.
5,596,027 A 1/1997 Mead et al.
5,641,346 A 6/1997 Mantell et al.
5,889,084 A 3/1999 Roth
5,897,695 A 4/1999 Mayo et al.
6,187,897 B1 2/2001 Kawashima et al.
6,310,115 B1 10/2001 Vanmaele et al.
7,963,625 B2 6/2011 Okada
8,227,047 B2 7/2012 Loccufier et al.
8,664,291 B2 3/2014 Kida et al.
9,034,940 B2 5/2015 Kida et al.
9,056,986 B2 6/2015 Kagose et al.
9,458,338 B2 10/2016 Kagose et al.
9,493,667 B2 11/2016 Kida et al.
9,782,982 B2 10/2017 Yoshida et al.
9,796,193 B2 10/2017 Yoshida et al.
9,827,760 B2 11/2017 Fukumoto et al.
9,837,788 B2 12/2017 Akasaka et al.
9,873,808 B2 1/2018 Kida et al.
9,884,487 B2 2/2018 Kobayashi et al.
9,925,801 B2 3/2018 Nakajima et al.
9,981,486 B2 5/2018 Nakajima et al.
10,029,483 B2 7/2018 Kobayashi et al.
2001/0036978 A1 11/2001 Kohler et al.
2003/0162868 A1 8/2003 Stretanski et al.
2004/0075726 A1 4/2004 Hirai
2004/0106700 A1 6/2004 Yamanouchi et al.
2004/0132862 A1* 7/2004 Woudenberg ..... C09D 11/101 523/160
2006/0050116 A1 3/2006 Nakajima
2006/0203024 A1 9/2006 Kusunoki
2007/0035594 A1 2/2007 Brooks et al.
2007/0229612 A1 10/2007 Oyanagi et al.
2008/0079792 A1 4/2008 Hirato
2008/0165237 A1 7/2008 Yamauchi et al.
2008/0166495 A1 7/2008 Maeno et al.
2008/0199631 A1 8/2008 Makuta et al.
2008/0218574 A1 9/2008 Furuno et al.
2008/0238980 A1 10/2008 Nagashima et al.
2008/0239045 A1* 10/2008 Umebayashi ..... C09D 11/101 347/102
2008/0249795 A1 10/2008 Walker
2008/0254234 A1 10/2008 Fink et al.
2009/0000508 A1 1/2009 Edison et al.
2009/0040249 A1 2/2009 Wouters et al.
2009/0041946 A1 2/2009 Fukumoto et al.
2009/0053484 A1 2/2009 Yoshihiro et al.
2009/0068418 A1 3/2009 Iwase et al.
2009/0099277 A1 4/2009 Nagvekar et al.
2009/0118388 A1 5/2009 Naruse et al.
2009/0145638 A1 6/2009 Toyoda et al.
2009/0169834 A1 7/2009 Sano et al.
2009/0197988 A1 8/2009 Kito et al.
2009/0208651 A1 8/2009 Oyanagi et al.
2009/0280302 A1 11/2009 Fukumoto et al.
2009/0289999 A1 11/2009 Takahashi et al.
2009/0303304 A1 12/2009 Oyanagi et al.
2010/0036978 A1 2/2010 Candelaria et al.
2010/0073437 A1 3/2010 Shibata et al.
2010/0079566 A1 4/2010 Ishikawa
2010/0080925 A1 4/2010 Araki et al.
2010/0112497 A1 5/2010 Takabayashi et al.
2010/0313782 A1 12/2010 Loccufier et al.
2010/0330296 A1 12/2010 Loccufier et al.
2011/0015294 A1 1/2011 Kito et al.
2011/0024392 A1 2/2011 Sato et al.
2011/0028586 A1 2/2011 Kito et al.
2011/0085013 A1 4/2011 Onishi et al.
2011/0091790 A1 4/2011 Barnwell et al.
2011/0124768 A1 5/2011 Claes et al.
2011/0165387 A1 7/2011 Kondo
2011/0234680 A1 9/2011 Aoyama et al.
2011/0241264 A1 10/2011 Yokoi
2012/0014005 A1 1/2012 Kliem
2012/0026236 A1 2/2012 Fujii
2012/0075394 A1 3/2012 Ohnishi
2012/0083545 A1 4/2012 Kida et al.
2012/0113201 A1 5/2012 Kagose et al.
2012/0127249 A1 5/2012 Mizutaki et al.
2012/0128890 A1 5/2012 Mirchev
2012/0140005 A1 6/2012 De Voeght et al.
2012/0147095 A1 6/2012 Miura et al.
2012/0235414 A1 9/2012 Levy
2012/0252919 A1 10/2012 Suzuki et al.
2012/0274717 A1 11/2012 Nakano et al.
2013/0002773 A1 1/2013 Fujii et al.
2013/0010039 A1 1/2013 Kida et al.
2013/0063535 A1 3/2013 Yoda et al.
2013/0236654 A1 9/2013 Claes et al.
2013/0250019 A1 9/2013 Sato et al.
2013/0258016 A1 10/2013 Yoshida et al.
2013/0258018 A1 10/2013 Nakajima et al.
2013/0286120 A1 10/2013 Kobayashi et al.
2013/0286121 A1 10/2013 Fukumoto et al.
2014/0022321 A1 1/2014 Komatsu
2014/0053753 A1 2/2014 Suzuki et al.
2014/0063154 A1 3/2014 Gould et al.
2014/0104356 A1 4/2014 Kitade et al.
2014/0128496 A1 5/2014 Kida et al.
2014/0132682 A1 5/2014 Kida et al.
2014/0212634 A1 7/2014 Kameyama et al.
2015/0050427 A1 2/2015 Claes et al.
2015/0225581 A1 8/2015 Kida et al.
2015/0240094 A1 8/2015 Kagose et al.
2016/0001578 A1 1/2016 Kobayashi et al.
2016/0046134 A1 2/2016 Fukumoto et al.

(56) References Cited

U.S. PATENT DOCUMENTS

| | | | |
|---|---|---|---|
| 2016/0152044 | A1 | 6/2016 | Yoshida et al. |
| 2017/0002221 | A1 | 1/2017 | Kida et al. |
| 2017/0087876 | A1 | 3/2017 | Nakajima et al. |
| 2018/0072047 | A1 | 3/2018 | Fukumoto et al. |
| 2018/0319177 | A1 | 11/2018 | Nakajima et al. |

FOREIGN PATENT DOCUMENTS

| | | | | |
|---|---|---|---|---|
| EP | 2 017 311 | A1 | 1/2009 | |
| EP | 2 266 812 | A2 | 12/2010 | |
| EP | 2 305 762 | A1 | 4/2011 | |
| EP | 2 335 940 | A1 | 6/2011 | |
| EP | 2 399 965 | A1 | 12/2011 | |
| EP | 2 399 966 | A1 | 12/2011 | |
| EP | 2 412 765 | A1 | 2/2012 | |
| EP | 2 543 707 | A1 | 1/2013 | |
| EP | 2 568 022 | A2 | 3/2013 | |
| JP | 60-208317 | A | 10/1985 | |
| JP | 60-210678 | A | 10/1985 | |
| JP | 2000-052596 | A | 2/2000 | |
| JP | 2000-169511 | A | 6/2000 | |
| JP | 2002-326976 | A | 11/2002 | |
| JP | 2003-089198 | A | 3/2003 | |
| JP | 2003-191593 | A | 7/2003 | |
| JP | 2003-200559 | A | 7/2003 | |
| JP | 2003-292855 | A | 10/2003 | |
| JP | 3461501 | B1 | 10/2003 | |
| JP | 2004-067991 | A | 3/2004 | |
| JP | 2004-098553 | A | 4/2004 | |
| JP | 2004-167873 | A | 6/2004 | |
| JP | 2004-182930 | A | 7/2004 | |
| JP | 2004-196936 | A | 7/2004 | |
| JP | 2004-224841 | A | 8/2004 | |
| JP | 2005-103854 | A | 4/2005 | |
| JP | 2005-170039 | A | 6/2005 | |
| JP | 2005-212412 | A | 8/2005 | |
| JP | 2005-214395 | A | 8/2005 | |
| JP | 2006-069025 | A | 3/2006 | |
| JP | 2006-152064 | A | 6/2006 | |
| JP | 2006-219625 | A | 8/2006 | |
| JP | 2006-231795 | A | 9/2006 | |
| JP | 2006-248042 | A | 9/2006 | |
| JP | 2006-257350 | A | 9/2006 | |
| JP | 2007-118409 | A | 5/2007 | |
| JP | 2007-136766 | A | 6/2007 | |
| JP | 2007-138070 | A | 6/2007 | |
| JP | 2007-185852 | A | 7/2007 | |
| JP | 2007-245630 | A | 9/2007 | |
| JP | 2007-283753 | A | 11/2007 | |
| JP | 2008-001003 | A | 1/2008 | |
| JP | 2008-001849 | A | 1/2008 | |
| JP | 2008-007687 | A | 1/2008 | |
| JP | 2008-050600 | A | 3/2008 | |
| JP | 2008-055716 | A | 3/2008 | |
| JP | 2008-507598 | A | 3/2008 | |
| JP | 2008-163080 | A | 7/2008 | |
| JP | 2008-179136 | A | 8/2008 | |
| JP | 2008-207425 | A | 9/2008 | |
| JP | 2008-246832 | A | 10/2008 | |
| JP | 2008-254196 | A | 10/2008 | |
| JP | 2008-254312 | A | 10/2008 | |
| JP | 2008-280383 | A | 11/2008 | |
| JP | 2008280383 | A * | 11/2008 | ..... C08K 5/103 |
| JP | 2009-000961 | A | 1/2009 | |
| JP | 4204333 | B2 | 1/2009 | |
| JP | 2009-035650 | A | 2/2009 | |
| JP | 2009-040880 | A | 2/2009 | |
| JP | 2009-057548 | A | 3/2009 | |
| JP | 2009-073945 | A | 4/2009 | |
| JP | 2009-096043 | A | 5/2009 | |
| JP | 2009-096910 | A | 5/2009 | |
| JP | 2009-146624 | A | 7/2009 | |
| JP | 2009-185157 | A | 8/2009 | |
| JP | 2009-191183 | A | 8/2009 | |
| JP | 4321050 | B2 | 8/2009 | |
| JP | 2009173853 | A | 8/2009 | |
| JP | 4335955 | B1 | 9/2009 | |
| JP | 2009-235272 | A | 10/2009 | |
| JP | 2009-279830 | A | 12/2009 | |
| JP | 2009-279848 | A | 12/2009 | |
| JP | 2009-285853 | A | 12/2009 | |
| JP | 2009-292091 | A | 12/2009 | |
| JP | 2009-299057 | A | 12/2009 | |
| JP | 2010-012629 | A | 1/2010 | |
| JP | 2010-023285 | A | 2/2010 | |
| JP | 2010-030110 | A | 2/2010 | |
| JP | 2010-100833 | A | 5/2010 | |
| JP | 2010-131975 | A | 6/2010 | |
| JP | 2010-138315 | A | 6/2010 | |
| JP | 2010-143974 | A | 7/2010 | |
| JP | 2010-143982 | A | 7/2010 | |
| JP | 2010-167677 | A | 8/2010 | |
| JP | 2010-269471 | A | 12/2010 | |
| JP | 2010-280828 | A | 12/2010 | |
| JP | 2011-502188 | A | 1/2011 | |
| JP | 2011-025684 | A | 2/2011 | |
| JP | 2011-051107 | A | 3/2011 | |
| JP | 2011063778 | | 3/2011 | |
| JP | 2011-068013 | A | 4/2011 | |
| JP | 2011-083916 | A | 4/2011 | |
| JP | 2011-093156 | A | 5/2011 | |
| JP | 2011-098455 | A | 5/2011 | |
| JP | 2011-126269 | A | 6/2011 | |
| JP | 2011-132349 | A | 7/2011 | |
| JP | 2011-140197 | | 7/2011 | |
| JP | 2011-143344 | A | 7/2011 | |
| JP | 2011-523370 | A | 8/2011 | |
| JP | 2011-184609 | A | 9/2011 | |
| JP | 2011-184610 | A | 9/2011 | |
| JP | 2011-208018 | A | 10/2011 | |
| JP | 2011-213933 | A | 10/2011 | |
| JP | 2011-213934 | A | 10/2011 | |
| JP | 2011-219648 | A | 11/2011 | |
| JP | 2011-225848 | A | 11/2011 | |
| JP | 2011-235566 | A | 11/2011 | |
| JP | 2011-240565 | A | 12/2011 | |
| JP | 2012-000883 | A | 1/2012 | |
| JP | 2012-012478 | A | 1/2012 | |
| JP | 2012-020481 | A | 2/2012 | |
| JP | 2012-025124 | A | 2/2012 | |
| JP | 2012-046724 | A | 3/2012 | |
| JP | 2012046719 | | 3/2012 | |
| JP | 2012-072271 | A | 4/2012 | |
| JP | 2012-077221 | A | 4/2012 | |
| JP | 2012-077222 | A | 4/2012 | |
| JP | 2012-092291 | A | 5/2012 | |
| JP | 2012-126122 | A | 7/2012 | |
| JP | 2012-207084 | A | 10/2012 | |
| JP | 2013-010832 | A | 1/2013 | |
| JP | 2013-047305 | A | 3/2013 | |
| JP | 2013-053208 | A | 3/2013 | |
| JP | 5772032 | B2 | 9/2015 | |
| WO | 2006/085992 | A2 | 8/2006 | |
| WO | 2006/129476 | A1 | 12/2006 | |
| WO | 2007-083473 | A1 | 7/2007 | |
| WO | 2007/094446 | A1 | 8/2007 | |
| WO | 2007/126103 | A1 | 11/2007 | |
| WO | 2009/053305 | A1 | 4/2009 | |
| WO | 2010/029017 | A1 | 3/2010 | |
| WO | 2010/069758 | A1 | 6/2010 | |
| WO | 2011/039081 | A1 | 4/2011 | |
| WO | 2011/076703 | A1 | 6/2011 | |
| WO | 2012/133694 | A1 | 10/2012 | |
| WO | 2012/172973 | A1 | 12/2012 | |

OTHER PUBLICATIONS

Green, W.A., Commercial photoinitiators, Chapter 4, Industrial Photoinitiators, A Technical Guide. CRC Press, Taylor & Francis Group, 2010, pp. 75-114.

Keskin et al., "2-Mercaptothioxanthone as sensitizers and coinitiators for acylphosphine oxide photoinitiators for free radical polymerization," Macromolecules, 2008, vol. 41, pp. 4631-4634.

(56) References Cited

OTHER PUBLICATIONS

U.S. Appl. No. 15/991,316, filed May 29, 2018, Ink Jet Recording Method, Ultraviolet Curable Ink, and Ink Jet Recording Apparatus.
U.S. Appl. No. 13/234,666, filed Sep. 16, 2011, Ultraviolet-Curable Ink Jet Ink Composition.
U.S. Appl. No. 13/292,219, filed Nov. 9, 2011, Ultraviolet Curable Type Ink-Jet Ink Composition, Recording Method and Recording Apparatus Usisng Same.
U.S. Appl. No. 13/851,426, filed Mar. 27, 2013, Ink Jet Recording Method, Ultraviolet Curable Ink and Ink Jet Recording Apparatus.
U.S. Appl. No. 13/851,627, filed Mar. 27, 2013, Ink Jet Recording Method, Ultraviolet Curable Ink, and Ink Jet Recording Apparatus.
U.S. Appl. No. 13/853,120, filed Mar. 29, 2013, Ink Jet Recording Method, Ultraviolet-Ray Curable Ink, and Ink Jet Recording Apparatus.
U.S. Appl. No. 13/853,185, filed Mar. 29, 2013, Ink Jet Recording Method and Ink Jet Recording Apparatus.
U.S. Appl. No. 14/081,281, filed Nov. 15, 2013, UV Curable Ink Jet Recording Ink Composition, Ink Container and Ink Jet Recording Apparatus.
U.S. Appl. No. 14/155,588, filed Jan. 15, 2014, Ultraviolet-Curable Ink Jet Ink Composition.
U.S. Appl. No. 14/689,502, filed Apr. 17, 2015, Ultraviolet-Curable Ink Jet Ink Composition.
U.S. Appl. No. 14/708,325, filed May 11, 2015, Ultraviolet Curable Type Ink-Jet Ink Composition, Recording Method and Recording Apparatus Using the Same.
U.S. Appl. No. 14/856,092, filed Sep. 16, 2015, Ink Jet Recording Method, Ultraviolet-Ray Curable Ink, and Ink Jet Recording Apparatus.
U.S. Appl. No. 14/920,966, filed Oct. 23, 2015, Ink Jet Recording Method and Ink Jet Recording Apparatus.
U.S. Appl. No. 15/014,361, filed Feb. 3, 2016, Ink Jet Recording Method, Ultraviolet Curable Ink and Ink Jet Recording Apparatus.
U.S. Appl. No. 15/269,319, filed Sep. 19, 2016, UV Curable Ink Jet Recording Ink Composition, Ink Container and Ink Jet Recording Apparatus.
U.S. Appl. No. 15/373,390, filed Dec. 8, 2016, Ink Jet Recording Method, Ultraviolet Curable Ink, and Ink Jet Recording Apparatus.
U.S. Appl. No. 15/821,561, filed Nov. 22, 2017, Ink Jet Recording Method and Ink Jet Recording Apparatus.
BASF Product Brochure, "Coatings that stay looking good", pp. 1-32, accessed on Nov. 12, 2019 via <www.btc-europe.com>.

* cited by examiner

INK JET RECORDING METHOD, ULTRAVIOLET-RAY CURABLE INK, AND INK JET RECORDING APPARATUS

CROSS REFERENCES TO RELATED APPLICATIONS

The present application claims priority under 35 U.S.C. § 120 to U.S. patent application Ser. No. 14/856,092, filed on Sep. 16, 2015, which is a continuation of U.S. patent application Ser. No. 13/853,120, filed on Mar. 29, 2013. The present application also claims priority under 35 U.S.C § 119 to Japanese Patent Application Nos. 2012-99995, filed Apr. 25, 2012, 2012-249034, filed Nov. 13, 2012, 2012-102537, filed Apr. 27, 2012, and 2012-250030, filed Nov. 14, 2012, which are expressly incorporated by reference herein.

BACKGROUND

1. Technical Field

The present invention relates to an ink jet recording method, an ultraviolet-ray curable ink, and an ink jet recording apparatus.

2. Related Art

In the related art, various methods are used as a recording method of forming an image on a recording medium such as paper on the basis of an image data signal. Among them, since an ink jet method of ejecting an ink onto only a necessary image part with low-priced apparatus and directly forming an image on a recording medium, an ink can be used with high efficiency and thus running costs are low. In addition, noise is small and thus the ink jet method is good as a recording method.

In recent years, in an ink jet recording method using an ultraviolet-ray curable ink in which monomers are photo-polimerized (cured) by irradiating the monomers with ultraviolet rays, an image with good water resistance and rub-fastness can be formed on a recording surface of a recording medium, and thus the method is used for manufacturing of color filters, printing on a printed board, a plastic card, a vinyl sheet, a large-sized signboard, and a plastic part, printing of barcodes or the date, and the like.

An ink used for ink jet recording may include an aqueous ink of a solvent system, an ultraviolet-ray curable ink (UV ink) of a nonsolvent system, or the like. Among them, since the ultraviolet-ray curable ink of the nonsolvent system has a considerably higher viscosity than the aqueous ink of the solvent system, a viscosity fluctuation due to a temperature fluctuation during ejection is great, and this viscosity fluctuation exerts great influence on a variation in a droplet size and a variation in droplet ejection speed and further causes image quality deterioration. Therefore, a technique is disclosed in which, when the ultraviolet-ray curable ink is ejected, the ink is heated so as to reduce a viscosity and is then ejected.

For example, JP-A-2003-200559 discloses a UV ink in which, since the UV ink has a higher viscosity than general ink at room temperature and is thus required to be ejected in a low viscosity state by heating the ink inside a recording head so as to maintain a set target temperature (a set temperature necessary for the ink to have a viscosity in which the ink can be ejected), the UV ink is varied by adjusting a heating temperature such that the ink viscosity is 7000 mPa·s to 500 mPa·s in a condition of 5° C. and the ink viscosity is 20 mPa·s to 3 mPa·s in a condition of 80° C. (paragraphs [0034], [0041] and [0042] of JP-A-2003-200559).

However, the UV ink disclosed in JP-A-2003-200559 has a problem in that members of the head deteriorate due to the heating. In addition, since the UV ink has a very high viscosity, if the ink is to be ejected without heating, ejection stability or ejection amount stability worsens.

SUMMARY

An advantage of some aspects of the invention is to provide an ink jet recording method in which durability of a head, and ejection stability and ejection amount stability of an ultraviolet-ray curable ink are good.

Another advantage of some aspects of the invention is to provide an ink jet recording apparatus in which durability of a head and ejection stability of an ultraviolet-ray curable ink are good.

In order to achieve the advantages, the present inventors have diligently performed study and obtained the following findings. First, a method has been examined in which an ultraviolet-ray curable ink (hereinafter, the ultraviolet-ray curable ink is simply referred to as an "ink") with a very low viscosity is prepared, and the ink is not heated and is ejected. However, according to the method, it has been found that a temperature of the ink tends to be fluctuated due to a variation in an environmental temperature, and ejection stability and ejection amount stability of the ink cannot be improved. In addition, it has been found that the members of the head deteriorate due to a composition of the ultraviolet-ray curable ink with a very low viscosity, and thus durability of the head worsens, and, further, curing wrinkles tend to be generated. Therefore, the present inventors have tried to heat an ultraviolet-ray curable ink which has a relatively low viscosity in a predetermined range, at a relatively low temperature in a predetermined range. As a result, it has been found that deterioration of the members of the head can be prevented. In addition to this, it has been found that, since a temperature fluctuation during ejection can be made to be small, a viscosity fluctuation can be suppressed, and thus ejection stability and ejection amount stability of the ultraviolet-ray curable ink become favorable.

As a result of the present inventors having more diligently performed study based on the findings, it has been found that the above-described problems can be solved by an ink jet recording method in which an ultraviolet-ray curable ink with a viscosity of 8 mPa·s or more at 28° C. is heated so as to set a temperature of the ejected ultraviolet-ray curable ink to 28° C. to 40° C., and the ultraviolet-ray curable ink of which a viscosity at the corresponding temperature is 15 mPa·s or less is ejected and cured, and thereby the invention has been made.

In other words, a first aspect of the invention is as follows.

[1] An ink jet recording method including ejecting an ultraviolet-ray curable ink of which a viscosity at 28° C. is 8 mPa·s or more from a head to a recording medium; and curing the ultraviolet-ray curable ink attached to the recording medium, wherein the ultraviolet-ray curable ink is heated such that a temperature of the ejected ultraviolet-ray curable ink becomes 28° C. to 40° C., and a viscosity of the ultraviolet-ray curable ink at the temperature is 15 mPa·s or less.

[2] The ink jet recording method set forth in [1], wherein recording is performed using a line type ink jet recording apparatus which includes a line head with a length equal to or more than a length corresponding to a width of a recording medium as the head.

[3] The ink jet recording method set forth in [1] or [2], wherein recording is performed using an ink jet recording apparatus in which at least a part of an ink path for supplying the ultraviolet-ray curable ink from an ink container to the head is an ink circulation path for circulating the ultraviolet-ray curable ink.

[4] The ink jet recording method set forth in [3], wherein an ink inflow amount of the ultraviolet-ray curable ink which is supplied from the ink circulation path to the head is twice or more the maximum ink ejection amount in which the ultraviolet-ray curable ink is ejected from the head.

[5] The ink jet recording method set forth in [3] or [4], wherein a heating mechanism which heats the ultraviolet-ray curable ink is provided at a position other than a position which is connected to at least the head in the ink circulation path.

[6] The ink jet recording method set forth in any one of [3] to [5], wherein there are a plurality of heads to which the ultraviolet-ray curable ink is supplied from the ink circulation path, and the ultraviolet-ray curable ink is ejected from the plurality of heads.

[7] The ink jet recording method set forth in any one of [1] to [6], wherein the ultraviolet-ray curable ink includes (meth)acrylic acid esters containing a vinyl ether group expressed in the following Formula (I).

$$CH_2{=}CR^1{-}COOR^2{-}O{-}CH{=}CH{-}R^3 \quad (I)$$

(wherein $R^1$ indicates a hydrogen atom or a methyl group, $R^2$ indicates a divalent organic residue having 2 to 20 carbon atoms, and $R^3$ indicates a hydrogen atom or a monovalent organic residue having 1 to 11 carbon atoms).

[8] The ink jet recording method set forth in [7], wherein the ultraviolet-ray curable ink further includes a monofunctional (meth)acrylate (here, excluding (meth)acrylic acid esters containing a vinyl ether group expressed in Formula (I)).

[9] The ink jet recording method set forth in any one of [1] to [8], wherein a light source used for the curing of the ultraviolet-ray curable ink is a light emitting diode.

[10] The ink jet recording method set forth in [9], wherein the light emitting diode applies ultraviolet rays which have a peak intensity of 800 $mW/cm^2$ or more.

[11] The ink jet recording method set forth in any one of [1] to [10], wherein an epoxy resin is used for the head.

[12] An ink jet recording apparatus using the ink jet recording method set forth in any one of [1] to [11].

[13] An ultraviolet-ray curable ink used for the ink jet recording method set forth in any one of [1] to [11] or the ink jet recording apparatus set forth in [12].

In addition, in order to achieve the advantages, the present inventors have diligently performed study and obtained the following findings. First, a method has been examined in which an ultraviolet-ray curable ink (hereinafter, the ultraviolet-ray curable ink is simply referred to as an "ink") with a very low viscosity is prepared, and the ink is not heated and is ejected. However, according to the method, it has been found that a temperature of the ink tends to be fluctuated due to a variation in an environmental temperature, and ejection stability of the ink cannot be improved. In addition, it has been found that the members of the head deteriorate due to a composition of the ultraviolet-ray curable ink with a very low viscosity, and thus durability of the head worsens, and, further, curing wrinkle tends to be generated. Therefore, the present inventors have tried to heat an ultraviolet-ray curable ink which has a relatively low viscosity in a predetermined range, at a relatively low temperature in a predetermined range. As a result, it has been found that deterioration of the members of the head can be prevented. In addition to this, it has been found that, since a temperature fluctuation during ejection can be made to be small, a viscosity fluctuation can be suppressed, and thus ejection stability of the ultraviolet-ray curable ink become favorable.

Further, a degassing mechanism has been provided, and it has been found that degassing efficiency of the ink is varied by a temperature and a viscosity of the ink based on the conception in which ejection stability of the ink can be made to be more favorable by sufficiently degassing the ink. Therefore, the present inventors have repeatedly examined a relationship between the degassing efficiency, temperature and viscosity of the ink, and have found that temperature and viscosity of the ultraviolet-ray curable ink are set in the above-described predetermined range, and thereby the degassing efficiency is considerably increased such that the ejection stability of the ink can be made to be good.

As a result of the present inventors having more diligently performed study based on the findings, it has been found that the above-described problems can be solved by an ink jet recording apparatus which ejects an ultraviolet-ray curable ink with a viscosity of 8 mPa·s or more at 28° C. to a recording medium from the head in a degassed ink state in which a temperature of the ejected ultraviolet-ray curable ink is 28° C. to 40° C. and the ultraviolet-ray curable ink of which a viscosity at the corresponding temperature is 15 mPa·s or less, and cures the ink attached to a recording surface through ultraviolet-ray irradiation from a light source, and thereby the invention has been made.

In other words, a second aspect of the invention is as follows.

[1] An ink jet recording apparatus including a head that ejects an ultraviolet-ray curable ink to a recording medium so as to be attached to the recording medium; an ink path that supplies the ultraviolet-ray curable ink from an ink container to the head; a heating mechanism that heats the ultraviolet-ray curable ink of which a viscosity at 28° C. is 8 mPa·s or more, enables a temperature of the ejected ink to be 28° C. to 40° C., and enables a viscosity of the ink at the temperature to be 15 mPa·s or less; a degassing mechanism that degasses the ultraviolet-ray curable ink and supplies the degassed ink to the head; and a light source which irradiates the ultraviolet-ray curable ink attached to the recording medium with ultraviolet rays so as to cure the ink.

[2] The ink jet recording apparatus set forth in [1], wherein the degassing mechanism is provided in the ink path.

[3] The ink jet recording apparatus set forth in [1] or [2], wherein at least a part of the ink path is an ink circulation path for circulating the ultraviolet-ray curable ink

[4] The ink jet recording apparatus set forth in [3], wherein an ink inflow amount per unit time of the ultraviolet-ray curable ink which is supplied from the ink circulation path to the head is twice or more the maximum ink ejection amount per unit time in which the ultraviolet-ray curable ink is ejected from the head.

[5] The ink jet recording apparatus set forth in any one of [1] to [4], wherein a dissolved oxygen content of the ultraviolet-ray curable ink supplied to the head is 20 ppm or less.

[6] The ink jet recording apparatus set forth in any one of [3] to [5], wherein the heating mechanism and the degassing mechanism are provided in the ink circulation path, and wherein the degassing mechanism is provided on a downstream side of the heating mechanism and on an upstream side of the head in a direction in which the ink is circulated.

[7] The ink jet recording apparatus set forth in any one of [1] to [6], wherein the ultraviolet-ray curable ink includes a thioxanthone-based photopolymerization initiator.

[8] The ink jet recording apparatus set forth in any one of [1] to [7], wherein an epoxy resin is used for at least a part of a portion which comes into contact with the ultraviolet-ray curable ink in the head.

[9] The ink jet recording apparatus set forth in any one of [1] to [8], wherein the light source is a light emitting diode, and the light emitting diode applies ultraviolet rays which have an irradiation peak intensity of 800 $mW/cm^2$ or more.

[10] An ink jet recording method of performing recording, using the ink jet recording apparatus set forth in any one of [1] to [9].

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
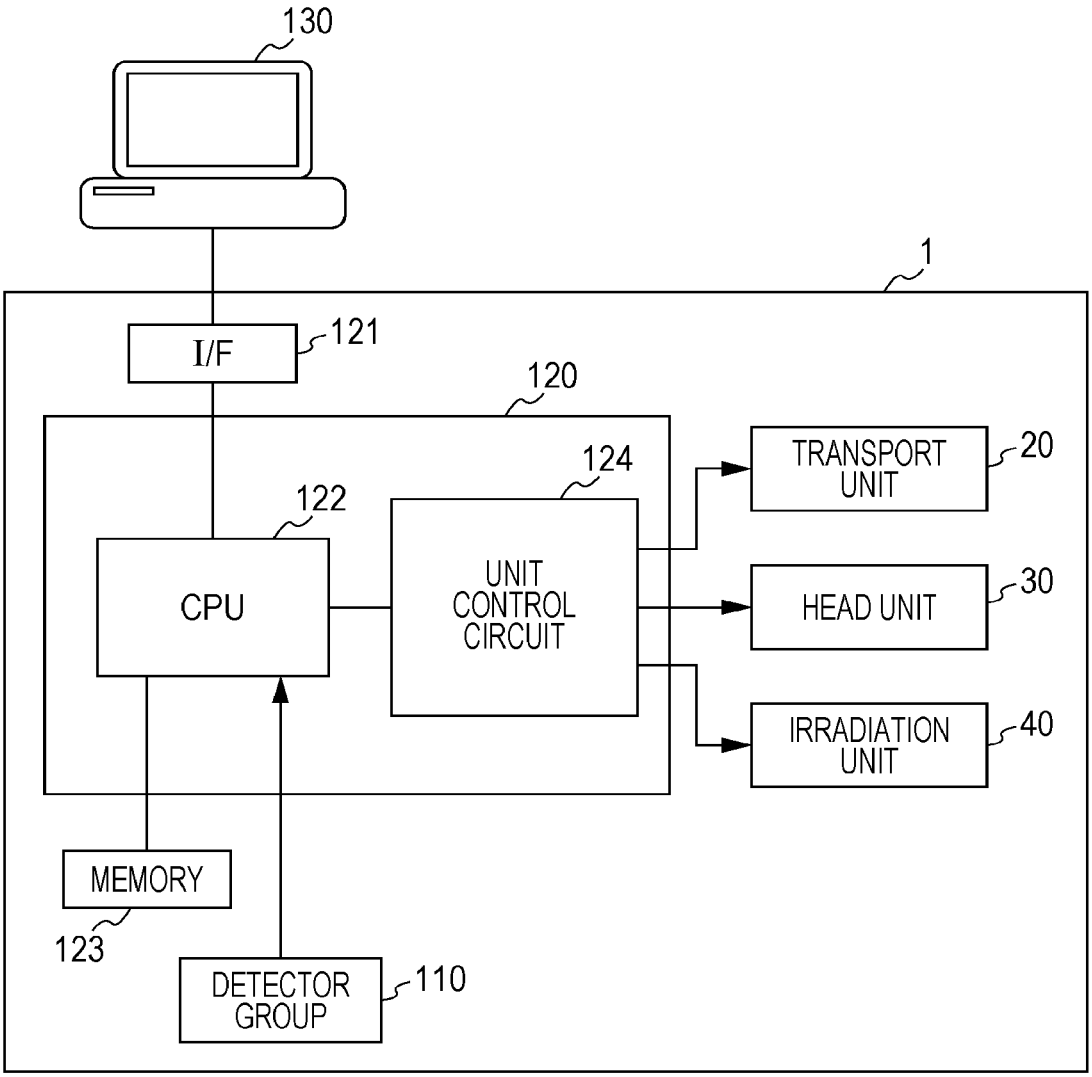
FIG. 1 is a block diagram illustrating an example of the configuration of an ink jet recording apparatus of the invention.

Hereinafter, a first embodiment of the invention will be described in detail.

In the present specification, the term "recorded matter" refers to a matter in which ink is recorded on a recording medium and thus a cured object is formed. In addition, the cured substance in the present specification indicates a cured substance including a cured film or a coated film.

In addition, in the present specification, the term "curing" indicates that, when ink including a polymerizable compound is irradiated with light, the polymerizable compound is polymerized and thus the ink is hardened. The term "curability" refers to a property of being cured in response to light and is also referred to as photopolymerization. The term "curing wrinkles" indicates wrinkles generated in a surface of a cured coated film as a result of an increase in polymerization volume shrinkage ratio due to uncured ink present inside the coated film which is a cured target irregularly flowing before being cured.

In addition, in the present specification, the term "ejection stability" refers to a property of ejecting ink droplets which are stable at all time from nozzles without blocking of the nozzles. The term "ejection amount stability" refers to a property in which a variation in an ejection amount of ink with time is small in a case where ink is ejected from a nozzle for a predetermined time. More specifically, the present inventors have found that the ejection amount stability is mainly influenced by a fluctuation in heating temperature in terms of a short term, and is mainly influenced by a fluctuation in environmental temperature in terms of a long term. Therefore, in the present specification, the former ejection amount stability is referred to as "short-term ejection amount stability" or "ejection amount stability (short term)", and the latter ejection amount stability is referred to as "long-term ejection amount stability" or "ejection amount stability (long term)".

Further, in the present specification, the term "durability of a head" indicates a property in which deterioration including alteration such as swelling is unlikely to occur when members of the head (specifically, an adhesive among the head members) forming the recording apparatus come into contact with an ink.

In addition, in the present specification, the term "preservation stability" indicates a property in which a viscosity is unlikely to vary before and after being preserved when an ink is preserved. The term "rubfastness" indicates a property in which, when a cured object is rubbed, the cured object is unlikely to be peeled off and is thus unlikely to be damaged.

In addition, in the present specification, the term "(meth) acrylate" indicates at least one of acrylate and methacrylate corresponding thereto, the term "(meth)acryl" indicates at least one of acryl and methacryl corresponding thereto, and the term (meth)acryloyl indicates at least one of acryloyl and methacryloyl corresponding thereto.

Ink Jet Recording Method

An embodiment of the invention is related to an ink jet recording method. The ink jet recording method at least includes an ejecting step of heating a ultraviolet-ray curable ink with a viscosity in a predetermined range at 28° C. so as to have a viscosity in a predetermined range and ejecting the ink from a head to a recording medium, and a curing step of curing the ultraviolet-ray curable ink attached to the recording medium. In this way, a cured object of the ink is formed by the ink cured on the recording medium.

Viscosity at 28° C. of Ultraviolet-Ray Curable Ink

The ultraviolet-ray curable ink used for the recording method has a viscosity of 8 mPa·s or more at 28° C. By using the ultraviolet-ray curable ink with this viscosity, it is possible to effectively prevent occurrence of curing wrinkles in an obtained cured object. A principle in which the curing wrinkles is guessed as follows, but the scope of the invention is not limited by the following guess. Curing wrinkles are guessed to be generated since, when, in a coated film of ink, a surface of the coated film is cured earlier, and an inside of the coated film is cured later than the surface of the coated film, the coated film surface which is cured earlier is deformed, the ink inside the coated film irregularly flows until the ink is cured later, or the like. In addition, the ultraviolet-ray curable ink with a low viscosity is observed to tend to have a great polymerization shrinkage ratio according to the curing (a difference between a volume of an ink and a volume of the ink (cured object) after being cured with respect to a volume of the ink before being cured with predetermined mass), and, for this reason, occurrence of curing wrinkles is guessed to be notable. Further, an ultraviolet-ray curable ink which contains, particularly, (meth) acrylate containing mono-functional (meth)acrylate described later a vinyl ether group expressed in Formula (I) is observed to have a tendency in which curing wrinkles easily occur, and, particularly, in a low viscosity ultraviolet-ray curable ink which contains (meth)acrylate containing a vinyl ether group expressed in Formula (I), occurrence of curing wrinkles is guessed to be notable. An ultraviolet-ray curable ink used in the ink jet recording method of the present embodiment is made to be set in the above-described viscosity range, and thereby it is possible to effectively prevent occurrence of curing wrinkles even if these components are contained. In addition, a viscosity in the present specification employs a value measured using a method performed in Examples described later, but this does not intend to limit a method of measuring a viscosity, and a well-known measuring method in the related art may be used.

Particularly, a viscosity of the ink in the present embodiment may be measured using an E type viscometer. When the E type viscometer is used, to perform measurement according to an operation manual of the viscometer is a common sense, therefore, needless to say, the measurement is performed by setting the type or rotation speed of rotor according to the operation manual such that a viscosity of the ink which is a measurement target can be normally measured, and, also in the present embodiment, it is obvious that the measurement is performed by setting the a viscosity of the ink according to the operation manual such that a viscosity of the ink which is a measurement target can be normally measured.

Recording Medium

The recording medium may include, for example, a recording medium with an ink non-absorption nature or an ink low-absorption nature. Of the recording media, a recording medium with the ink non-absorption nature may include, for example, a medium in which plastic is coated on a base material such as a plastic film or paper in which surface treatment for ink jet recording is not performed (that is, an ink absorption layer is not formed), a medium to which a plastic film is attached, and the like. The plastic described here is not limited to the following, and may include, for example, Polyvinyl chloride (PVC), polyethylene terephthalate (PET), polycarbonate (PC), polystyrene (PS), polyurethane (PU), polyethylene (PE), and polypropylene (PP), and the like. Examples of the recording medium with the ink low-absorption nature are not limited to the following and may include printing paper such as art paper, coated paper and matte paper.

Ejecting Step

An ejecting step in the present embodiment is to eject an ultraviolet-ray curable ink from a head to a recording medium. In addition, a temperature of the ejected ultraviolet-ray curable ink is 28° C. to 40° C., and a viscosity of the ultraviolet-ray curable ink at the corresponding temperature is 15 mPa·s or less.

The temperature of 28° C. to 40° C. is a relatively low temperature for a temperature which is increased through heating. As such, if a temperature of an ejected ink (hereinafter, also referred to as "ejection temperature") is relatively low, it is possible to achieve advantageous effects in which, since deterioration in members of the head can be prevented, durability of the head is improved, and, since there is almost no variation in temperature, ejection stability and ejection amount stability of the ink become favorable.

Here, the "temperature of the ejected ultraviolet-ray curable ink" in the present specification is indicated by an average value of measured temperatures by continuously ejecting the ink from the head for sixty minutes and measuring a temperature every five minutes during that time.

Hereinafter, the ejection temperature will be described in detail. If the temperature is 28° C. or more, it is possible to reduce a fluctuation in an ejection amount in terms of a long term. In other words, the long-term ejection amount stability becomes good since a fluctuation in an environmental temperature (in an ink path described later) is suppressed. In addition to this, a viscosity of the ultraviolet-ray curable ink which can be ejected at a temperature lower than 28° C. is very low; however, there is a problem caused by the low viscosity, that is, a problem in that the members of the head deteriorate, durability of the head worsens, and curing wrinkles also easily occur. In contrast, the ink according to the present embodiment can solve the problem.

On the other hand, if the temperature is 40° C. or less, it is possible to reduce a fluctuation in an ejection amount in terms of a short term. In other words, the short-term ejection amount stability becomes good since a fluctuation in heating temperature is suppressed. In addition, an ultraviolet-ray curable ink of which an ink viscosity when heating temperature exceeds 40° C. is 15 mPa·s or less can prevent occurrence of curing wrinkles; however, since the heating temperature is very high, there is a problem in that durability of the head worsens, and the ejection amount stability also worsens. In contrast, the ink according to the present embodiment can solve the problem.

In addition, if the viscosity of ink at the ejection temperature is 15 mPa·s or less, it is possible to achieve advantageous effects in which the ejection stability and ejection amount stability of an ink become good. There is a problem in that the ejection stability worsens in a case where the viscosity of the ink is high, but, if the viscosity is 15 mPa·s or less, such a problem does not occur, and the ejection stability becomes good. On the other hand, in relation to the ejection amount stability, if the viscosity of the ink is low, a fluctuation range of an ejection amount is small, and, if the viscosity is 15 mPa·s or less, the fluctuation range of the ejection amount is sufficiently small, and thus the ejection amount stability becomes good.

In addition, in order to further increase the effect and reliably solve the problem, the ejection temperature is preferably 34° C. to 40° C. The upper limit of the viscosity of the ink at a predetermined ejection temperature is preferably 12 mPa·s or less. The lower limit of the viscosity is preferably 5 mPa·s or more, more preferably 7 mPa·s or more, and most preferably 8 mPa·s or more. If the lower limit of the viscosity of the ink at a predetermined ejection temperature is the above-described value, durability of the head due to a composition of the ink becomes favorable, occurrence of curing wrinkles due to a composition of the ink can be effectively prevented, and instability of ejection due to a low viscosity can be prevented. The fact that instability of ejection due to a low viscosity can be prevented means that the ejection stability and the ejection amount stability become better.

Further, the ultraviolet-ray curable ink, as described above, has a higher viscosity than an aqueous ink used for a typical ink for ink jet and has a great viscosity fluctuation depending on a temperature fluctuation during ejection. This viscosity fluctuation of the ink exerts great influence on a variation in a droplet size and a variation in a droplet ejection speed, and, further causes image quality deterioration. For this reason, preferably, a temperature of an ejected ink (ejection temperature) is maintained to be as constant as possible. In the ink according to the present embodiment, an ejection temperature is relatively low, and the ejection temperature can be maintained to be substantially constant by adjusting a temperature through heating. Therefore, the ink according to the present embodiment provides good image quality.

Here, a description will be made of an example of the ink design method for setting the viscosity of an ink in a desired range.

A mixed viscosity of all polymerizable compounds included in an ink can be calculated from viscosities of respective polymerizable compounds to be used and mass ratios to polymerizable compositions of the respective polymerizable compositions.

The ink is assumed to include the N types of polymerizable compounds including A, B . . . (omission) . . . , and N. A viscosity of a polymerizable compound A is set to VA, and a mass ratio of the polymerizable compound A to a total amount of the polymerizable compounds of the ink is set to MA. A viscosity of a polymerizable compound B is set to VB, and a mass ratio of the polymerizable compound B to a total amount of the polymerizable compounds of the ink is set to MB. Similarly, a viscosity of an N-th polymerizable compound N is set to VN, and a mass ratio of the polymerizable compound N to a total amount of the polymerizable compounds of the ink is set to MN. For confirmation, the equation "MA+MB+ . . . (omission)+MN=1" is established. In addition, a mixed viscosity of all the polymerizable compounds included in the ink is set to VX. Then, the following Equation (1) is assumed to be satisfied.

$$MA \times \text{Log } VA + MB \times \text{Log } VB + \ldots \text{(omission)} \ldots + MN \times \text{Log } VN = \text{Log } VX \quad (1)$$

In addition, for example, in a case where two kinds of polymerizable compounds are included in an ink, mass ratios of the polymerizable compounds after MB are set to zero. The number of kinds of polymerizable compounds may be any number of one or more kinds.

Next, an example of the procedures (steps 1 to 7) for setting an ink viscosity in a desired range will be described.

First, information of a viscosity at a predetermined temperature of each polymerizable compound to be used is obtained (step 1). An obtaining method may include obtaining a viscosity from a manufacturer's catalog, measuring a viscosity at a predetermined temperature of each polymerizable compound, or the like. Since a viscosity of a simple polymerizable compound may be different depending on manufacturers even in the same polymerizable compound, viscosity information provided by a manufacturer of a polymerizable compound to be used may be employed.

Successively, a target viscosity is set to VX, and a composition ratio (mass ratio) of each polymerizable compound is determined such that VX becomes the target viscosity based on above-described Equation (1) (step 2). The target viscosity is a viscosity of an ink composition which is desired to be finally obtained and is set to a viscosity in a range of 8 mPa·s to 15 mPa·s. The predetermined temperature is set to a temperature in a range of 28° C. to 40° C.

Next, the polymerizable compounds are practically mixed so as to prepare a composition of the polymerizable compounds (hereinafter, referred to as a "polymerizable composition"), and a viscosity thereof is measured at a predetermined temperature (step 3).

Successively, in a case where the viscosity of the polymerizable composition is approximately close to the target viscosity (in this step 4, "target viscosity±5 mPa·s"), an ink composition including the polymerizable composition and components other than the polymerizable compound such as a photopolymerization initiator and pigments (hereinafter, referred to as "components other than the polymerizable compound") is prepared, and a viscosity of the ink composition is measured (step 4). In this step 4, in a case where there is a component which is a component other than the polymerizable compound and is mixed in the ink composition in a form of a pigment dispersion such as, for example, pigments, since a polymerizable compound which is included in the pigment dispersion in advance is also carried into the ink composition, the ink composition is required to be adjusted to a mass ratio obtained by subtracting a mass ratio of the polymerizable compound carried into the ink composition as a pigment dispersion from the composition ratio of each polymerizable compound determined in step 2.

Next, a difference between the measured viscosity of the ink composition and the measured viscosity of the polymerizable composition is calculated and is set to VY (step 5). Here, normally, "VY>0". VY depends on the kind of component other than the polymerizable compound or an inclusion condition such as a content, and VY was 3 mPa·s to 5 mPa·s in Examples described later.

Next, "target viscosity in step 2-VY" is set to VX, and a composition ratio of each polymerizable compound is determined again such that VX becomes the set "target viscosity in step 2-VY" from above-described Equation (1) (step 6).

Next, the polymerizable compounds with the composition ratios determined in step 6 are mixed with components other than the polymerizable compound so as to prepare an ink composition, and a viscosity thereof at a predetermined temperature is measured (step 7). If the measured viscosity is the target viscosity, the ink composition prepared in step 7 is obtained as an ink composition with the target viscosity.

On the other hand, in a case where the measured viscosity of the prepared composition of the polymerizable compounds is not in a range of "target viscosity±5 mPa·s", the following fine adjustment is performed, and then the procedures are performed again from step 3. First, if the measured viscosity is too high, fine adjustment is adjusted in which a content of a polymerizable compound of which a viscosity as a simple substance is higher than the target viscosity is reduced, and, a content of a polymerizable compound of which a viscosity as a simple substance is lower than the target viscosity is increased. On the other hand, if the measured viscosity is too low, fine adjustment is adjusted in which a content of a polymerizable compound of which a viscosity as a simple substance is lower than the target viscosity is reduced, and, a content of a polymerizable compound of which a viscosity as a simple substance is higher than the target viscosity is increased. In addition, in a case where the measured viscosity of the prepared ink composition is not the target viscosity in step 7, adjustment such as the above-described fine adjustment is performed, and then the procedures are performed again from step 7.

Ink Supply Step

In the recording method of the present embodiment, recording may be performed using an ink jet recording apparatus in which at least a part of an ink path for supplying an ink from an ink container to a head is an ink circulation path for circulating the ink. In other words, in the recording method, the ink circulation path for circulating the ink is provided at least a part of the ink path for supplying the ink to the head of the ink jet recording apparatus, and an ink supply step of circulating the ink in the ink circulation path may be further included. An ink flowing out of the head is circulated in at least a part of the ink path, and thereby a temperature of the ink in the ink circulation path is easily stabilized, and, further, the ejection amount stability becomes better.

In the ink supply step, an inflow amount of an ultraviolet-ray curable ink (an ink inflow amount) supplied to the head from the ink circulation path may be adjusted such that an ink of the ink inflow amount is supplied to the head. The ink supply step may be performed during the ejecting step. In the ink supply step, it is preferable that the ink inflow amount be larger than an ejection amount in which an ink is ejected from the head during recording (printing) since outflow of the ink occurs and thus the ink is circulated. In addition, the ink inflow amount is more preferably larger than the maximum value (the maximum ink ejection amount described later) of an ejection amount in which an ink is ejected from the head, further preferably twice or more the maximum ink ejection amount, and still further preferably 2.5 times or more the maximum ink ejection amount. If the ink inflow amount is in the above-described range, the ejection amount stability becomes better. On the other hand, the upper limit of the ink inflow amount is not particularly limited and may be four times or less the maximum ink ejection amount. In addition, an amount of ink ejected from the head, that is, both the ink inflow amount and the maximum ink ejection amount are amounts in terms of a volume.

The ink supply step may be performed by providing a device which adjusts an ink supply amount (hereinafter, simply referred to as an "ink supply device"), for example, in the ink jet recording apparatus described later. The ink supply device will be described later.

Curing Step

In the curing step included in the recording method of the present embodiment, an ultraviolet-ray curable ink attached to a recording medium is irradiated with ultraviolet rays from a light source and is thus cured. In this step, the photopolymerization initiator included in the ink is decomposed by irradiation with the ultraviolet rays so as to generate initiating species such as a radical, an acid, and a base, and a polymerization reaction of photopolymerizable compounds is promoted by a function of the initiating species. Alternatively, in this step, a polymerization reaction of photopolymerizable compounds is initiated by irradiation with the ultraviolet rays. At this time, if there is a sensitizing dye along with the photopolymerization initiator in the ink, the sensitizing dye in a system absorbs the ultraviolet rays so as to be excited, and promotes decomposition of the photopolymerization initiator through contact with the photopolymerization initiator, thereby achieving a curing reaction of higher sensitivity.

A mercury lamp or a gas or solid-state laser is mainly used as the light source (ultraviolet light source), and, a mercury lamp or a metal-halide lamp is widely known as a light source used to cure an ultraviolet-ray curable ink. On the other hand, mercury-free is intensively desirable from the viewpoint of the protection of the environment at present, and thus replacement with a GaN-based semiconductor ultraviolet light emitting device is very useful industrially and environmentally. In addition, a light emitting diode (LED) such as an ultraviolet light emitting diode (UV-LED) and an ultraviolet laser diode (UV-LD) has small size, long life, high efficiency, and low costs, and is expected as a light source for an ultraviolet-ray curable ink.

As above, the ultraviolet-ray curable ink in the present embodiment can be used appropriately even if a light source is the LED or the metal halide lamp, but the LED is preferably used of the two.

An emission peak wavelength of the light source (ultraviolet light source) is preferably in a range of 360 nm to 420 nm, and is more preferably in a range of 380 nm to 410 nm. If the emission peak wavelength is in the above-described range, the UV-LED is easily obtained and is inexpensive, and is thus appropriate.

In addition, a peak intensity (irradiation peak intensity) of ultraviolet rays applied from a light source (preferably, the LED) which has an emission peak wavelength in the above-described range is preferably 800 mW/cm$^2$ or more, and more preferably 1000 mW/cm$^2$ or more. The upper limit of the irradiation peak intensity is not particularly limited and may be 3000 mW/cm$^2$ or less. If the irradiation peak intensity is in the above-described range, the curability becomes better, and it is possible to more effective suppress occurrence of curing wrinkles. A principle of occurrence of the curing wrinkles is guessed as described above, and if the irradiation peak intensity is in the above-described range, up to inside can be cured at the same time as a surface of a coated film being cured, and thus it is guessed that the ultraviolet rays can effectively suppress occurrence of curing wrinkles. If a viscosity at 28° C. of the ultraviolet-ray curable ink of the present embodiment is 8 mPa·s or more, it is possible to more effectively prevent occurrence of curing wrinkles. Particularly, if the ultraviolet-ray curable ink includes (meth)acrylates containing a vinyl ether group expressed in Formula (I) described later, and an irradiation peak intensity is in the above-described range, the curability becomes better, and it is possible to more effectively suppress occurrence of curing wrinkles.

In addition, the irradiation peak intensity in the present specification employs a value measured using an ultraviolet ray intensity meter UM-10 and a light reception unit UM-400 (both of the two are manufactured by KONICA MINOLTA SENSING, INC.). However, this does not intends to limit a measurement method of an irradiation peak intensity, and a well-known measurement method in the related art may be used.

An ultraviolet-ray curable ink which can be cured with an irradiation energy of preferably 600 mJ/cm$^2$ or less and more preferably 200 mJ/cm$^2$ to 500 mJ/cm$^2$ from a light source having an emission peak wavelength in the above-described range may be used for the recording method of the present embodiment. In this case, it is possible to easily increase an output of the LED and to realize low cost printing and high printing speed. Here, the irradiation energy is a total irradiation energy obtained by summing respective irradiation energies if the irradiation is performed in plurality.

In addition, the irradiation energy in the present specification is calculated by multiplying time from irradiation start to irradiation end by an irradiation peak intensity. In addition, if the irradiation is performed in plurality, the irradiation energy is expressed by an irradiation energy amount obtained by summing a plurality of irradiations. An emission peak wavelength may be singly or in plurality in the above-described preferable wavelength range. Even if there are a plurality of wavelengths, an irradiation energy amount of all the ultraviolet rays having the emission peak wavelengths in the above-described range is used as the irradiation energy.

This ink is obtained by including at least one of a photopolymerization initiator which is decomposed through irradiation with ultraviolet rays in the above-described wavelength range and a polymerizable compound which initiates polymerization through irradiation with ultraviolet rays in the above-described wavelength range.

In addition, an ejection amount (an attachment amount, an implantation amount) of an ink per unit area during ejection onto a recording medium is preferably 5 mg/inch$^2$ to 16 mg/inch$^2$ in order to prevent wasteful use of the ink.

In addition, the ejection amount of an ink per unit area is varied depending on a recording resolution and an ink amount implanted into a recording unit region (pixel) regulated by the recording resolution, but is preferably 300 dpi×300 dpi to 1500 dpi×1500 dpi when the recording resolution (printing resolution) is expressed by "resolution in a sub-scanning direction×a resolution in a direction (main scanning direction) intersecting the sub-scanning direction". In addition, a nozzle density of the head and an ejection amount are preferably adjusted according to this recording resolution.

In addition, an ejection amount of ink per pixel is preferably 2 ng/pixel to 200 ng/pixel, and more preferably 3 ng/pixel to 160 ng/pixel. Further, the nozzle density (a distance between the nozzles in a nozzle string) is preferably 180 dpi to 720 dpi, and more preferably 300 dpi to 720 dpi.

As above, according to the present embodiment, it is possible to provide an ink jet recording method in which durability of the head, and the ejection stability and the ejection amount stability (short term and long term) of the ultraviolet-ray curable ink are good, and, further, solubility of the photopolymerization initiator included in the ultraviolet-ray curable ink, curability of the ultraviolet-ray curable ink, and suppression of curing wrinkles are also good.

Ink Jet Recording Apparatus

An embodiment of the invention is related to an ink jet recording apparatus, that is, an ink jet printer. The recording apparatus uses the ink jet recording method of the above-described embodiment. The recording apparatus (printer) for performing the recording method will be described in detail.

FIG. 1 is a block diagram illustrating an example of the configuration of the ink jet recording apparatus according to the present embodiment. A computer 130 includes a printer driver installed therein, and outputs printing data according to an image to a printer 1 so as to make the printer 1 record the image. The printer 1 includes a transport unit 20, a head unit 30, an irradiation unit 40, an ink supply unit (not shown), a detector group 110, a memory 123, and an interface (I/F) 121, and a controller 120. The printer 1 which has received printing data from the computer 130 which is an external apparatus controls each unit using the controller 120, and records an image on a recording medium according to the printing data. Circumstances inside the printer 1 are monitored by the detector group 110, and the detector group 110 outputs a detection result to the controller 120. The controller 120 controls each unit based on the detection result output from the detector group 110. The controller 120 stores the printing data which is input via the interface 121 in the memory 123, and includes a CPU 122 and a unit control circuit 124. The memory 123 stores control information for controlling each unit.

The printer of the present embodiment can record inks of various colors (forms an image) on a recording medium, for example, may form an image using inks of four colors of CMYK (cyan, magenta, yellow, and black), or may form a ground image which gives good concealment to a recording medium using a white ink.

The printer of the present embodiment may include a line printer and a serial printer, and either one may be used. They are different in a printer method.

The line printer which is a line type ink jet recording apparatus has a line head with a length equal to or more than a length corresponding to a width of a recording medium as a head. The line head and the recording medium are moved at relative positions in a scanning direction intersecting the width direction, and an ink is ejected from the line head to the recording medium, that is, the recording medium which is scanned relatively to the line head. In addition, in the line printer, the head is (almost) not moved and is fixed, and performs recording in one pass (a single pass). The line printer is more advantageous than the serial printer in that recording speed is high.

Here, the "line head with a length corresponding to a width of a recording medium" is not limited to a case where the width of the recording medium completely conforms to the length (width) of the line head, and may be different from each other. A case of being different from each other may include, for example, a case where a length (width) of the line head is a length corresponding to a width (recording width) of the recording medium on which an ink is to be ejected (an image is to be recorded).

On the other hand, in the serial printer which is a serial type ink jet recording apparatus, a head is moved in a main scanning direction intersecting a sub-scanning direction of a recording medium and performs main scanning (pass) for ejecting an ink, so as to normally perform recording in two or more passes (multi-pass).

Ink Jet Head

The head unit 30 of the ink jet recording apparatus (the printer 1) includes a head (an ink jet head) which ejects an ultraviolet-ray curable ink to a recording medium and performs recording. The head at least includes a cavity which ejects an accommodated ink from a nozzle, an ejection driving portion which is provided for each cavity and applies an ejection driving force to the ink, and the nozzle which is provided for each cavity and ejects the ink to outside of the head. The cavity, and the ejection driving portion and the nozzle which are provided for each cavity may be provided in a single head in plurality independently from each other. The ejection driving portion may be formed using an electromechanical conversion element such as a piezoelectric element which varies a volume of the cavity through mechanical deformation, an electrothermal conversion element which generates bubbles in an ink and ejects the ink by emitting heat, or the like. In the ink jet recording apparatus, the head may be provided singly or in plurality for a single color ink. Of them, in a case where a plurality of heads are provided, a line head may be formed by arranging a plurality of head in the width direction of a recording medium, and thereby the above-described recording width can be further lengthened. In a case where recording is performed using inks of a plurality of colors, the ink jet recording apparatus includes a head for each ink. Here, the head included in the serial printer or the line printer which is a printer of the present embodiment is preferably a head in which an epoxy resin is used in at least a part of a portion which comes into contact with an ink such as inside or a surface of the head. The epoxy resin may be used as, for example, an adhesive which adheres members of the head to each other when the head is manufactured. If the head using an adhesive of the epoxy resin is employed, a strong adhesive force between the members of the head can be maintained, particularly, even if a temperature variation occurs in the head. The term "contact with an ink" includes direct contact with ink, and indirect contact with an ink through permeation of a constituent component of the ink. At this time, since the ultraviolet-ray curable ink in the present embodiment can prevent the adhesive of an epoxy resin from swelling, it is difficult for deterioration including alteration, and thus the durability of the head becomes good. As above, the ultraviolet-ray curable ink can be appropriately ejected from the head using the adhesive of an epoxy resin.

The adhesive of an epoxy resin is not limited to the following, and may include, for example, a well-known adhesive in the related art in which a main agent including a compound with an epoxy group is cured by a curing agent. The compound with an epoxy group included in the main agent is not limited to the following, and may include, for example, bisphenol type epoxy such as bisphenol A type and bisphenol F type, novolak type epoxy such as phenol novolac type and cresol novolac type, epoxy polyol type epoxy, urethane-modified epoxy, chelate-modified epoxy, and rubber-modified epoxy. The curing agent is not limited to the following, and may include, for example, amines such as polyamine and amines, acid anhydrides, amides such as amide and polyamide, imidazoles, and polymercaptan. Among them, a combination of the bisphenol type epoxy as a main agent and amines as a curing agent is preferably used for a good adhesive force. A mixing ratio (main agent:curing agent) of the main agent and the curing agent is preferably 10:1 to 1:10 in terms of mass for good curability of an adhesive. The head may be formed in such a manner as in FIG. 3 or the like of JP-A-2009-279830.

Hereinafter, the printer of the present embodiment will be described in more detail with reference to the drawings. In addition, the scope of the invention is not limited to the following drawings at all. Further, in each drawing used for the following description, a scale of each member is appropriately changed such that each member has a recognizable size.

Line Printer

Figure 2:
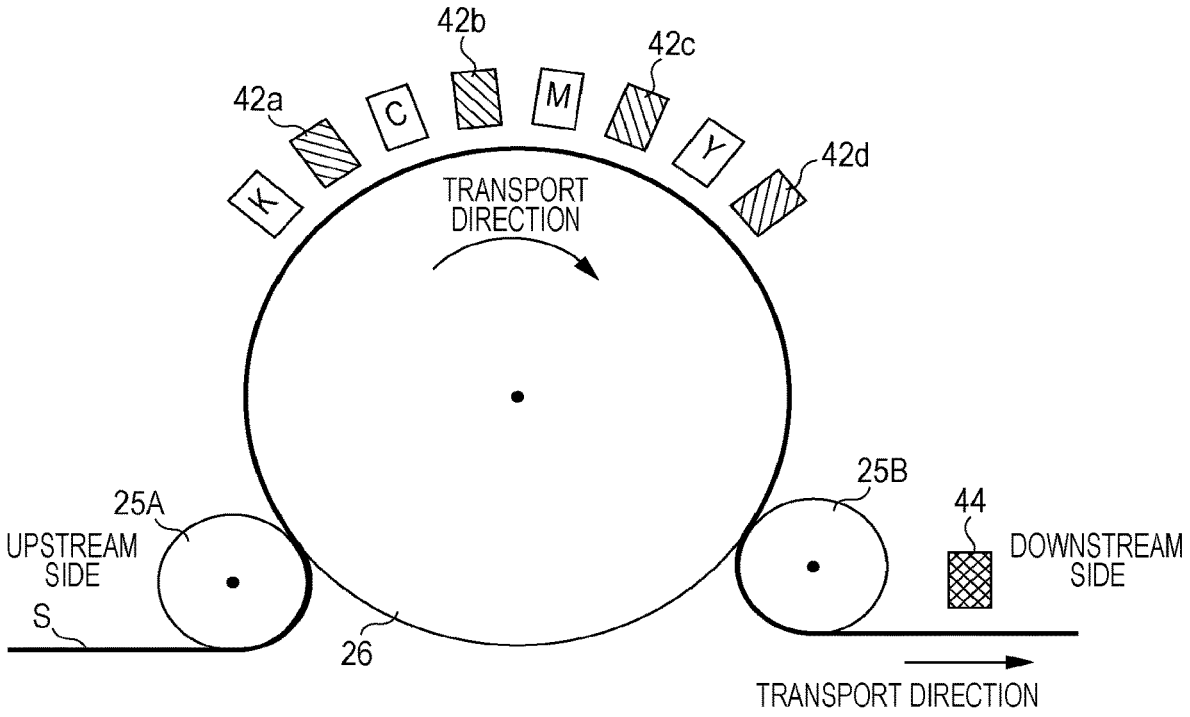
FIG. 2 is a schematic cross-sectional view illustrating an example of the periphery of a head unit, a transport unit, and an irradiation unit in a line printer which is an example of the ink jet recording apparatus of the invention.

FIG. 2 is a schematic cross-sectional view illustrating an example of the periphery of the head unit, the transport unit, and the irradiation unit of the above-described line printer which is an example of the printer of the present embodiment.

Transport rollers including an upstream side roller 25A and a downstream side roller 25B are rotated by a transport motor (not shown), and a transport drum 26 is driven. A recording medium S is transported according to rotation of the transport rollers along the peripheral surfaces of the transport rollers and the transport drum 26. Respective heads including a head K, a head C, a head M, and a head Y are disposed opposite to the transport drum 26 around the transport drum 26, and recording is performed through the ejecting step of ejecting inks to the recording medium S facing the heads so as to be attached thereto. Temporary curing irradiation portions 42*a*, 42*b*, 42*c* and 42*d* are disposed on the downstream sides in the transport direction of the respective heads, and irradiate the recording medium S with ultraviolet rays. A main curing irradiation portion 44 is disposed further on the downstream side in the transport direction. This recording apparatus may be formed in such a manner as in FIG. 11 of JP-A-2010-269471, for example.

In the present specification, the "temporary curing" indicates temporary tacking (pinning) of an ink, and, more specifically, indicates curing before main curing in order to prevent smearing between dots or control a dot diameter. Generally, a polymerization degree of polymerizable compounds in the temporary curing is lower than a polymerization degree of the polymerizable compounds in the main curing which is performed next to the temporary curing. In addition, the "main curing" indicates that the dots formed on the recording medium are cured up to a curing state necessary to use a recorded matter. Here, in the present specification, just "curing" indicates main curing unless particularly mentioned.

In addition, since ink may be irradiated with ultraviolet rays from the main curing irradiation portion 44 and undergo main curing, some or all of the temporary curing irradiation portions 42*a*, 42*b*, 42*c* and 42*d* may not apply ultraviolet rays and the main curing irradiation portion 44 may apply ultraviolet rays, thereby finishing the curing step. As such, in the curing step, the temporary curing may not be performed, and only the main curing may be performed.

Ink Supply Device

The ink supply unit of the ink jet recording apparatus of the present embodiment may include a device adjusting an ink supply amount (an ink supply device) as described above. The above-described ink supply amount adjustment step may be performed, for example, by providing the ink supply device in the ink jet recording apparatus described later. The ink supply device may be provided, for example, between an ink container such as an ink tank or an ink cartridge and the head. In addition, the ink supply device has an ink circulation path in at least a part of an ink path for supplying ink from the ink container to the head and thus can adjust an ink inflow amount to the head. More specifically, first, the ink supply device adjusts an ink inflow amount which is supplied from the ink circulation path to the head. Second, the ink supply device ejects an ink of at least some of flow (this ejected amount is an ejection amount), and can return a residue (an ink outflow amount) of the flow to the ink circulation path from the head. Therefore, for example, when an ink inflow amount supplied to the head is equal to or more than an amount of the ink ejected from the head (an ink ejection amount), the ink flows out of the head and returns to the ink circulation path, and thereby the ink is circulated. In addition, when the ink inflow amount is twice or more the ink ejection amount, the ink outflow amount is one or more times the ink ejection amount.

Figure 3:
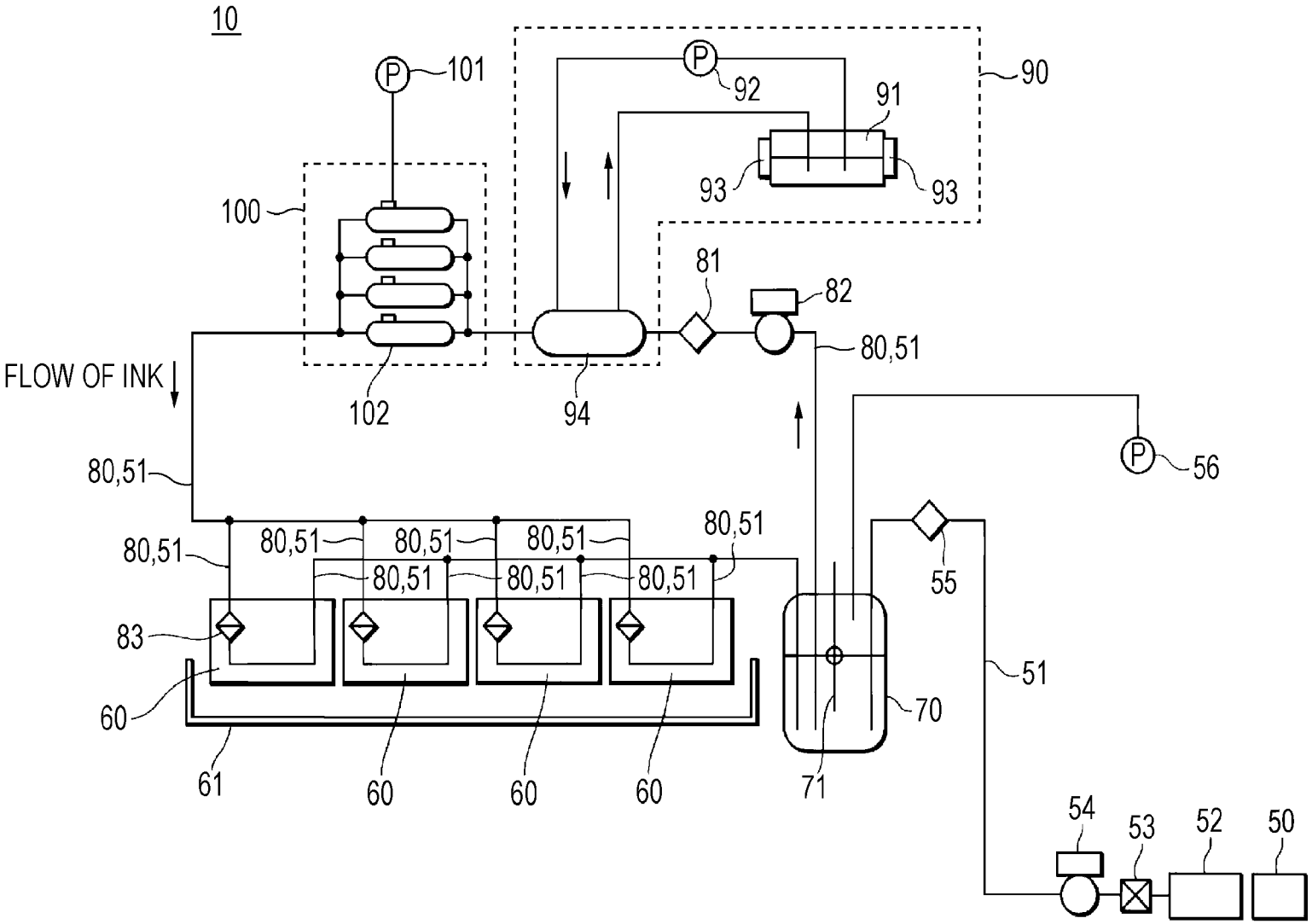
FIG. 3 is a schematic front view illustrating an example of the ink supply device included in the ink jet recording apparatus of the invention.

Hereinafter, the ink supply device will be described with reference to the drawing. FIG. 3 is a schematic front view illustrating an example of the ink supply device 10 included in the ink jet recording apparatus of the present embodiment.

1. Device Configuration

The ink supply device 10 is located between an ink cartridge 50 and a head 60 in the ink jet recording apparatus. The ink supply device 10 includes an ink cartridge 50, an ink path 51 including an ink circulation path 80, a sub-tank 70, a heating mechanism 90, a degassing mechanism 100, and heads 60. The heads 60 are included in the above-described head unit 30.

The ink cartridge 50 is used to accommodate an ultraviolet-ray curable ink. A holder 52 is used to install the ink cartridge 50. The ink path 51 includes the ink circulation path 80 and is a flow channel which allows an ink to pass from the ink cartridge 50 to the heads 60. In other words, at least a part of the ink path 51 which supplies ink from the ink cartridge 50 which is an ink container to the heads 60 is the ink circulation path 80 which circulates the ink. In the ink path 51, the holder 52, a valve 53, a supply pump 54, and a filter 55 are provided in a pipe between the ink cartridge 50 and the sub-tank 70.

The valve 53 is opened when the ink cartridge 50 accommodating the ink is installed in the holder 52. When the valve 53 is opened, the supply pump 54 pushes out the ink from the ink cartridge 50 to the ink path 51. The ink path 51 supplies the ink pushed out from the ink cartridge 50 by the supply pump 54 to the sub-tank 70 via the filter 55 which filters foreign substances in the ink. A pressing pump 56 presses the sub-tank 70 and supplies the ink to the ink circulation path 80 from the sub-tank 70.

The sub-tank 70 supplies the ink to the ink circulation path 80 when a fluid volume sensor 71 detects a fluid volume of the ink in the sub-tank 70 and the fluid volume is equal to or more than a predetermined first fluid volume, and receives the ink from the ink cartridge 50 when the fluid volume is equal to or less than a predetermined second fluid volume.

The ink circulation path 80 is connected to the sub-tank 70 and the heads 60, is supplied with the ink from the sub-tank 70, and supplies the ink to the heads 60. The ink circulation path 80 is a pipe which includes a filter 81, a circulation pump 82, and a head filter 83. The ink supplied from the sub-tank 70 is circulated in the ink circulation path 80 by the circulation pump 82. The filter 81 is provided on a downstream side of the circulation pump 82 of the ink circulation path 80 and filters foreign substances in the ink. A part of the ink circulation path 80 is provided in the head 60, and at least some of the circulated ink is ejected from the head 60 via the head filter 83 which filters foreign substances in the ink.

The heating mechanism 90 and the degassing mechanism 100 are located in the middle of the ink circulation path 80, that is, between the sub-tank 70 and the heads 60.

The heating mechanism 90 is provided at a position other than the position which is connected to at least the heads 60 in the ink circulation path 80. Here, the "position which is connected to at least the heads 60 in the ink circulation path 80" corresponds to a coupling portion of the ink circulation path 80 which is located outside the heads 60 in FIG. 3. The heating mechanism 90 heats the ink in the ink circulation path 80 using a temperature adjustment module 94 while circulating warm water of a warm water tank 91 between the temperature adjustment module 94 and the warm water tank 91 using a warm water circulating pump 92. A heater 93 of the warm water tank 91 adjusts a temperature of the circulated ink to a target temperature.

The degassing mechanism 100 is provided further on the downstream side than the temperature adjustment module 94 of the ink circulation path 80 and further on the upstream side than the heads 60. A degassing module 102 includes a degassing chamber (not shown) into which the ink flows, and a decompression chamber (not shown) which comes into contact with the degassing chamber via a separation membrane which does not allow a liquid such as an ink to pass therethrough. A negative pressure pump 101 reduces the pressure of the decompression chamber. When the decompression chamber is decompressed, a dissolved air content of the ink in the ink circulation path 80 is reduced and thereby bubbles are removed. In this way, the degassing mechanism 100 degases the ink in the ink circulation path 80.

The head 60 is used to eject the ink to a recording medium. The head 60 includes a nozzle (not shown) which ejects the ink, a nozzle plate which has a nozzle surface on which the nozzle is formed, a cavity (not shown) which communicates with the nozzles and accommodates the ink, a reservoir (not shown) which prevents reverse flow of the ink, and an ejection driving portion (not shown) which applies an ejection driving force to the ink accommodated in the cavity so as to form an ink droplet suitable for ejection and ejects the droplet from the nozzle. In FIG. 3, for example, the cavity is a pressure generation chamber, and the ejection driving portion is a piezoelectric element. A cap 61 prevents an ink attached around the nozzle from being dried when the recording apparatus is not used and thus protects the nozzles of the heads 60.

In FIG. 3, in the ink circulation path 80, four heads 60 are provided in parallel. As above, preferably, there are a plurality of heads 60 to which an ink is supplied from the ink circulation path 80, and the ink is ejected from the plurality of heads 60. In this case, as described later, since a single ink circulation path 80 is present with respect to a plurality of heads 60, the ink circulation path 80 or the temperature adjustment module 94 is used in common, and thus temperatures of inks supplied to the four heads 60 can be made to be uniform, and, further, it is possible to achieve low costs of the recording apparatus.

In addition, as proved in Examples described later, according to the recording apparatus of the present embodiment, even in a case where a plurality of heads are provided and a recordable width is increased, an ink inflow amount is set to a predetermined value, and thereby the ejection amount stability becomes good.

2. Operation of Apparatus

First, initial filling of an ink is performed. When the ink cartridge 50 accommodating the ink is installed in the holder 52, the valve 53 is "opened", and the ink is supplied to the sub-tank 70 via the filter 55 which filters foreign substances in the ink by the supply pump 54. When the fluid volume sensor 71 detects that an ink fluid volume in the sub-tank 70 is equal to or more than a predetermined first fluid volume, the supply pump 54 stops and the valve 53 is "closed". The sub-tank 70 is pressed by the pressing pump 56 such that the ink is supplied from the sub-tank 70 to the ink circulation path 80. Here, when a fluid volume of the sub-tank 70 is less than a predetermined second fluid volume (that is, an amount smaller than the predetermined first fluid volume) before the ink circulation path 80 is completely filled with the ink, the pressing pump 56 temporarily stops and the sub-tank 70 returns to an ordinary pressure. In addition, in the above-described way, the ink is supplied again from the ink cartridge 50 to the sub-tank 70, and the ink is supplied again from the sub-tank 70 to the ink circulation path 80. When the ink circulation path 80 is completely filled with the ink by repeatedly performing this operation, the pressing pump 56 stops, the sub-tank 70 returns to an atmospheric pressure, and the ink is supplied again from the ink cartridge 50 to the sub-tank 70 such that a fluid volume of the sub-tank 70 is equal to or more than the predetermined first fluid volume. In this way, the initial filling of an ink is completed.

If the initial filling of the ink is completed, successively, the ink is circulated in the ink circulation path 80 by the circulation pump 82. The heating mechanism 90 in which the heater 93 is in an ON state in advance circulates the warm water of the warm water tank 91 between the temperature adjustment module 94 and the warm water tank 91 using the warm water circulating pump 92. In addition, the temperature adjustment module 94 heats the ink which is circulated in the ink circulation path 80. The filter 81 provided on the downstream side of the circulation pump 82 of the ink circulation path 80 filters foreign substances of the ink. The degassing module 102 of the degassing mechanism 100 includes the degassing chamber (not shown) into which the ink flows, and the decompression chamber (not shown) which comes into contact with the degassing chamber via a separation membrane which allows a gas such as air to pass therethrough and does not allow a liquid such as an ink to pass therethrough. When the decompression chamber is decompressed by the negative pressure pump 101, bubbles or dissolve air included in the ink inside the degassing chamber flees to the decompression chamber via the separation membrane, and thus a dissolved air content is reduced and thus bubbles are removed from the ink in the ink circulation path 80. Since four degassing modules 102 are provided in parallel, degassing efficiency increases, and thus it is possible to degas the ink while circulating the ink. Since the degassing mechanism 100 is provided further on the downstream side than the temperature adjustment module 94, it is possible to perform degassing at a position where an ink temperature is the highest in the ink circulation path 80. For this reason, degassing efficiency of the ink is very high, and, the degassing module 102 is located further on the downstream side than the circulation pump 82, and thus it is possible to perform degassing at a position where a pressure of the ink is high and to thereby notably increase degassing efficiency.

In addition, in the ink circulation path 80, four heads 60 are provided in parallel. In the ink circulation path 80 inside the head 60, the reservoir (not shown) is provided further on the downstream side than the head filter 83 which filters foreign substances of the ink. The inks which flow into the heads and pass through the reservoir flow out of the heads 60 again, and the inks which flow out of the respective heads 60 join in the coupling portion of the ink circulation path 80 and return to the sub-tank 70. The reservoir is connected to six hundred pressure generation chambers (not shown) which are provided for each head, and the piezoelectric element (not shown) provided for each pressure generation chamber is separately driven, thereby changing a volume of the pressure generation chamber. In addition, the nozzle (not shown) is provided for each pressure generation chamber, and the ink can be ejected from the nozzle to outside. Since the ink supply device is common to the four heads, the ink circulation path 80 or the temperature adjustment module 94 is used in common, and thus temperatures of inks supplied to the four heads 60 can be made to be uniform, and, further, it is possible to achieve low costs of the recording apparatus. The ink which has returned to the sub-tank 70 is circulated in the ink circulation path 80 again. When the head 60 is assembled by adhering members forming the reservoir, the above-described adhesive of an epoxy resin is used. In addition, although, in FIG. 3, the ink circulation path 80 passes the inside of the head 60, the ink circulation path may pass not the inside of the head but the outside of the head, and the ink may be supplied to the reservoir in the head from the ink circulation path which passes the outside of the head. In this case, circulation of the ink is performed up to the ink circulation path which passes through the outside of the head. However, also in this case, an ink which flows into the ink circulation path is set as an ink which flows into the head, and an ink which flows out of the ink circulation path is set as an ink which flows out of the head.

Successively, preparation before printing starts is performed. Ink circulation is performed for fifteen minutes so as to stabilize a temperature of the ink in the ink circulation path 80. The ink temperature is detected as a temperature of the nozzle by a temperature sensor (not shown) provided around the nozzle, and is adjusted to a target temperature before printing and during printing by controlling the heater 93 of the warm water tank 91. When the printing preparation is completed, the piezoelectric element is separately driven so as to eject the ink from the head, and thereby printing starts.

An ink inflow amount of the ink circulation path 80 is preferably larger than an ejection amount in which the ink is ejected from the head, during printing, as described above. In order to set the ink inflow amount and the ejection amount to this relationship, the ink inflow amount may be larger than the above-described maximum ink ejection amount. In addition, as described above, the ink inflow amount is preferably larger than the maximum ink ejection amount, and more preferably twice or more the maximum ink ejection amount. The ink inflow amount which flows into the heads 60 from the ink circulation path 80 is set to A (mL/min), the maximum ink ejection amount in which all the nozzles of all the heads 60 are driven at the maximum driving frequency during printing and which is an ejection amount when the ink is ejected in the maximum amount of the ink per driving which can be ejected during the printing is set to B (mL/min), and the ink outflow amount which flows out of the heads 60 to the ink circulation path 80 when the heads 60 eject in the maximum ink ejection amount is set to C (mL/min). At this time, settings are performed so as to satisfy the following equation.

$$A \geq 2B = 2(A-C) \quad \text{(i)}$$

The ink inflow amount is set to satisfy Equation (i), and the ink is circulated, and thereby an ink temperature and a degassing degree can be further stabilized. In addition, by performing this printing preparation, it is possible to stabilize an ink temperature and a degassing degree in advance before printing starts. Further, an ejection amount of the heads may be the maximum ink ejection amount to the maximum. However, an ejection amount during practical printing may be varied depending on an ejection state such as whether or not each nozzle is driven according to an image to be recorded, and a practical ink outflow amount may be varied depending on this variation. Setting information regarding the ink inflow amount is determined in advance based on the maximum ink ejection amount and the like of the ink jet recording apparatus and is stored in the above-described memory 123 or the like, and the controller 120 controls an ink inflow amount based on the information. In addition, the maximum ink ejection amount may be grasped by performing ejection in the above-described condition. In addition, if the maximum ink ejection amount for each of the heads 60 is set to D (mL/min), "B=4D". During printing, a fluid volume of the sub-tank 70 is gradually reduced according to the ejection of the ink. Therefore, the ink is normally supplied to the sub-tank 70 by the supply pump 54 during printing such that a fluid volume of the sub-tank 70 is equal to or more than the predetermined first fluid volume at all times. In addition, although not included in the ink supply device 10 shown in FIG. 3, a temperature adjustment module may be further provided at any position in the ink path 51 between the supply pump 54 and the sub-tank 70 in order to stabilize an ink temperature during printing.

As above, according to the present embodiment, it is possible to provide an ink jet recording apparatus using an ink jet recording method in which durability of the head, and the ejection stability and the ejection amount stability (short term and long term) of the ultraviolet-ray curable ink are good, and, further, solubility of the photopolymerization initiator included in the ultraviolet-ray curable ink, curability of the ultraviolet-ray curable ink, and suppression of curing wrinkles are also good.

Ultraviolet-Ray Curable Ink

In addition, an embodiment of the invention is related to an ultraviolet-ray curable ink which can be used for the ink jet recording method and the ink jet recording apparatus of the above-described embodiment. Above-described, in the ultraviolet-ray curable ink, a viscosity at 28° C., an ejection temperature, and a viscosity at the temperature are respectively in predetermined ranges. An ink for setting the viscosity in a predetermined range may be designed using the above-described ink design method.

Hereinafter, a description will be made of additives (components) which are included in the ultraviolet-ray curable ink (hereinafter, simply referred to as an "ink") of the present embodiment or which are included and obtained as desired.

Polymerizable Compound

Polymerizable compounds included in the ink of the present embodiment are polymerized independently or by action of a photopolymerization initiator described later when light is applied, and can cure a printed ink. As other polymerizable compounds, various well-known monomers and oligomers in the related art such as monofunction, bifunction, and multifunction of trifunction or higher may be used. The monomers may include, for example, (meth) acrylic acid, itaconic acid, crotonic acid, unsaturated carboxylic acid such as isocrotonic acid and maleic acid or its salt or ester, urethane, amide and its anhydride, acrylonitrile, styrene, various unsaturated polyesters, unsaturated polyethers, unsaturated polyamides, and unsaturated urethanes. In addition, the oligomers may include, for example, oligomers formed from the monomers such as linear acrylic oligomers, epoxy (meth)acrylate, oxetane (meth)acrylate, aliphatic urethane (meth)acrylate, aromatic urethane (meth) acrylate, and polyester (meth)acrylate.

Among them, (meth)acrylic acid esters, that is, (meth) acrylates are preferable. Among the (meth)acrylates, at least one of (meth)acrylic acid esters containing a vinyl ether group expressed in Formula (I) and other monofunctional (meth)acrylates is preferable, (meth)acrylic acid esters containing a vinyl ether group is more preferable, and (meth) acrylic acid esters containing a vinyl ether group and other monofunctional (meth)acrylates are still more preferable.

Hereinafter, the polymerizable compound will be described in detail mainly based on the (meth)acrylate.

1. (Meth)Acrylic Acid Esters Containing Vinyl Ether Group

The ink of the present embodiment preferably includes (meth)acrylic acid esters containing a vinyl ether group expressed in the following Formula (I).

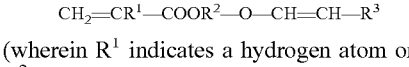

$$CH_2{=}CR^1{-}COOR^2{-}O{-}CH{=}CH{-}R^3 \quad (I)$$

(wherein $R^1$ indicates a hydrogen atom or a methyl group, $R^2$ indicates a divalent organic residue having 2 to 20 carbon atoms, and $R^3$ indicates a hydrogen atom or a monovalent organic residue having 1 to 11 carbon atoms).

The ink includes the (meth)acrylic acid esters containing a vinyl ether group, a viscosity of the ink can be reduced, durability of the ink becomes good, and occurrence of curing wrinkles can be effectively prevented. Further, it is more preferable in making curability of the ink favorable to use a compound having the vinyl ether group and the (meth)acryl group in a single molecule than to use a compound having the vinyl ether group and a compound having the (meth) acryl group separately.

In Formula (I), as the divalent organic residue having 2 to 20 carbon atoms indicated by $R^2$, a linear, branched or cyclic alkylene group having 2 to 20 carbon atoms which may be substituted, an alkylene group having 2 to 20 carbon atoms which may be substituted and having an oxygen atom by an ether linkage and/or an ester linkage in a structure, and a divalent aromatic group having 6 to 11 carbon atoms which may be substituted are preferable. Among them, an alkylene group having 2 to 6 carbon atoms such as an ethylene group, an n-propylene group, an isopropylene group, and a butylene group, and an alkylene group having 2 to 9 carbon atoms and having an oxygen atom in a structure by an ether linkage such as an oxyethylene group, an oxy n-propylene group, an oxyisopropylene group, and oxybutylene group are preferably used.

In Formula (I), as the monovalent organic residue having 1 to 11 carbon atoms indicated by R3, a linear, branched or cyclic alkylene group having 1 to 10 carbon atoms which may be substituted, and an aromatic group having 6 to 11 carbon atoms which may be substituted are preferable. Among them, an alkyl group having 1 or 2 carbon atoms such as a methyl group or an ethyl group, and an aromatic group having 6 to 8 carbon atoms such as a phenyl group or a benzyl group are preferably used.

In a case where each organic residue is a group which may be substituted, the substituent may be divided into a group having a carbon atom and a group not having a carbon atom. First, in a case where the substituent is a group having a carbon atom, the carbon atom is included in a carbon number of the organic residue. The group having a carbon atom is not limited to the following, and may include, for example, a carboxyl group, and an alkoxy group. Next, the group not having a carbon atom is not limited to the following, and may include, for example, a hydroxyl group, and a halo group.

The (meth)acrylic acid esters containing a vinyl ether group is not limited to the following, and may include, for example, 2-vinyloxyethyl (meth)acrylate, 3-vinyloxypropyl (meth)acrylate, 1-methyl-2-vinyloxyethyl (meth)acrylate, 2-vinyloxypropyl (meth)acrylate, 4-vinyloxybutyl (meth) acrylate, 1-methyl-3-vinyloxypropyl (meth)acrylate, 1-vinyloxymethylpropyl (meth)acrylate, 2-methyl-3-vinyloxypropyl (meth)acrylate, 1,1-dimethyl-2-vinyloxyethyl (meth) acrylate, 3-vinyloxybutyl (meth)acrylate, 1-methyl-2-vinyloxypropyl (meth)acrylate, 2-vinyloxybutyl (meth) acrylate, 4-vinyloxycyclohexyl (meth)acrylate, 6-vinyloxyhexyl (meth)acrylate, 4-vinyloxymethylcyclohexylmethyl (meth)acrylate, 3-vinyloxymethylcyclohexylmethyl (meth)acrylate, 2-vinyloxymethylcyclohexylmethyl (meth)acrylate, p-vinyloxymethylphenylmethyl (meth)acrylate, m-vinyloxymethylphenylmethyl (meth)acrylate, o-vinyloxymethylphenylmethyl (meth)acrylate, 2-(vinyloxyethoxy)ethyl (meth)acrylate, 2-(vinyloxyisopropoxy)ethyl (meth)acrylate, 2-(vinyloxyethoxy)propyl (meth)acrylate, 2-(vinyloxyethoxy)isopropyl (meth)acrylate, 2-(vinyloxyisopropoxy)propyl (meth)acrylate, 2-(vinyloxyisopropoxy) isopropyl (meth)acrylate, 2-(vinyloxyethoxyethoxy)ethyl (meth)acrylate, 2-(vinyloxyethoxyisopropoxy)ethyl (meth) acrylate, 2-(vinyloxyisopropoxyethoxy)ethyl (meth)acrylate, 2-(vinyloxyisopropoxyisopropoxy)ethyl (meth)acrylate, 2-(vinyloxyethoxyethoxy)propyl (meth)acrylate, 2-(vinyloxyethoxyisopropoxy)propyl (meth)acrylate, 2-(vinyloxyisopropoxyethoxy)propyl (meth)acrylate, 2-(vinyloxyisopropoxyisopropoxy)propyl (meth)acrylate, 2-(vinyloxyethoxyethoxy)isopropyl (meth)acrylate, 2-(vinyloxyethoxyisopropoxy)isopropyl (meth)acrylate, 2-(vinyloxyisopropoxyethoxy)isopropyl (meth)acrylate, 2-(vinyloxyisopropoxyisopropoxy)isopropyl (meth)acrylate, 2-(vinyloxyethoxyethoxyethoxy)ethyl (meth)acrylate, 2-(vinyloxyethoxyethoxyethoxyethoxy)ethyl (meth)acrylate, 2-(isopropenoxyethoxy)ethyl (meth)acrylate, 2-(isopropenoxyethoxyethoxy)ethyl (meth)acrylate, 2-(isopropenoxyethoxyethoxyethoxy)ethyl (meth)acrylate, 2-(isopropenoxyethoxyethoxyethoxyethoxy)ethyl (meth) acrylate, polyethylene glycol monovinyl ether (meth)acrylate, and polypropylene glycol monovinyl ether (meth) acrylate.

Among them, since a viscosity of the ink can be further reduced, a flash point is high, and curability of the ink becomes good, 2-(vinyloxyethoxy)ethyl (meth)acrylate, that is, at least one of 2-(vinyloxyethoxy)ethyl acrylate and 2-(vinyloxyethoxy)ethyl methacrylate is preferable; and 2-(vinyloxyethoxy)ethyl acrylate is more preferable. In particular, both 2-(vinyloxyethoxy)ethyl acrylate and 2-(vinyloxyethoxy)ethyl methacrylate have a simple structure and a low molecular weight, the viscosity of the ink can be significantly reduced. Examples of 2-(vinyloxyethoxy)ethyl (meth)acrylate include 2-(2-vinyloxyethoxy)ethyl (meth) acrylate and 2-(1-vinyloxyethoxy) (meth)acrylate. Examples of 2-(vinyloxyethoxy)ethyl acrylate include 2-(2-vinyloxyethoxy)ethyl acrylate and 2-(1-vinyloxyethoxy) acrylate. 2-(vinyloxyethoxy)ethyl acrylate is better than 2-(vinyloxyethoxy)ethyl methacrylate in terms of the curability.

As the (meth)acrylic acid esters containing a vinyl ether group, one kind may be used alone or two or more kinds may be used in combination.

A content of the (meth)acrylic acid esters containing a vinyl ether group, particularly, 2-(vinyloxyethoxy)ethyl (meth)acrylate is preferably 10 mass % to 70 mass %, more preferably 10 mass % to 60 mass %, and most preferably 20 mass % to 50 mass %, with respect to the total mass (100 mass %) of the ink. If the content is equal to or more than the lower limit value, a viscosity of the ink can be reduced, and the curability of the ink becomes better. On the other hand, if the content is equal to or less than the upper limit value, the preservation stability of the ink can be maintained in a favorable state, and occurrence of curing wrinkles can be more effectively prevented.

A method of preparing the (meth)acrylic acid esters containing a vinyl ether group is not limited to the following, and may include a method of esterifying an (meth)acrylic acid and hydroxyl group-containing vinyl ether (preparation B), a method of esterifying a (meth)acrylic acid halide and hydroxyl group-containing vinyl ether (preparation C), a method of esterifying a (meth)acrylic acid anhydride and hydroxyl group-containing vinyl ether (preparation D), a method of ester-exchanging a (meth)acrylic acid ester and hydroxyl group-containing vinyl ether (preparation E), a method of esterifying (meth)acrylic acid and halogen-containing vinyl ether (preparation F), a method of exchanging a (meth)acrylic acid alkaline (earth) metal salt and halogen-containing vinyl ether (preparation G), a method of vinyl-exchanging hydroxyl group-containing (meth)acrylic acid ester and carboxylic acid vinyl (preparation H), and a method of ether-exchanging hydroxyl group-containing (meth)acrylic acid ester and alkyl vinyl ether (preparation I).

Among them, the preparation E is preferable since a desired effect can be further achieved in the present embodiment.

2. Monofunctional (Meth)Acrylate

The ink of the present embodiment preferably includes monofunctional (meth)acrylate. Here, in a case where the ink of the present embodiment includes the above-described (meth)acrylic acid esters containing a vinyl ether group (however, limited to monofunctional (meth)acrylate), the (meth)acrylic acid esters containing a vinyl ether group are also included in the monofunctional (meth)acrylate, but a description of the (meth)acrylic acid esters containing a vinyl ether group will be omitted. In the following, monofunctional (meth)acrylate other than the above-described (meth)acrylic acid esters containing a vinyl ether group will be described. The ink contains the monofunctional (meth) acrylate, and thereby a viscosity of the ink can be reduced, and both solubility and curability of a photopolymerization initiator and other additives become good. Further, the solubility of a photopolymerization initiator and other additives becomes good, and thereby the ejection stability of the ink becomes good, and toughness, heat resistance and chemical resistance of a coated film increase.

The monofunctional (meth)acrylate may include, for example, phenoxyethyl (meth)acrylate, isoamyl (meth)acrylate, stearyl (meth)acrylate, lauryl (meth)acrylate, octyl (meth)acrylate, decyl (meth)acrylate, isomyristyl (meth) acrylate, isostearyl (meth)acrylate, 2-ethylhexyl-diglycol (meth)acrylate, 2-hydroxybutyl (meth)acrylate, 4-hydroxybutyl (meth)acrylate, 2-methoxyethyl (meth)acrylate, butoxyethyl (meth)acrylate, ethoxy-diethylene glycol (meth)acrylate, methoxy diethylene glycol (meth)acrylate, methoxy polyethylene glycol (meth)acrylate, methoxy propylene glycol (meth)acrylate, tetrahydrofurfuryl (meth)acrylate, isobornyl (meth)acrylate, 2-hydroxyethyl (meth)acrylate, 2-hydroxypropyl (meth)acrylate, 2-hydroxy-3-phenoxypropyl (meth)acrylate, lactone-modifiable (meth) acrylate, t-butyl cyclohexyl (meth)acrylate, dicyclopentanyl (meth)acrylate, dicyclopentenyloxyethyl (meth)acrylate, benzyl (meth)acrylate, ethoxylated nonyl phenyl (meth) acrylate, alkoxylated nonyl phenyl (meth)acrylate, and p-cumylphenol EO-modified (meth)acrylate.

Among them, monofunctional (meth)acrylate having an aromatic ring skeleton in a molecule is preferable since the curability, the preservation stability, and the solubility of a photopolymerization initiator become better. The monofunctional (meth)acrylate having an aromatic ring skeleton is not limited to the following, and may preferably include, for example, phenoxyethyl (meth)acrylate, benzyl (meth)acrylate, 2-hydroxy-phenoxypropyl (meth)acrylate, and phenoxy diethylene glycol (meth)acrylate. Among them, since a viscosity of the ink can be reduced, and the curability, the rubfastness, the adhesion, and the solubility of a photopolymerization initiator all become good, at least one of the phenoxyethyl (meth)acrylate and the benzyl (meth)acrylate is preferable, and the phenoxyethyl (meth)acrylate is more preferable.

As the monofunctional (meth)acrylate other than the (meth)acrylic acid esters containing a vinyl ether group, one kind may be used alone or two or more kinds may be used in combination.

A content of the monofunctional (meth)acrylate other than the (meth)acrylic acid esters containing a vinyl ether group is preferably 10 mass % to 75 mass %, more preferably 10 mass % to 55 mass %, and most preferably 10 mass % to 40 mass %, with respect to the total mass (100 mass %) of the ink. If the content is equal to or more than the lower limit value, the solubility of a photopolymerization initiator becomes better in addition to the curability. On the other hand, if the content is equal to or less than the upper limit value, the adhesion becomes better in addition to the curability.

In addition, in a case where the ink includes the (meth) acrylic acid esters containing a vinyl ether group (however, limited to the monofunctional (meth)acrylate), a total of a content of the monofunctional (meth)acrylate including this is preferably 35 mass % to 90 mass %, and more preferably 40 mass % to 70 mass %, with respect to the total mass (100 mass %) of the ink. If the content is in the above-described range, both an ink viscosity, specifically, an ink viscosity at 28° C. and an ink viscosity at an ejection temperature can be easily set in the above-described desired range.

3. Other Polymerizable Compounds

The ink of the present embodiment may further contain polymerizable compounds other than those described above (hereinafter, referred to as "other polymerizable compounds"). The other polymerizable compounds may include the above-described monomers and oligomers, and, among them, bifunctional or higher (meth)acrylates are preferable.

The bifunctional (meth)acrylate may include, for example, diethylene glycol di(meth)acrylate, triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, 1,6-hexanediol di(meth)acrylate, 1,9-nonanediol di(meth)acrylate, neopentyl glycol di(meth) acrylate, dimethylol-tricyclodecane di(meth)acrylate, EO (ethylene oxide) adduct di(meth)acrylate of bisphenol A, PO (propylene oxide) adduct di(meth)acrylate of bisphenol A, neopentyl glycol hydroxypivalic acid di(meth)acrylate, and polytetramethylene glycol di(meth)acrylate.

The trifunctional or higher (meth)acrylates may include, for example, trimethylolpropane tri(meth)acrylate, EO-modified trimethylolpropane tri(meth)acrylate, pentaerythritol tri(meth)acrylate, pentaerythritol tetra(meth) acrylate, dipentaerythritol hexa(meth)acrylate, ditrimethylolpropane tetra(meth)acrylate, glycerol propoxy tri(meth) acrylate, caprolactone-modified trimethylolpropane tri (meth)acrylate, pentaerythritol ethoxy tetra(meth)acrylate, and caprolactam-modified dipentaerythritol hexa(meth) acrylate.

As the other polymerizable compounds, one kind may be used alone or two or more kinds may be used in combination.

In a case where the other polymerizable compounds are included in the ink, a content of the other polymerizable compounds is preferably 5 mass % to 50 mass % with respect to the total mass (100 mass %) of the ink. Particularly, in a case where the ink includes bifunctional (meth) acrylate, a content of the bifunctional (meth)acrylate is preferably 5 mass % to 50 mass %, and more preferably 10 mass % to 45 mass %, with respect to the total mass (100 mass %) of the ink. If the content is in the above-described range, the curability of the ink or the rubfastness of a cured object becomes good, and a viscosity of the ink is likely to be designed to a desired viscosity. In addition, preferably, the monofunctional (meth)acrylates in which a simple polymerizable compound has a relatively low viscosity, and, among them, particularly, the (meth)acrylic acid esters containing a vinyl ether group with a low viscosity and other polymerizable compounds with a relatively high viscosity are combined. Thereby, a viscosity of the ink is likely to be designed to a desired viscosity.

In addition, when a photopolymerizable compound is used as the polymerizable compound, addition of a photopolymerization initiator may be omitted, but it is preferable to use the photopolymerization initiator since the start of polymerization can be easily adjusted.

Photopolymerization Initiator

The ink of the present embodiment may include a photopolymerization initiator. The photopolymerization initiator is used to cure an ink on a surface of a recording medium through photopolymerization by performing irradiation with ultraviolet rays and to perform printing. Among light beams, ultraviolet rays (UV) are used, and thereby stability becomes good, and costs of a light source lamp can be suppressed. A photopolymerization initiator is not limited as long as it generates an active species such as a radical or a cation and initiates polymerization of the polymerizable compounds, but a photoradical initiator or a photocationic iniator may be used, and, of them, the photoradical initiator is preferably used.

The photoradical initiators may include, for example, aromatic ketones, acyl phosphine oxide compounds, aromatic onium salt compounds, organic peroxides, thio compounds (thioxanthone compounds, thiophenyl group-containing compounds, and the like), hexaarylbiimidazole compounds, ketoxime ester compounds, borate compounds, azinium compounds, metallocene compounds, active ester compounds, compounds having a carbon-halogen bond, and alkyl amine compounds.

Among them, particularly, the curability of the ink becomes better, and thus the acyl phosphine oxide compounds are preferable.

Specific examples of the photoradical initiators may include acetophenone, acetophenone benzyl ketal, 1-hydroxy cyclohexyl phenyl ketone, 2,2-dimethoxy-2-phenyl acetophenone, xanthone, fluorenone, benzaldehyde, fluorene, anthraquinone, triphenylamine, carbazole, 3-methylacetophenone, 4-chloro benzophenone, 4,4'-dimethoxy benzophenone, 4,4'-diamino benzophenone, Michler ketone, benzoin propyl ether, benzoin ethyl ether, benzyl dimethyl ketal, 1-(4-isopropylphenyl)-2-hydroxy-2-methyl-propan-1-one, 2-hydroxy-2-methyl-1-phenylpropan-1-one, thioxanthone, diethyl thioxanthone, 2-isopropylthioxanthone, 2-chlorothioxanthone, 2-methyl-1-[4-(methylthio)phenyl]-2-morpholino propan-1-one, bis(2,4,6-trimethyl benzoyl)-phenyl phosphine oxide, 2,4,6-trimethyl benzoyl-diphenylphosphine oxide, 2,4-diethyl thioxanthone, and bis-(2,6-dimethoxyphenyl)-2,4,4-trimethylpentyl phosphine oxide.

Examples of commercially available products of photoradical initiator includes Examples of commercially available products of the radical photopolymerization initiator include IRGACURE 651 (2,2-dimethoxy-1,2-diphenylethan-1-one), IRGACURE 184 (1-hydroxy-cyclohexyl-phenyl-ketone), DAROCUR 1173 (2-hydroxy-2-methyl-1-phenyl-propan-1-one), IRGACURE 2959 (1-[4-(2-hydroxyethoxy)-phenyl]-2-hydroxy-2-methyl-1-propan-1-one), IRGACURE 127 (2-hydroxy-1-{4-[4-(2-hydroxy-2-methyl-propionyl)-benzyl]phenyl}-2-methyl-propan-1-one), IRGACURE 907 (2-methyl-1-(4-methylthiophenyl)-2-morpholinopropan-1-one), IRGACURE 369 (2-benzyl-2-dimethylamino-1-(4-morpholinophenyl)-butanone-1), IRGACURE 379 (2-(dimethylamino)-2-[(4-methylphenyl) methyl]-1-[4-(4-morpholinyl)phenyl]-1-butanone), DAROCUR TPO (2,4,6-trimethylbenzoyl-diphenyl-phosphine oxide), IRGACURE 819 (bis(2,4,6-trimethylbenzoyl)-phenylphosphine oxide), IRGACURE 784 (bis(η5-2,4-cyclopentadien-1-yl)-bis(2,6-difluoro-3-(1H-pyrrol-1-yl)-phenyl)titanium), IRGACURE OXE 01 (1,2-octanedione, 1-[4-(phenylthio)-, 2-(O-benzoyloxime)]), IRGACURE OXE 02 (ethanone, 1-[9-ethyl-6-(2-methylbenzoyl)-9H-carbazol-3-yl]-, 1-(O-acetyloxime)), IRGACURE 754 (mixture of oxyphenylacetic acid, 2-[2-oxo-2-phenylacetoxyethoxy] ethylester, oxyphenylacetic acid, and 2-(2-hydroxyethoxy) ethylester) (trade names, all of which are manufactured by BASF Japan Ltd.), KAYACURE DETX-S (2,4-diethylthioxanthone) (trade name, manufactured by Nippon Kayaku Co., Ltd.), Speedcure TPO (2,4,6,trimethylbenzoyl-diphenylphosphin oxide), Speedcure DETX (2,4-diethylthioxanthen-9-one) (trade names, all of which are manufactured by Lambson Ltd.), Lucirin TPO, LR8893, LR8970 (trade names, all manufactured by BASF Japan Ltd.), and Ubecryl P36 (trade name, manufactured by UCB Japan Co., Ltd.).

As the photopolymerization initiator, one kind may be used alone or two or more kinds may be used in combination.

The content of the photopolymerization initiator is preferably equal to or less than 20 mass % with respect to the total mass (100 mass %) from the viewpoints of improving the curing rate of ultraviolet rays to obtain superior curability and of avoiding the remaining of an undissolved photopolymerization initiator and coloring caused by the photopolymerization initiator.

Particularly, when the photopolymerization initiator includes an acylphosphine oxide compound, the content thereof is preferably 5 mass % to 15 mass % and more preferably 7 mass % to 13 mass % with respect to the total mass (100 mass %) of the ink. When the content is greater than or equal to the above-described lower limit, the curability becomes better. More specifically, particularly when curing is performed using an LED (preferable emission peak wavelength of 360 nm to 420 nm), a curing rate is sufficiently high, and thus the curability becomes better. Meanwhile, if the content is equal to or less than the above-described upper limit value, the solubility of the photopolymerization initiator becomes better.

Fluorescent Brightening Agent

The ink of the embodiment may include a fluorescent brightening agent. The fluorescent brightening agent is a compound which is colorless or lightly colored, can absorb light having a wavelength around 300 nm to 450 nm which is a range from ultraviolet rays to short wave visible rays, and can emit fluorescence having a wavelength around 400 nm to 500 nm. The fluorescent brightening agent is also known as a fluorescent whitening agent. A physical principle and a chemical property of the fluorescent brightening agent are disclosed in Ullmann's Encyclopedia of Industrial Chemistry, Sixth Edition, Electronic Release, Wiley-VCH 1998.

The ink of the present embodiment includes the fluorescent brightening agent, and thereby the curability becomes better.

The fluorescent brightening agent is not limited to the following, and may include, for example, naphthalene benzoxazole derivatives such as 1,4-bis-(2-benzoxazole) naphthalene, thiophene benzoxazole derivatives such as 2,5-thiophenediyl bis-(5-tert-butyl-1,3 benzoxazole), stilbene benzoxazole derivatives, coumarin derivatives, styrene biphenyl derivatives, pyrazolone derivatives, stilbene derivatives, styryl derivatives of benzene and biphenyl, bis(benzazol-2-yl) derivatives, carbostyrils, naphthalimides, derivatives of dibenzothiophene-5,5'-dioxide, pyrene derivatives and, pyridotriazoles.

Examples of commercially available products of the fluorescent brightening agent include HOSTALUX KCB (trade name, manufactured by Clariant GMbH; 1,4-bis-(2-benzoxazole) naphthalene), TINOPAL OB (trade name, manufactured by BASF Japan Ltd.; 2,5-thiophenediyl bis-(5-tert-butyl-1,3 benzoxazole)), and the like.

As the fluorescent brightening agent, one kind may be used alone or two or more kinds may be used in combination. In addition, the content is preferably 0.10 mass % to 0.5 mass % with respect to the total mass (100 mass %) of the ink. If the content is in the above-described range, it is possible to reduce influence which the fluorescent brightening agent itself may exert on a color of a cured film.

Colorant

The ink of the present embodiment may contain a colorant. As the colorant, at least one of a pigment and a dye can be used.

1. Pigment

When a pigment is used as the colorant, the light resistance of the ink can be improved. As the pigment, both an inorganic pigment and an organic pigment can be used.

Examples of the inorganic pigment include carbon blacks (C.I. Pigment Black 7) such as furnace black, lamp black, acetylene black, iron oxide, and titanium oxide.

Examples of the organic pigment include azo pigments such as insoluble azo pigments, condensed azo pigments, azo lakes, and chelate azo pigments; polycyclic pigments such as phthalocyanine pigments, perylene and perinone pigments, anthraquinone pigments, quinacridone pigments, dioxane pigments, thioindigo pigments, isoindolinone pigments, and quinophthalone pigments; dye chelates (for example, basic dye chelates and acidic dye chelates); dye lakes (for example, basic dye lakes and acidic dye lakes); nitro pigments; nitroso pigments; aniline blacks; and daylight fluorescent pigments.

Examples of a pigment used for white ink include C.I. Pigment White 6, 18, and 21.

Examples of a pigment used for yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of a pigment used for magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, and 245; and C.I. Pigment Violet 19, 23, 32, 33, 36, 38, 43, and 50.

Examples of a pigment used for cyan ink include C.I. Pigment Blue 1, 2, 3, 15, 15:1, 15:2, 15:3, 15:34, 15:4, 16, 18, 22, 25, 60, 65, and 66; and C.I. Vat Blue 4 and 60.

In addition, examples of a pigment used for pigments other than magenta, cyan, and yellow include C.I. Pigment Green 7 and 10; C.I. Pigment Brown 3, 5, 25, and 26; and C.I. Pigment Orange 1, 2, 5, 7, 13, 14, 15, 16, 24, 34, 36, 38, 40, 43, and 63.

As the pigment, one kind may be used alone or two or more kinds may be used in combination.

When the pigment is used, the average particle size thereof is preferably equal to or less than 300 nm and more preferably 50 nm to 200 nm. If the average particle size is in the above-described range, the reliability in the ejection stability and dispersion stability of the ink becomes better and a high-quality image can be formed. In the present specification, the average particle size is measured using dynamic light scattering.

2. Dye

As the colorant, a dye may be used. The dye is not particularly limited, and an acid dye, a direct dye, a reactive dye, and a basic dye may be used. Examples of the dye include C.I. Acid Yellow 17, 23, 42, 44, 79, and 142; C.I. Acid Red 52, 80, 82, 249, 254, and 289; C.I. Acid Blue 9, 45, and 249; C.I. Acid Black 1, 2, 24, and 94; C.I. Food Black 1 and 2; C.I. Direct Yellow 1, 12, 24, 33, 50, 55, 58, 86, 132, 142, 144, and 173; C.I. Direct Red 1, 4, 9, 80, 81, 225, and 227; C.I. Direct Blue 1, 2, 15, 71, 86, 87, 98, 165, 199, and 202; C.I. Direct Black 19, 38, 51, 71, 154, 168, 171, and 195; C.I. Reactive Red 14, 32, 55, 79, and 249; and C.I. Reactive Black 3, 4, and 35.

As the dye, one kind may be used alone or two or more kinds may be used in combination.

The content of the colorant is preferably 1 mass % to 20 mass % with respect to the total mass (100 mass %) of the ink since good concealment and color reproduction are obtained.

Dispersant

When the ink of the present embodiment includes the pigment, a dispersant may be added thereto in order to improve pigment dispersibility. The dispersant is not particularly limited, and may include, for example, a dispersant such as a polymeric dispersant which is usually used for preparing a pigment dispersion. Specific examples thereof include those containing, as a major component, one kind or more kinds of polyoxyalkylene polyamine, vinyl-based polymers and copolymers, acrylic polymers and copolymers, polyesters, polyamides, polyimides, polyurethanes, amine-based polymers, silicon-containing polymers, sulfur-containing polymers, fluorine-containing polymers, and epoxy resins. Examples of commercially available products of the polymeric dispersant include AJISPER series (trade name, manufactured by Ajinomoto Fine-Techno Co., Inc.); SOLSPERSE series (32000 and 36000 [trade name] manufactured by Avecia Co.); DISPERBYK series (trade name, manufactured by BYK Chemie); and DISPARLON series (trade name, manufacturd by Kusmoto Chemicals Ltd.).

As the dispersant, one kind may be used alone or two or more kinds may be used in combination. The content of the dispersant is not particularly limited, and an appropriate amount thereof may be added.

Polymerization Inhibitor

The ink of the present embodiment may include a polymerization inhibitor. The ink includes a polymerization inhibitor, and thereby it is possible to prevent a polymerization reaction of the above-described polymerizable compounds before being cured.

The polymerization inhibitor is not particularly limited, and may include, for example, a phenol polymerization inhibitor. The phenol polymerization inhibitor is not limited to the following, and may include, for example, p-methoxyphenol, cresol, t-butyl catechol, di-t-butyl-p-cresol, hydroquinone monomethyl ether, α-naphthol, 3,5-di-t-butyl-4-hydroxy toluene, 2,6-di-t-butyl-4-methylphenol, 2,2'-methylene-bis(4-methyl-6-t-butylphenol), 2,2'-methylene-bis(4-ethyl-6-butylphenol), and 4,4'-thio-bis(3-methyl-6-t-butylphenol).

Examples of commercially available products may include, for example, p-Methoxyphenol (trade name, manufactured by Tokyo Chemical Industry Co., Ltd.; p-methoxyphenol), NONFLEX MBP (trade name, manufactured by Seiko Chemical Co., Ltd.; 2,2'-methylene-bis(4-methyl-6-t-butylphenol)), and BHT Swanox (trade name, manufactured by Seiko Chemical Co., Ltd.; 2,6-di-t-butyl-4-methylphenol).

As the polymerization inhibitor, one kind may be used alone or two or more kinds may be used in combination. The content of the polymerization inhibitor is not particularly limited, and an appropriate amount thereof may be added.

Surfactant

The ink of the present embodiment may include a surfactant. The surfactant is not particularly limited and may include, for example, a silicone-based surfactant. As the silicone-based surfactant, polyester-modified silicone or polyether-modified silicone is preferably used, and, of them, at least one of polyether-modified polydimethylsiloxane and polyester-modified polydimethylsiloxane is more preferable. Examples of commercially available products of the surfactant may include BYK-347, BYK-348, BYK-UV3500, 3510, 3530, and 3570 (all of which are manufactured by BYK Chemie).

As the surfactant, one kind may be used along or two or more kinds may be used in combination. The content of the surfactant is not particularly limited, and an appropriate amount thereof may be added.

Other Additives

The ink according to the embodiment contains other additives (components) other than the above-described additives. These components are not particularly limited, and may include, for example, well-known materials of the related art such as a polymerization promoter, a penetration enhancer, and a wetting agent (moisturizing agent); and other additives. Specific examples of these additives include well-known additives of the related art such as a fixing agent, an antifungal agent, a preservative, an antioxidant, an ultraviolet absorber, a chelating agent, a pH adjusting agent, and a thickener.

Above-described, according to the present embodiment, it is possible to provide an ultraviolet-ray curable ink capable of achieving good curability and solubility of a photopolymerization initiator, used for an ink jet recording method, in which the durability of a head, and the ejection stability and the ejection amount stability (short term and long term) of the ultraviolet-ray curable ink become good, and further suppression of curing wrinkles is also good.

Hereinafter, a second embodiment of the invention will be described in detail. In addition, the invention is not limited to the following embodiment, and may have various modifications within the scope of the spirit thereof. Further, in each drawing used for the following description, a scale of each constituent element is appropriately changed such that each constituent element (member) has a recognizable size. The present embodiment is not limited only to a quantity, a shape and a ratio of sizes of constituent elements disclosed in the drawings, and a relative positional relationship of the respective constituent elements.

In the present specification, the term "recorded matter" refers to a matter in which an ink is recorded on a recording medium and thus a cured object is formed. In addition, the cured substance in the present specification indicates a cured substance including a cured film or a coated film.

In addition, in the present specification, the term "ejection stability" refers to a property of ejecting ink droplets which are stable at all time from nozzles without omission of the nozzles. Further, in the present specification, the term "durability of a head" indicates a property in which deterioration including alteration such as swelling is unlikely to occur when members of the head (specifically, an adhesive among the head members) forming the recording apparatus come into contact with an ink.

In addition, in the present specification, the term "curing" indicates that, when an ink including a polymerizable compound is irradiated with light, the polymerizable compound is polymerized and thus the ink is hardened. The term "curability" refers to a property of being cured in response to light and is also referred to as photopolymerization. The term "curing wrinkles" indicates wrinkles generated in a surface of a cured coated film as a result of an increase in polymerization volume shrinkage ratio due to an uncured ink present inside the coated film which is a cured target irregularly flowing before being cured.

In addition, in the present specification, the term "preservation stability" indicates a property in which a viscosity is unlikely to vary before and after being preserved when an ink is preserved. The term "rubfastness" indicates a property in which, when a cured object is rubbed, the cured object is unlikely to be peeled off and is thus unlikely to be damaged.

In addition, in the present specification, the term "(meth) acrylate" indicates at least one of acrylate and methacrylate corresponding thereto, the term "(meth)acryl" indicates at least one of acryl and methacryl corresponding thereto, and the term (meth)acryloyl indicates at least one of acryloyl and methacryloyl corresponding thereto.

Ink Jet Recording Apparatus

An embodiment of the invention is related to an ink jet recording apparatus, that is, an ink jet printer. The ink jet recording apparatus (hereinafter, simply referred to as a "recording apparatus") uses an ultraviolet-ray curable ink (hereinafter, simply referred to as an "ink") with predetermined physical properties, and at least includes a head, an ink path for supplying an ink to the head, a heating mechanism, a degassing mechanism, and a light source.

The printer of the present embodiment can record inks of various colors (forms an image) on a recording medium, for example, may form an image using inks of four colors of CMYK (cyan, magenta, yellow, and black), or may form a ground image which gives good concealment to a recording medium using a white ink.

The printer of the present embodiment may include a line printer and a serial printer, and either one may be used. They are different in a printer method.

The line printer which is a line type ink jet recording apparatus has a line head with a length equal to or more than a length corresponding to a width of a recording medium as a head. The line head and the recording medium are moved at relative positions in a scanning direction intersecting the width direction, and an ink is ejected from the line head to the recording medium, that is, the recording medium which is scanned relatively to the line head. In addition, in the line printer, the head is (almost) not moved and is fixed, and performs recording in one pass (a single pass). The line printer is more advantageous than the serial printer in that recording speed is high.

Here, the "line head with a length corresponding to a width of a recording medium" is not limited to a case where the width of the recording medium completely conforms to the length (width) of the line head, and may be different from each other. A case of being different from each other may include, for example, a case where a length (width) of the line head is a length corresponding to a width (recording width) of the recording medium on which ink is to be ejected (an image is to be formed).

On the other hand, in the serial printer which is a serial type ink jet recording apparatus, a head is moved in a main scanning direction intersecting a sub-scanning direction of a recording medium and performs main scanning (pass) for ejecting ink, so as to normally perform recording in two or more passes (multi-pass).

Hereinafter, a line printer which is an example of the printer of the present embodiment will be described in detail with reference to the drawings. FIG. 1 is a block diagram illustrating an example of the ink jet recording apparatus (the printer 1) of the present embodiment. FIG. 2 is a schematic cross-sectional view illustrating an example of the periphery of the head unit, the transport unit, and the irradiation unit of the line printer of the present embodiment.

1. Configuration of Recording Apparatus

The printer 1 is a recording apparatus which forms an image on a recording medium, and is connected to a computer 130 which is an external device so as to communicate therewith.

A printer driver is installed in the computer 130 which is an external apparatus. The printer driver is a program which displays a user interface on a display device (not shown) and converts image data which is output from an application program into printing data (image forming data). The printer driver is recorded on a "computer readable recording medium" such as a flexible disc (FD) or a CD-ROM. Alternatively, the printer driver may be downloaded to the computer 130 via the Internet. In addition, the program includes codes for realizing various functions.

In addition, the computer 130 outputs printing data according to an image to a printer 1 so as to make the printer 1 form the image.

The printer 1 includes an ink supply unit 10, a transport unit 20, a head unit 30, an irradiation unit 40, a detector group 110, a memory 123, and an interface (I/F) 121, and a controller 120. The printer 1 which has received printing data from the computer 130 controls each unit using the controller 120, and records an image on a recording medium according to the printing data. Circumstances inside the printer 1 are monitored by the detector group 110, and the detector group 110 outputs a detection result to the controller 120. The controller 120 controls each unit based on the detection result output from the detector group 110. The controller 120 stores the printing data which is input via the interface 121 in the memory 123, and includes a CPU 122 and a unit control circuit 124. The memory 123 stores control information for controlling each unit.

The ink supply unit 10 adjusts an ink supply amount. The ink supply unit 10 includes a device (hereinafter, referred to as an "ink supply device") which adjusts an ink supply amount, for example, between an ink container such as an ink tank or an ink cartridge and the head.

In addition, the ink supply unit (ink supply device) 10 will be described later in detail.

The transport unit 20 transports a recording medium S in a transport direction. As shown in FIG. 2, in the transport unit 20, transport rollers including an upstream side roller 25A and a downstream side roller 25B are rotated by a transport motor (not shown), and a transport drum 26 is driven. A recording medium S is transported to a recordable region (a region facing the head) according to rotation of the transport rollers along the peripheral surface of the transport drum 26.

The head unit 30 ejects an ink to the recording medium S. The head unit 30 ejects each ink to the recording medium S of which transport is in progress so as to form dots on the recording medium S, thereby forming an image. The printer 1 of the present embodiment is a line printer, and the respective heads of the head unit 30 can form dots corresponding to a width of the recording medium at a time. Specifically, as shown in FIG. 2, the respective heads (hereinafter, collectively referred to as "heads") which include a black ink head K, a cyan ink head C, a magenta ink head M, and a yellow ink head Y are disposed around the transport drum 26 so as to face the transport drum 26 in order from the upstream side in the transport direction. The black ink head K is an ejection portion of an ultraviolet-ray curable black ink. The cyan ink head C is an ejection portion of an ultraviolet-ray curable cyan ink. The magenta ink head M is an ejection portion of an ultraviolet-ray curable magenta ink. The yellow ink head Y is an ejection portion of an ultraviolet-ray curable yellow ink. Each head ejects the ultraviolet-ray curable ink to the recording medium S. The ejected ink is attached to a recording surface of the recording medium S. As above, each head is controlled from the upstream side so as to form dots at necessary locations in a line corresponding to the width of the recording medium S, and thereby an image can be formed by scanning the recording medium S once in the transport direction.

In addition, the head (ink jet head) will be described later in detail. Further, here, for convenience, the term "paper" is used; however, a recording medium described later may be used as the recording medium of the present embodiment.

The irradiation unit 40 irradiates the dots of the ultraviolet-ray curable ink landed on the recording medium S with ultraviolet rays. The dots formed on the recording medium S are cured by being irradiated with the ultraviolet rays from the irradiation unit 40. The irradiation unit 40 in the present embodiment includes a light source which irradiates the ink attached to the recording medium S with ultraviolet rays. Specifically, as shown in FIG. 2, the irradiation unit 40 includes temporary curing irradiation portions 42*a*, 42*b*, 42*c* and 42*d* which are disposed on the downstream sides in the transport direction of the respective heads as light sources, and a main curing irradiation portion 44 which is disposed further on the downstream side in the transport direction as a light source. This recording apparatus may be formed in such a manner as in FIG. 11 of JP-A-2010-269471, for example.

In the present specification, the "temporary curing" indicates temporary tacking (pinning) of an ink, and, more specifically, indicates curing before main curing in order to prevent smearing between dots or control a dot diameter. Generally, a polymerization degree of polymerizable compounds in the temporary curing is lower than a polymerization degree of the polymerizable compounds in the main curing which is performed next to the temporary curing. In addition, the "main curing" indicates that the dots formed on the recording medium are cured up to a curing state necessary to use a recorded matter. Here, in the present specification, just "curing" indicates main curing unless particularly mentioned.

In addition, since the ink may be irradiated with ultraviolet rays from the main curing irradiation portion 44 and undergo main curing, some or all of the temporary curing irradiation portions 42*a*, 42*b*, 42*c* and 42*d* may not apply ultraviolet rays and the main curing irradiation portion 44 may apply ultraviolet rays, thereby finishing the curing step. As such, in the curing step, the temporary curing may not be performed, and only the main curing may be performed.

The detector group 110 includes a rotary type encoder (not shown), a paper detection sensor (not shown), or the like. The rotary type encoder detects rotation speed of the above-described upstream side roller 25A or the downstream roller 25B. A transport rate of the recording medium S can be detected based on the detection result of the rotary type encoder. The paper detection sensor detects a position of a front end of the recording medium S of which feeding is in progress.

The controller 120 is a control unit (control portion) for performing control of the printer. The controller 120 includes an interface portion 121, a CPU 122, a memory 123, and a unit control circuit 124. The interface portion 121 performs transmission and reception of data between the computer 130 which is an external apparatus and the printer 1. The CPU 122 is a central processing unit for controlling the overall printer 1. The memory 123 is used to secure a region for storing programs of the CPU 122 or a work region, and has storage elements such as RAM or EEPROM. The CPU 122 controls each unit via the unit control circuit 124 according to the programs stored in the memory 123.

2. Configuration of Head of Recording Apparatus

The head unit 30 of the ink jet recording apparatus (the printer 1) includes the head (ink jet head) which ejects the ultraviolet-ray curable ink to a recording medium and performs recording.

The head includes a cavity which ejects an accommodated ink from a nozzle, an ejection driving portion which is provided for each cavity and applies an ejection driving force to the ink, and the nozzle which is provided for each cavity and ejects the ink to outside of the head. The cavity, and the ejection driving portion and the nozzle which are provided for each cavity may be provided in a single head in plurality independently from each other. The ejection driving portion may be formed using an electromechanical conversion element such as a piezoelectric element which varies a volume of the cavity through mechanical deformation, an electrothermal conversion element which generates bubbles in an ink and ejects the ink by emitting heat, or the like. In the ink jet recording apparatus, the head may be provided singly or in plurality for a single color ink. Of them, in a case where a plurality of heads are provided, a line head may be formed by arranging a plurality of head in the width direction of a recording medium, and thereby the above-described recording width can be further lengthened. In a case where recording is performed using inks of a plurality of colors, the ink jet recording apparatus includes a head for each ink.

Here, the head included in the serial printer or the line printer which is a printer of the present embodiment is particularly a head in which an epoxy resin is used in at least a part of a portion which comes into contact with an ink such as inside or a surface of the head. The epoxy resin may be used as, for example, an adhesive which adheres members of the head to each other when the head is manufactured. If the head using an adhesive of the epoxy resin is employed, a strong adhesive force between the members of the head can be maintained, particularly, even if a temperature variation occurs in the head. The term "contact with an ink" includes direct contact with an ink, and indirect contact with an ink through permeation of a constituent component of the ink. At this time, since the ultraviolet-ray curable ink in the present embodiment can prevent the adhesive of an epoxy resin from swelling, it is difficult for deterioration including alteration, and thus the durability of the head becomes good. As above, the ultraviolet-ray curable ink can be appropriately ejected from the head using the adhesive of an epoxy resin.

The adhesive of an epoxy resin is not limited to the following, and may include, for example, a well-known adhesive in the related art in which a main agent including a compound with an epoxy group is cured by a curing agent. The compound with an epoxy group included in the main agent is not limited to the following, and may include, for example, bisphenol type epoxy such as bisphenol A type and bisphenol F type, novolak type epoxy such as phenol novolac type and cresol novolac type, poxy polyol type epoxy, urethane-modified epoxy, chelate-modified epoxy, and rubber-modified epoxy. The curing agent is not limited to the following, and may include, for example, amines such as polyamine and amines, acid anhydrides, amides such as amide and polyamide, imidazoles, and polymercaptan. Among them, a combination of the bisphenol type epoxy as a main agent and amines as a curing agent is preferably used for a good adhesive force. A mixing ratio (main agent:curing agent) of the main agent and the curing agent is preferably 10:1 to 1:10 in terms of mass for good curability of an adhesive. The head may be formed in such a manner as in FIG. 3 or the like of JP-A-2009-279830.

3. Configuration of Ink Supply Device of Recording Apparatus

The ink supply unit 10 of the ink jet recording apparatus of the present embodiment includes a device which adjusts an ink supply amount (an ink supply device). The ink supply device may be provided between an ink container such as an ink tank or an ink cartridge and the head. In addition, an ink path included in the ink supply device supplies an ink to the head. More specifically, the ink path connects the ink container to the head, and supplies the ink from the ink container to the head.

Here, an ink circulation path is preferably provided in at least a part of the ink path and thus an ink inflow amount to the head can be adjusted. More specifically, first, the ink supply device adjusts an ink inflow amount which is supplied from the ink circulation path to the head. Second, the ink supply device ejects an ink of at least some of flow (this ejected amount is an ejection amount), and can return a residue (an ink outflow amount) of the flow to the ink circulation path from the head. Therefore, for example, when an ink inflow amount per time which is supplied to the head is equal to or more than an amount of an ink ejected from the head (an ink ejection amount per time), the ink flows out of the head and returns to the ink circulation path, and thereby the ink is circulated. In addition, when the ink inflow amount per time is twice or more the ink ejection amount, the ink outflow amount is one or more times the ink ejection amount.

Hereinafter, the ink supply device will be described with reference to the drawing. FIG. 3 is a schematic front view illustrating an example of the ink supply device 10 included in the ink jet recording apparatus of the present embodiment.

The ink supply device 10 is located between an ink cartridge 50 and a head 60 in the ink jet recording apparatus. The ink supply device 10 includes an ink cartridge 50, an ink path 51 (preferably, including an ink circulation path 80), a sub-tank 70, a heating mechanism 90, a degassing mechanism 100, and heads 60. The heads 60 are included in the above-described head unit 30.

The ink cartridge 50 is used to accommodate an ultraviolet-ray curable ink. A holder 52 is used to install the ink cartridge 50. The ink path 51 includes the ink circulation path 80 and is a flow channel which allows an ink to pass from the ink cartridge 50 to the heads 60. In other words, at least a part of the ink path 51 which supplies the ink from the ink cartridge 50 which is an ink container to the heads 60 is preferably the ink circulation path 80 which circulates the ink. In the ink path 51, the holder 52, a valve 53, a supply pump 54, and a filter 55 are provided in a pipe between the ink cartridge 50 and the sub-tank 70.

The valve 53 is opened when the ink cartridge 50 accommodating the ink is installed in the holder 52. When the valve 53 is opened, the supply pump 54 pushes out the ink from the ink cartridge 50 to the ink path 51. The ink path 51 supplies the ink pushed out from the ink cartridge 50 by the supply pump 54 to the sub-tank 70 via the filter 55 which filters foreign substances in the ink. A pressing pump 56 presses the sub-tank 70 and supplies the ink to the ink circulation path 80 from the sub-tank 70.

The sub-tank 70 supplies the ink to the ink circulation path 80 when a fluid volume sensor 71 detects a fluid volume of the ink in the sub-tank 70 and the fluid volume is equal to or more than a predetermined first fluid volume, and receives the ink from the ink cartridge 50 when the fluid volume is equal to or less than a predetermined second fluid volume.

The ink circulation path 80 is connected to the sub-tank 70 and the heads 60, is supplied with the ink from the sub-tank 70, and supplies the ink to the heads 60. The ink circulation path 80 can make a temperature of the ink heated in the heating mechanism 90 described later or prevent precipitation of components included in the ink by making the ink flow at all times. The ink circulation path 80 is a pipe which includes a filter 81, a circulation pump 82, and a head filter 83. The ink supplied from the sub-tank 70 is circulated in the ink circulation path 80 by the circulation pump 82. The ink is circulated in this way, and thereby degassing efficiency increases, and a temperature of the ink supplied to the heads 60 is easily stabilized when the ink is heated. The filter 81 is provided on a downstream side of the circulation pump 82 of the ink circulation path 80 and filters foreign substances in the ink. A part of the ink circulation path 80 is provided in the head 60, and at least some of the circulated ink is ejected from the head 60 via the head filter 83 which filters foreign substances in the ink.

The heating mechanism 90 and the degassing mechanism 100 are located in the ink circulation path 80 in FIG. 3, specifically, in the middle of the ink circulation path 80, that is, between the sub-tank 70 and the heads 60.

The heating mechanism 90 heats the ultraviolet-ray curable ink of which a viscosity is equal to or more than 8 mPa·s at 28° C. This heating mechanism can set a temperature (hereinafter, referred to as an "ejection temperature") of the ejected ultraviolet-ray curable ink to 28° C. to 40° C., and allows a viscosity of the ultraviolet-ray curable ink at the corresponding temperature to be 15 mPa·s or less. In FIG. 3, the heating mechanism 90 is provided at a position other than the position which is connected to at least the heads 60 in the ink circulation path 80. Here, the "position which is connected to at least the heads 60 in the ink circulation path 80" corresponds to a coupling portion of the ink circulation path 80 which is located outside the heads 60 in FIG. 3. The heating mechanism 90 heats the ink in the ink circulation path 80 using a temperature adjustment module 94 while circulating warm water of a warm water tank 91 between the temperature adjustment module 94 and the warm water tank 91 using a warm water circulating pump 92. A heater 93 of the warm water tank 91 adjusts a temperature of the circulated ink to a target temperature.

The degassing mechanism 100 degases the ultraviolet-ray curable ink. In addition, the degassed ultraviolet-ray curable ink is supplied to the heads 60. In FIG. 3, the degassing mechanism 100 is provided further on the downstream side than the heating mechanism 90 (specifically, the temperature adjustment module 94 of the ink circulation path 80) and further on the upstream side than the heads 60 in the direction in which the ink is circulated. Since the degassing mechanism 100 is located on the downstream side of the heating mechanism 90, the ink is degassed in a state in which a temperature thereof is high, and thereby it is possible to further increase degassing efficiency. A degassing module 102 includes a degassing chamber (not shown) into which the ink flows, and a decompression chamber (not shown) which comes into contact with the degassing chamber via a separation membrane which does not allow a liquid such as an ink to pass therethrough. A negative pressure pump 101 reduces the pressure of the decompression chamber. When the decompression chamber is decompressed, a dissolved air amount of the ink in the ink circulation path 80 is reduced and thereby bubbles are removed. In this way, the degassing mechanism 100 degases the ink in the ink circulation path 80.

Here, a dissolved oxygen content in the ultraviolet-ray curable ink supplied to the heads 60 is preferably equal to or less than 20 ppm. The degassing mechanism 100 located on the front side of the heads 60 performs degassing such that the dissolved oxygen content is equal to or less than 20 ppm, and thereby it is possible to obtain an ink with good ejection stability and curability. Thereby, the ink can be appropriately used for the ink jet recording apparatus.

In addition, the dissolved oxygen content is preferably 1 ppm to 20 ppm, more preferably 3 ppm to 20 ppm, and most preferably 5 ppm to 15 ppm. Particularly, if the dissolved oxygen content is equal to or more than 1 ppm, since polymerization of polymerizable compounds can be sufficiently prevented, good preservation stability can be effectively maintained.

In addition, the dissolved oxygen content in the present specification may be measured using a well-known method in the related art; however, for convenience, a value obtained by a measurement method using in Examples described later is employed.

The description is continued referring to FIG. 3 again. The head 60 ejects the ink to a recording medium. The head 60 includes a nozzle (not shown) which ejects the ink, a nozzle plate which has a nozzle surface on which the nozzle is formed, a cavity (not shown) which communicates with the nozzles and accommodates the ink, a reservoir (not shown) which prevents reverse flow of the ink, and an ejection driving portion (not shown) which applies an ejection driving force to ink accommodated in the cavity so as to form an ink droplet suitable for ejection and ejects the droplet from the nozzle. In FIG. 3, for example, the cavity is a pressure generation chamber, and the ejection driving portion is a piezoelectric element. A cap 61 prevents the ink attached around the nozzle from being dried when the recording apparatus is not used and thus protects the nozzles of the heads 60.

In FIG. 3, in the ink circulation path 80, four heads 60 are provided in parallel. As above, preferably, there are a plurality of heads 60 to which the ink is supplied from the ink circulation path 80, and the ink is ejected from the plurality of heads 60. In this case, as described later, since a single ink circulation path 80 is present with respect to a plurality of heads 60, the ink circulation path 80 or the temperature adjustment module 94 is used in common, and thus temperatures of inks supplied to the four heads 60 can be made to be uniform, and, further, it is possible to achieve low costs of the recording apparatus.

4. Operation of Recording Apparatus

First, initial filling of an ink is performed through an operation of the ink supply device 10. When the ink cartridge 50 accommodating the ink is installed in the holder 52, the valve 53 is "opened", and the ink is supplied to the sub-tank 70 via the filter 55 which filters foreign substances in the ink by the supply pump 54. When the fluid volume sensor 71 detects that an ink fluid volume in the sub-tank 70 is equal to or more than a predetermined first fluid volume, the supply pump 54 stops and the valve 53 is "closed". The sub-tank 70 is pressed by the pressing pump 56 such that the ink is supplied from the sub-tank 70 to the ink circulation path 80. Here, when a fluid volume of the sub-tank 70 is less than a predetermined second fluid volume (that is, an amount smaller than the predetermined first fluid volume) before the ink circulation path 80 is completely filled with the ink, the pressing pump 56 temporarily stops and the sub-tank 70 returns to an ordinary pressure. In addition, in the above-described way, the ink is supplied again from the ink cartridge 50 to the sub-tank 70, and the ink is supplied again from the sub-tank 70 to the ink circulation path 80. When the ink circulation path 80 is completely filled with the ink by repeatedly performing this operation, the pressing pump 56 stops, the sub-tank 70 returns to an atmospheric pressure, and the ink is supplied again from the ink cartridge 50 to the sub-tank 70 such that a fluid volume of the sub-tank 70 is equal to or more than the predetermined first fluid volume. In this way, the initial filling of the ink is completed.

If the initial filling of the ink is completed, successively, the ink is circulated in the ink circulation path 80 by the circulation pump 82 through the operation of the ink supply device 10. The heating mechanism 90 in which the heater 93 is in an ON state in advance circulates the warm water of the warm water tank 91 between the temperature adjustment module 94 and the warm water tank 91 using the warm water circulating pump 92. In addition, the temperature adjustment module 94 heats the ink which is circulated in the ink circulation path 80. The filter 81 provided on the downstream side of the circulation pump 82 of the ink circulation path 80 filters foreign substances of the ink. The degassing module 102 of the degassing mechanism 100 includes the degassing chamber (not shown) into which the ink flows, and the decompression chamber (not shown) which comes into contact with the degassing chamber via a separation membrane which allows a gas such as air to pass therethrough and does not allow a liquid such as an ink to pass therethrough. When the decompression chamber is decompressed by the negative pressure pump 101, bubbles or dissolve air included in the ink inside the degassing chamber flees to the decompression chamber via the separation membrane, and thus a dissolved air content is reduced and thus bubbles are removed from the ink in the ink circulation path 80. Since four degassing modules 102 are provided in parallel, degassing efficiency increases, and thus it is possible to degas the ink while circulating the ink. Since the degassing mechanism 100 is provided further on the downstream side than the temperature adjustment module 94, it is possible to perform degassing at a position where an ink temperature is the highest in the ink circulation path 80. For this reason, degassing efficiency of the ink is very high, and, the degassing module 102 is located further on the downstream side than the circulation pump 82, and thus it is possible to perform degassing at a position where a pressure of the ink is high and to thereby notably increase degassing efficiency.

Here, in the ink circulation path 80, four heads 60 are provided in parallel. In the ink circulation path 80 inside the head 60, the reservoir (not shown) is provided further on the downstream side than the head filter 83 which filters foreign substances of the ink. The inks which flow into the heads and pass through the reservoirs flow out of the heads 60 again, and the inks which flow out of the respective heads 60 join in the coupling portion of the ink circulation path 80 and return to the sub-tank 70. The reservoir is connected to six hundred pressure generation chambers (not shown) which are provided for each head, and the piezoelectric element (not shown) provided for each pressure generation chamber is separately driven, thereby changing a volume of the pressure generation chamber. In addition, the nozzle (not shown) is provided for each pressure generation chamber, and the ink can be ejected from the nozzle to outside. Since the ink supply device is common to the four heads, the ink circulation path 80 or the temperature adjustment module 94 is used in common, and thus temperatures of inks supplied to the four heads 60 can be made to be uniform, and, further, it is possible to achieve low costs of the recording apparatus. The ink which has returned to the sub-tank 70 is circulated in the ink circulation path 80 again. When the head 60 is assembled by adhering members forming the reservoir, the above-described adhesive of an epoxy resin is used. In addition, although, in FIG. 3, the ink circulation path 80 passes the inside of the head 60, the ink circulation path may pass not the inside of the head but the outside of the head, and the ink may be supplied to the reservoir in the head from the ink circulation path which passes the outside of the head. In this case, circulation of the ink is performed up to the ink circulation path which passes through the outside of the head. However, also in this case, an ink which flows into the ink circulation path is set as an ink which flows into the head, and an ink which flows out of the ink circulation path is set as an ink which flows out of the head.

Successively, preparation before printing starts is performed through the operation of the ink supply device 10. Ink circulation is performed for fifteen minutes so as to stabilize a temperature of the ink in the ink circulation path 80. The ink temperature is detected as a temperature of the nozzle by a temperature sensor (not shown) provided around the nozzle, and is adjusted to a target temperature before printing and during printing by controlling the heater 93 of the warm water tank 91.

When the printing preparation is completed, printing starts through an ejecting operation. The piezoelectric element is separately driven so as to eject the ultraviolet-ray curable ink from the nozzle of the head 60 to the recording medium S. The ejected ink is landed on the recording medium S and is attached to a recording surface thereof.

Successively, the attached ink is cured through a curing operation. In the curing operation, a light source such as a light emitting diode is used, and the light source irradiates the ink attached to the recording surface with ultraviolet rays so as to cure the ink.

In addition, the ejecting operation and the curing operation will be described in detail in an ejecting step and a curing step described later, respectively.

In addition, during the ejection (printing), an ink supply operation is continuously or intermittently performed by the ink supply device 10, and thereby the ink is supplied to the heads 60. An ink inflow amount per unit time of the ink circulation path 80 is preferably larger than an ejection amount per unit time in which the ink is ejected from the head, during printing, as described above. In this case, degassing efficiency increases. In order to set the ink inflow amount and the ejection amount per unit time to this relationship, the ink inflow amount per unit time may be larger than the above-described maximum ink ejection amount per unit time. In addition, as described above, the ink inflow amount per unit time is preferably larger than the maximum ink ejection amount per unit time, and more preferably twice or more the maximum ink ejection amount per unit time. The ink inflow amount per unit time which flows into the heads 60 from the ink circulation path 80 is set to A (mL/min), the maximum ink ejection amount per unit time in which all the nozzles of all the heads 60 are driven at the maximum driving frequency during printing and which is an ejection amount per unit time when the ink is ejected in the maximum amount of the ink per driving which can be ejected during the printing is set to B (mL/min), and the ink outflow amount per unit time which flows out of the heads 60 to the ink circulation path 80 when the heads 60 eject in the maximum ink ejection amount is set to C (mL/min). At this time, settings are performed so as to satisfy the following Equation (i).

$$A \geq 2B = 2(A-C) \quad \text{(i)}$$

The ink inflow amount is set to satisfy Equation (i), and the ink is circulated, and thereby an ink temperature and a dissolved oxygen content (degassing degree) can be further stabilized. In addition, by performing this printing preparation, it is possible to stabilize an ink temperature and a degassing degree in advance before printing starts. Further, an ejection amount of the heads may be the maximum ink ejection amount to the maximum. However, an ejection amount during practical printing may be varied depending on an ejection state such as whether or not each nozzle is driven according to an image to be recorded, and a practical ink outflow amount may be varied depending on this variation. Setting information regarding the ink inflow amount is determined in advance based on the maximum ink ejection amount and the like of the ink jet recording apparatus and is stored in the above-described memory 123 or the like, and the controller 120 controls an ink inflow amount based on the information. In addition, the maximum ink ejection amount may be grasped by performing ejection in the above-described condition. In addition, if the maximum ink ejection amount for each of the heads 60 is set to D (mL/min), "B=4D". During printing, a fluid volume of the sub-tank 70 is gradually reduced according to the ejection of the ink. Therefore, the ink is normally supplied to the sub-tank 70 during printing such that a fluid volume of the sub-tank 70 is equal to or more than the predetermined first fluid volume at all times. In addition, although not included in the ink supply device 10 shown in FIG. 3, a temperature adjustment module may be further provided at any position in the ink path 51 between the supply pump 54 and the sub-tank 70 in order to stabilize an ink temperature during printing.

As above, according to the present embodiment, it is possible to provide an ink jet recording apparatus in which durability of the head, and the ejection stability of the ultraviolet-ray curable ink are good, and, further, solubility of the photopolymerization initiator included in the ultraviolet-ray curable ink, curability of the ultraviolet-ray curable ink, and suppression of curing wrinkles are also good. Particularly, the present embodiment has features in a temperature range and a viscosity range during heating. The recording apparatus is further provided with the circulation path and the degassing mechanism, and a dissolved oxygen content of the ink is reduced by the degassing mechanism so as to improve the ejection stability. At this time, since the degassing efficiency (dissolved oxygen content) is changed depending on a viscosity and a temperature of the ink, it is possible to increase the degassing efficiency by setting a temperature and a viscosity of the ink in a predetermined range.

5. Modification Examples of Recording Apparatus

The heating mechanism 90 and the degassing mechanism 100 are located in the middle of the ink circulation path 80 in FIG. 3. However, the heating mechanism 90 and the degassing mechanism 100 are not limited to being located in the middle of the ink circulation path 80, and may be provided independently from each other at any positions from the ink container (the ink cartridge 50) up to the front of the nozzle (not shown) of the head 60. In other words, as long as a temperature and a viscosity of an ejected ink are in the above-described predetermined range, the heating mechanism 90 and the degassing mechanism 100 may be provided at any positions, or may be provided between the ink cartridge 50 and the sub-tank 70. Of them, the degassing mechanism 100 is preferably provided on the downstream side of the heating mechanism 90 since degassing efficiency is good. Alternatively, since degassing efficiency is good, and a temperature of the ink is easily stabilized when the ink is heated, the heating mechanism 90 and the degassing mechanism 100 are preferably provided in the ink circulation path 80 independently from each other as shown in FIG. 3.

In any device configuration, as a positional relationship between the heating mechanism 90 and the degassing mechanism 100, the heating mechanism may be provided on the downstream side of the degassing mechanism instead of the degassing mechanism being provided on the downstream side of the heating mechanism as shown in FIG. 3 when viewed from the direction in which the ink flows. However, as shown in Examples described later, when the degassing mechanism is located on the downstream side of the heating mechanism, degassing is sufficiently performed, and thus the ejection stability becomes better.

In addition, as described above, the recording apparatus of the present embodiment may be an on-carriage type or off-carriage type serial printer instead of the line printer.

Further, the present embodiment is not limited to a form in which a part of the ink circulation path 80 passes through the heads 60 as in FIG. 3, and may have a modification form in which the ink path 51 extending from the ink circulation path 80 has finish points inside the heads 60. Specifically, the ink circulation path 80 has branched points in front (corresponding to black point portions on the upper side of the heads 60 in FIG. 3) of the respective heads 60 (in FIG. 3, the black points correspond to the branched portions). One of the branch extends to the head 60 via the ink path 51 and becomes a finish point in this state. In other words, an ink which flows from the ink circulation path 80 to the head 60 is not required to be circulated any longer, and is ejected from the nozzle of the head 60 or stays at the ink path 51. In addition, the other of the branch arrives at the same branch provided in front of the next head 60 through the ink circulation path 80 (a path after being branched out is the same as described above, and thus description thereof will be omitted). Further, in a case where an ink flows toward not the head 60 side but the ink circulation path 80 side in the branch provided in front of the head 60 which is located furthest on the downstream side in the ink circulation path 80, the ink finally returns to the sub-tank 70. Thereafter, the ink flows through the ink circulation path 80 from the sub-tank 70 again.

Also in the modification form, an amount of an ink which flows into the branch (branched point) is set to an ink inflow amount, an amount of an ink which returns from the branched point to the sub-tank 70 is set to an ink outflow amount, and an amount of an ink which is supplied from the branched point to the head 60 is set to an ink ejection amount. Further, also in the modification form, an upstream side of the head 60 indicates an upstream side of the branched point.

Ink Jet Recording Method

An embodiment of the invention is related to an ink jet recording method (hereinafter, simply referred to as a "recording method"). The recording method uses the ink jet recording apparatus of the above-described embodiment and uses an ultraviolet-ray curable ink of which a viscosity at 28° C. when employed in this recording method is 8 mPa·s or more, so as to perform ink jet recording. The recording method includes an ejecting step of heating a ultraviolet-ray curable ink to 28° C. to 40° C. so as to have a viscosity of 15 mPa·s or less and ejecting the degassed ultraviolet-ray curable ink from a head to a recording medium, and a curing step of curing the ink which is ejected and is landed on (attached to) the recording medium. In this way, a cured object of the ink is formed by the ink cured on the recording medium.

1. Viscosity at 28° C. of Ultraviolet-Ray Curable Ink

The ultraviolet-ray curable ink used in the recording method has a viscosity of 8 mPa·s or more, particularly 8 mPa·s to 25 mPa·s, and more preferably 8 mPa·s to 20 mPa·s, at 28° C. By using the ultraviolet-ray curable ink with this viscosity, it is possible to effectively prevent occurrence of curing wrinkles in an obtained cured object. A principle in which the curing wrinkles is guessed as follows, but the scope of the invention is not limited by the following guess. Curing wrinkles are guessed to be generated since, when, in a coated film of ink, a surface of the coated film is cured earlier, and an inside of the coated film is cured later than the surface of the coated film, the coated film surface which is cured earlier is deformed, the ink inside the coated film irregularly flows, or the like. In addition, the ultraviolet-ray curable ink with a low viscosity is observed to tend to have a great polymerization shrinkage ratio (a difference between a volume of an ink and a volume of the ink (cured object) after being cured with respect to a volume of the ink before being cured with predetermined mass), and, for this reason, occurrence of curing wrinkles is guessed to be notable. Further, an ultraviolet-ray curable ink which contains (meth) acrylate containing mono-functional (meth)acrylate described later, particularly, a vinyl ether group expressed in Formula (I) is observed to have a tendency for curing wrinkles to easily occur, and, particularly, in a low viscosity ultraviolet-ray curable ink which contains (meth)acrylate containing a vinyl ether group expressed in Formula (I), occurrence of curing wrinkles is guessed to be notable. An ultraviolet-ray curable ink used in the ink jet recording method of the present embodiment is made to be set in the above-described viscosity range, and thereby it is possible to effectively prevent occurrence of curing wrinkles. In addition, a viscosity in the present specification may employ a value measured using a method performed in Examples described later.

Particularly, a viscosity of the ink in the present embodiment may be measured using an E type viscometer. When the E type viscometer is used, to perform measurement according to an operation manual of the viscometer is a common sense, therefore, needless to say, the measurement is performed by setting the type or rotation speed of rotor according to the operation manual such that a viscosity of the ink which is a measurement target can be normally measured, and, also in the present embodiment, it is obvious that the measurement is performed by setting the type or rotation speed of rotor according to the operation manual such that a viscosity of the ink which is a measurement target can be normally measured.

2. Recording Medium

The recording medium may include, for example, a recording medium with an ink non-absorption nature or an ink low-absorption nature. Of the recording media, a recording medium with the ink non-absorption nature may include, for example, a medium in which plastic is coated on a base material such as a plastic film or paper in which surface treatment for ink jet recording is not performed (that is, an ink absorption layer is not formed), a medium to which a plastic film is attached, and the like. The plastic described here is not limited to the following, and may include, for example, Polyvinyl chloride (PVC), polyethylene terephthalate (PET), polycarbonate (PC), polystyrene (PS), polyurethane (PU), polyethylene (PE), polypropylene (PP), and the like. Examples of the recording medium with the ink low-absorption nature may include printing paper such as art paper, coated paper and matte paper.

3. Ejecting Step

An ejecting step in the present embodiment is to eject an ultraviolet-ray curable ink (hereinafter, simply referred to as an "ink") from the head to a recording medium. In addition, a temperature of the ejected ultraviolet-ray curable ink is 28° C. to 40° C., and a viscosity of the ultraviolet-ray curable ink at the corresponding temperature is 15 mPa·s or less.

The temperature 28° C. to 40° C. is a relatively low temperature for a temperature which is increased through heating. As such, if a temperature of an ejected ink (hereinafter, also referred to as an "ejection temperature") is relatively low, it is possible to achieve advantageous effects in which, since deterioration in members of the head can be prevented, durability of the head is improved, and, since there is almost no variation in a temperature, ejection stability of the ink becomes favorable.

Here, the "temperature of the ejected ultraviolet-ray curable ink" in the present specification is indicated by an average value of measured temperatures by continuously ejecting ink from the head for sixty minutes and measuring a temperature every five minutes during that time.

Hereinafter, the ejection temperature will be described in detail. If the temperature is 28° C. or more, the ejection temperature becomes good since a dissolved oxygen content at the temperature increases (a degassing degree decreases). In addition to this, a viscosity of an ultraviolet-ray curable ink which can be ejected at a temperature lower than 28° C. is very low; however, there is a problem caused by the low viscosity, that is, a problem in that the members of the head deteriorate, durability of the head is worsened, and curing wrinkles also easily occur. In contrast, the ink according to the present embodiment can solve the problem. In addition, the above-described problem is notable particularly in a case where is a printer type is a line printer, and a light source is a light emitting diode (LED). For this reason, in a case of using a line printer or an LED in the present embodiment, an especially great effect is achieved.

In addition, an ultraviolet-ray curable ink of which ink viscosity when a heating temperature exceeds 40° C. is 15 mPa·s or less can prevent occurrence of curing wrinkles; however, since the heating temperature is very high, there is a problem in that durability of the head is worsened, and the ejection amount stability also worsens. In contrast, the ink according to the present embodiment can solve the problem.

In addition, if the viscosity of the ink at the ejection temperature is 15 mPa·s or less, it is possible to achieve advantageous effects in which the ejection stability of an ink becomes good even if a viscosity is high since a dissolved oxygen content increases (a degassing efficiency decreases). There is a problem in that the ejection stability worsens in a case where the viscosity of the ink is high, but, if the viscosity is 15 mPa·s or less, such a problem does not occur, and the ejection stability becomes good.

In addition, in order to further increase the effect and reliably solve the problem, the ejection temperature is preferably 34° C. to 40° C. The upper limit of the viscosity of the ink at a predetermined ejection temperature is preferably 12 mPa·s or less. The lower limit of the viscosity is preferably 5 mPa·s or more, more preferably 6 mPa·s or more, still more preferably 7 mPa·s or more, and most preferably 8 mPa·s or more. If the lower limit of the viscosity of the ink at a predetermined ejection temperature is the above-described value, durability of the head due to a composition of the ink becomes favorable, occurrence of curing wrinkles due to a composition of the ink can be effectively prevented, and instability of ejection due to a low viscosity can be prevented. The fact that instability of ejection due to a low viscosity can be prevented means that the ejection stability and the ejection amount stability become better.

Further, the ultraviolet-ray curable ink, as described above, has a higher viscosity than an aqueous ink used for a typical ink for ink jet and has a great viscosity fluctuation depending on a temperature fluctuation during ejection. This viscosity fluctuation of the ink exerts great influence on a variation in a droplet size and a variation in a droplet ejection speed, and, further causes image quality deterioration. For this reason, preferably, a temperature of an ejected ink (ejection temperature) is maintained to be as constant as possible. In the ink according to the present embodiment, an ejection temperature is relatively low, and the ejection temperature can be maintained to be substantially constant by adjusting a temperature through heating. Therefore, the ink according to the present embodiment provides good image quality.

Here, a description will be made of an example of the ink design method for setting a viscosity of the ink in a desired range.

A mixed viscosity of all polymerizable compounds included in an ink can be calculated from viscosities of respective polymerizable compounds to be used and mass ratios to polymerizable compositions of the respective polymerizable compositions.

The ink is assumed to include the N types of polymerizable compounds including A, B . . . (omission) . . . , and N. A viscosity of a polymerizable compound A is set to VA, and a mass ratio of the polymerizable compound A to a total amount of the polymerizable compounds of the ink is set to MA. A viscosity of a polymerizable compound B is set to VB, and a mass ratio of the polymerizable compound B to a total amount of the polymerizable compounds of the ink is set to MB. Similarly, a viscosity of an N-th polymerizable compound N is set to VN, and a mass ratio of the polymerizable compound N to a total amount of the polymerizable compounds of the ink is set to MN. For confirmation, the equation "MA+MB+ . . . (omission)+MN=1" is established. In addition, a mixed viscosity of all the polymerizable compounds included in the ink is set to VX. Then, the following Equation (1) is assumed to be satisfied.

$$MA\times\text{Log } VA+MB\times\text{Log } VB+\ldots\text{(omission)}\ldots+MN\times\text{Log } VN=\text{Log } VX \quad (1)$$

In addition, for example, in a case where two kinds of polymerizable compounds are included in an ink, mass ratios of the polymerizable compounds after MB are set to zero. The number of kinds of polymerizable compounds may be any number of one or more kinds.

Next, an example of the procedures (steps 1 to 7) for setting an ink viscosity in a desired range will be described.

First, information of a viscosity at a predetermined temperature of each polymerizable compound to be used is obtained (step 1). An obtaining method may include obtaining a viscosity from a manufacturer's catalog, measuring a viscosity at a predetermined temperature of each polymerizable compound, or the like. Since a viscosity of a simple polymerizable compound may be different depending on manufacturers even in the same polymerizable compound, viscosity information provided by a manufacturer of a polymerizable compound to be used may be employed.

Successively, a target viscosity is set to VX, and a composition ratio (mass ratio) of each polymerizable compound is determined such that VX becomes the target viscosity based on above-described Equation (1) (step 2). The target viscosity is a viscosity of an ink composition which is desired to be finally obtained and is set to a viscosity in a range of 8 mPa·s to 15 mPa·s. The predetermined temperature is set to a temperature in a range of 28° C. to 40° C.

Next, the polymerizable compounds are practically mixed so as to prepare a composition of the polymerizable compounds (hereinafter, referred to as a "polymerizable composition"), and a viscosity thereof is measured at a predetermined temperature (step 3).

Successively, in a case where the viscosity of the polymerizable composition is approximately close to the target viscosity (in this step 4, "target viscosity±5 mPa·s"), an ink composition including the polymerizable composition and components other than the polymerizable compound such as a photopolymerization initiator and pigments (hereinafter, referred to as "components other than the polymerizable compound") is prepared, and a viscosity of the ink composition is measured (step 4). In this step 4, in a case where there is a component which is a component other than the polymerizable compound and is mixed in the ink composition in a form of a pigment dispersion such as, for example, pigments, since a polymerizable compound which is included in the pigment dispersion in advance is also carried into the ink composition, the ink composition is required to be adjusted to a mass ratio obtained by subtracting a mass ratio of the polymerizable compound carried into the ink composition as a pigment dispersion from the composition ratio of each polymerizable compound determined in step 2.

Next, a difference between the measured viscosity of the ink composition and the measured viscosity of the polymerizable composition is calculated and is set to VY (step 5). Here, normally, "VY>0". VY depends on the kind of component other than the polymerizable compound or an inclusion condition such as a content, and VY was 3 mPa·s to 5 mPa·s in Examples described later.

Next, "target viscosity in step 2-VY" is set to VX, and a composition ratio of each polymerizable compound is determined again such that VX becomes the set "target viscosity in step 2-VY" from above-described Equation (1) (step 6).

Next, the polymerizable compounds with the composition ratios determined in step 6 are mixed with components other than the polymerizable compound so as to prepare an ink composition, and a viscosity thereof at a predetermined temperature is measured (step 7). If the measured viscosity is the target viscosity, the ink composition prepared in step 7 is obtained as an ink composition with the target viscosity.

On the other hand, in a case where the measured viscosity of the prepared composition of the polymerizable compounds is not in a range of "target viscosity±5 mPa·s", the following fine adjustment is performed, and then the procedures are performed again from step 3. First, if the measured viscosity is too high, fine adjustment is adjusted in which a content of a polymerizable compound of which a viscosity as a simple substance is higher than the target viscosity is reduced, and, a content of a polymerizable compound of which a viscosity as a simple substance is lower than the target viscosity is increased. On the other hand, if the measured viscosity is too low, fine adjustment is adjusted in which a content of a polymerizable compound of which a viscosity as a simple substance is lower than the target viscosity is reduced, and, a content of a polymerizable compound of which a viscosity as a simple substance is higher than the target viscosity is increased. In addition, in a case where the measured viscosity of the prepared ink composition is not the target viscosity in step 7, adjustment such as the above-described fine adjustment is performed, and then the procedures are performed again from step 7.

4. Ink Supply Step

In the recording method of the present embodiment, recording may be performed using an ink jet recording apparatus in which at least a part of an ink path for supplying ink from an ink container to a head is an ink circulation path. In other words, in the recording method, the ink circulation path for circulating ink is provided at least a part of the ink path for supplying ink to the head of the ink jet recording apparatus, and an ink supply step of circulating the ink in the ink circulation path may be further included. An ink flowing out of the head is circulated in at least a part of the ink path, and thereby a temperature of the ink in the ink circulation path is easily stabilized, and, further, an ejection amount is easily stabilized.

In the ink supply step, an inflow amount of an ultraviolet-ray curable ink (ink inflow amount) supplied to the head from the ink circulation path may be adjusted such that an ink of the ink inflow amount is supplied to the head. The ink supply step may be performed during the ejecting step. In the ink supply step, it is preferable that the ink inflow amount be larger than an ejection amount in which an ink is ejected from the head during recording (printing) since outflow of the ink occurs and thus the ink is circulated. In addition, the ink inflow amount is more preferably larger than the maximum value (the maximum ink ejection amount described later) of an ejection amount in which an ink is ejected from the head, further preferably twice or more the maximum ink ejection amount, and still further preferably 2.5 times or more the maximum ink ejection amount. If the ink inflow amount is in the above-described range, an ejection amount is easily stabilized. On the other hand, the upper limit of the ink inflow amount is not particularly limited and may be four times or less the maximum ink ejection amount. In addition, an amount of an ink ejected from the head, that is, both the ink inflow amount and the maximum ink ejection amount are amounts in terms of a volume.

The ink supply step may be performed by providing a device which adjusts an ink supply amount (hereinafter, simply referred to as an "ink supply device"), for example, in the ink jet recording apparatus described later. The ink supply device will be described later.

5. Curing Step

In the curing step included in the recording method of the present embodiment, an ultraviolet-ray curable ink attached to a recording medium is irradiated with ultraviolet rays from a light source and is thus cured. In this step, the photopolymerization initiator included in the ink is decomposed by irradiation with the ultraviolet rays so as to generate initiating species such as a radical, an acid, and a base, and a polymerization reaction of photopolymerizable compounds is promoted by a function of the initiating species. Alternatively, in this step, a polymerization reaction of photopolymerizable compounds is initiated by irradiation with the ultraviolet rays. At this time, if there is a sensitizing dye along with the photopolymerization initiator in the ink, the sensitizing dye in a system absorbs the ultraviolet rays so as to be excited, and promotes decomposition of the photopolymerization initiator through contact with the photopolymerization initiator, thereby achieving a curing reaction of higher sensitivity.

A mercury lamp or a gas or solid-state laser is mainly used as the light source (ultraviolet light source), and, a mercury lamp or a metal-halide lamp is widely known as a light source used to cure an ultraviolet-ray curable ink. On the other hand, mercury-free is intensively desirable from the viewpoint of the protection of the environment at present, and thus replacement with a GaN-based semiconductor ultraviolet light emitting device is very useful industrially and environmentally. In addition, a light emitting diode (LED) such as an ultraviolet light emitting diode (UV-LED) and an ultraviolet laser diode (UV-LD) has small size, long life, high efficiency, and low costs, and is expected as an ultraviolet-ray curable ink light source.

As above, the ultraviolet-ray curable ink in the present embodiment can be used appropriately even if a light source is the LED or the metal halide lamp, but the LED is preferably used of the two.

An emission peak wavelength of the light source (ultraviolet light source) is preferably in a range of 360 nm to 420 nm, and is more preferably in a range of 380 nm to 410 nm. If the emission peak wavelength is in the above-described range, the UV-LED is easily obtained and is inexpensive, and is thus appropriate.

In addition, a peak intensity (irradiation peak intensity) of ultraviolet rays applied from a light source (preferably, the LED) which has an emission peak wavelength in the above-described range is preferably 800 mW/cm$^2$ or more, and more preferably 1000 mW/cm$^2$ or more. If the irradiation peak intensity is in the above-described range, the curability becomes better, and it is possible to more effectively suppress occurrence of curing wrinkles. The upper limit of the irradiation peak intensity is not particularly limited and may be 3000 mW/cm$^2$ or less. A principle of occurrence of the curing wrinkles is guessed as described above, and if the irradiation peak intensity is in the above-described range, up to inside can be cured at the same time as a surface of a coated film being cured, and thus it is guessed that the ultraviolet rays can effectively suppress occurrence of curing wrinkles. If a viscosity at 28° C. of the ultraviolet-ray curable ink of the present embodiment is 8 mPa·s or more, it is possible to more effectively prevent occurrence of curing wrinkles. Particularly, if the ultraviolet-ray curable ink contains (meth)acrylates containing a vinyl ether group expressed in Formula (1) described later, and an irradiation peak intensity is in the above-described range, the curability becomes better, and it is possible to more effectively suppress occurrence of curing wrinkles.

In addition, the irradiation peak intensity in the present specification employs a value measured using an ultraviolet ray intensity meter UM-10 and a light reception unit UM-400 (both of the two are manufactured by KONICA MINOLTA SENSING, INC.). However, this does no intends to limit a measurement method of an irradiation peak intensity, and a well-known measurement method in the related art may be used.

An ultraviolet-ray curable ink which can be cured with an irradiation energy of preferably 600 mJ/cm$^2$ and more preferably 200 mJ/cm$^2$ to 500 mJ/cm$^2$ from a light source having an emission peak wavelength in the above-described range may be used for the recording method of the present embodiment. In this case, it is possible to easily increase an output of the LED and to realize low cost printing and high printing speed. Here, the irradiation energy is a total irradiation energy obtained by summing respective irradiation energies if the irradiation is performed in plurality.

In addition, the irradiation energy in the present specification is calculated by multiplying time from irradiation start to irradiation end by an irradiation peak intensity. In addition, if the irradiation is performed in plurality, the irradiation energy is expressed by an irradiation energy amount obtained by summing a plurality of irradiations. An emission peak wavelength may be singly or in plurality in the above-described preferable wavelength range. Even if there are a plurality of wavelengths, an irradiation energy amount of all the ultraviolet rays having the emission peak wavelengths in the above-described range is used as the irradiation energy.

This ink is obtained by including at least one of a photopolymerization initiator which is decomposed through irradiation with ultraviolet rays in the above-described wavelength range and a polymerizable compound which initiates polymerization through irradiation with ultraviolet rays in the above-described wavelength range.

In addition, an ejection amount (an attachment amount, an implantation amount) of an ink per unit area during ejection onto a recording medium is preferably 5 mg/inch$^2$ to 16 mg/inch$^2$ in order to prevent wasteful use of the ink.

In addition, an ejection amount of an ink per unit area is varied depending on a recording resolution and an ink amount implanted into a recording unit region (pixel) regulated by the recording resolution, but is preferably 300 dpi×300 dpi to 1500 dpi×1500 dpi when the recording resolution (printing resolution) is expressed by "resolution in a sub-scanning direction×a resolution in a direction (main scanning direction) intersecting the sub-scanning direction". In addition, a nozzle density of the head and an ejection amount are preferably adjusted according to this recording resolution.

In addition, a lower limit value of an ejection amount of an ink per pixel is preferably 2 ng/pixel and more preferably 3 ng/pixel. On the other hand, an upper limit value of the ejection amount is preferably 200 ng/pixel, more preferably 160 ng/pixel, further more preferably 50 ng/pixel, and most preferably 20 ng/pixel. Further, the nozzle density (a distance between the nozzles in a nozzle string) is preferably 180 dpi to 720 dpi, and more preferably 300 dpi to 720 dpi.

As above, according to the present embodiment, it is possible to provide an ink jet recording method, used for an ink jet recording apparatus, in which durability of the head and the ejection stability of the ultraviolet-ray curable ink are good, and, further, solubility of the photopolymerization initiator included in the ultraviolet-ray curable ink, curability of the ultraviolet-ray curable ink, and suppression of curing wrinkles are also good.

Ultraviolet-Ray Curable Ink

In addition, an embodiment of the invention is related to an ultraviolet-ray curable ink which can be used for the ink jet recording apparatus and the ink jet recording method of the above-described embodiment. Above-described, in the ultraviolet-ray curable ink, a viscosity at 28° C., an ejection temperature, and a viscosity at the temperature are respectively in predetermined ranges. An ink for setting the viscosity in a predetermined range may be designed using the above-described ink design method.

Hereinafter, a description will be made of additives (components) which are included in the ultraviolet-ray curable ink of the present embodiment or which may be included as desired.

1. Polymerizable Compound

Polymerizable compounds included in the ink of the present embodiment are polymerized independently or by action of a photopolymerization initiator described later when light is applied, and can cure a printed ink. As other polymerizable compounds, various well-known monomers and oligomers in the related art such as monofunction, bifunction, and multi-function of trifunction or higher may be used. The monomers may include, for example, (meth) acrylic acid, itaconic acid, crotonic acid, unsaturated carboxylic acids such as isocrotonic acid and maleic acid or salts or esters thereof, urethane, amides and anhydrides thereof, acrylonitrile, styrene, various unsaturated polyesters, unsaturated polyethers, unsaturated polyamides, and unsaturated urethanes. In addition, the oligomers may include, for example, oligomers formed from the monomers such as linear acrylic oligomers, epoxy (meth)acrylate, oxetane (meth)acrylate, aliphatic urethane (meth)acrylate, aromatic urethane (meth)acrylate, and polyester (meth)acrylate.

Among them, (meth)acrylic acid esters, that is, (meth) acrylates are preferable. Among the (meth)acrylates, at least one of (meth)acrylic acid esters containing a vinyl ether group expressed in Formula (I) and other monofunctional (meth)acrylates is preferable, (meth)acrylic acid esters containing a vinyl ether group is more preferable, and the (meth)acrylic acid esters containing a vinyl ether group and other monofunctional (meth)acrylates are still more preferable.

Hereinafter, the polymerizable compound will be described in detail mainly based on the (meth)acrylate.

1-1. (Meth)Acrylic Acid Esters Containing Vinyl Ether Group

The ink of the present embodiment preferably includes the (meth)acrylic acid esters containing a vinyl ether group expressed in the following Formula (I).

$$CH_2{=}CR^1{-}COOR^2{-}O{-}CH{=}CH{-}R^3 \quad (I)$$

(wherein $R^1$ indicates a hydrogen atom or a methyl group, $R^2$ indicates a divalent organic residue having 2 to 20 carbon atoms, and $R^3$ indicates a hydrogen atom or a monovalent organic residue having 1 to 11 carbon atoms).

When the ink includes the (meth)acrylic acid esters containing a vinyl ether group, a viscosity of the ink can be reduced, curability of the ink becomes good, and occurrence of curing wrinkles can be effectively prevented. Further, it is more preferable in making curability of the ink favorable to use a compound having a vinyl ether group and a (meth) acryl group in one molecule than to use a compound having a vinyl ether group and a compound having a (meth)acryl group separately.

In Formula (I), as the divalent organic residue having 2 to 20 carbon atoms indicated by $R^2$, a linear, branched or cyclic alkylene group having 2 to 20 carbon atoms which may be substituted, an alkylene group having 2 to 20 carbon atoms which may be substituted and having an oxygen atom by an ether linkage and/or an ester linkage in the structure, and a divalent aromatic group having 6 to 11 carbon atoms which may be substituted are preferable. Among them, an alkylene group having 2 to 6 carbon atoms such as an ethylene group, an n-propylene group, an isopropylene group, and a butylene group, and an alkylene group having 2 to 9 carbon atoms and having an oxygen atom in the structure by an ether linkage such as an oxyethylene group, an oxy n-propylene group, an oxyisopropylene group, and oxybutylene group are preferably used.

In Formula (I), as the monovalent organic residue with a carbon number of 1 to 11 indicated by $R^3$, a linear, branched or cyclic alkyl group having 1 to 10 carbon atoms which may be substituted, and an aromatic group having 6 to 11 carbon atoms which may be substituted are preferable. Among them, an alkyl group having 1 or 2 carbon atoms such as a methyl group or an ethyl group, and an aromatic group having 6 to 8 carbon atoms such as a phenyl group or a benzyl group are preferably used.

In a case where each organic residue is a group which may be substituted, the substituent may be divided into a group having a carbon atom and a group not having a carbon atom. First, in a case where the substituent is a group having a carbon atom, the carbon atom is included in a carbon number of the organic residue. The group having a carbon atom is not limited to the following, and may include, for example, a carboxyl group, and an alkoxy group. Next, the group not having a carbon atom is not limited to the following, and may include, for example, a hydroxyl group, and a halo group.

The (meth)acrylic acid esters containing a vinyl ether group is not limited to the following, and may include, for example, 2-vinyloxyethyl (meth)acrylate, 3-vinyloxypropyl (meth)acrylate, 1-methyl-2-vinyloxyethyl (meth)acrylate, 2-vinyloxypropyl (meth)acrylate, 4-vinyloxybutyl (meth) acrylate, 1-methyl-3-vinyloxypropyl (meth)acrylate, 1-vinyloxymethylpropyl (meth)acrylate, 2-methyl-3-vinyloxypropyl (meth)acrylate, 1,1-dimethyl-2-vinyloxyethyl (meth) acrylate, 3-vinyloxybutyl (meth)acrylate, 1-methyl-2-vinyloxypropyl (meth)acrylate, 2-vinyloxybutyl (meth) acrylate, 4-vinyloxycyclohexyl (meth)acrylate, 6-vinyloxyhexyl (meth)acrylate, 4-vinyloxymethylcyclohexylmethyl (meth)acrylate, 3-vinyloxymethylcyclohexylmethyl (meth)acrylate, 2-vinyloxymethylcyclohexylmethyl (meth)acrylate, p-vinyloxymethylphenylmethyl (meth)acrylate, m-vinyloxymethylphenylmethyl (meth)acrylate, o-vinyloxymethylphenylmethyl (meth)acrylate, 2-(vinyloxyethoxy)ethyl (meth)acrylate, 2-(vinyloxyisopropoxy)ethyl (meth)acrylate, 2-(vinyloxyethoxy)propyl (meth)acrylate, 2-(vinyloxyethoxy)isopropyl (meth)acrylate, 2-(vinyloxyisopropoxy)propyl (meth)acrylate, 2-(vinyloxyisopropoxy) isopropyl (meth)acrylate, 2-(vinyloxyethoxyethoxy)ethyl (meth)acrylate, 2-(vinyloxyethoxyisopropoxy)ethyl (meth) acrylate, 2-(vinyloxyisopropoxyethoxy)ethyl (meth)acrylate, 2-(vinyloxyisopropoxyisopropoxy)ethyl (meth)acrylate, 2-(vinyloxyethoxyethoxy)propyl (meth)acrylate, 2-(vinyloxyethoxyisopropoxy)propyl (meth)acrylate, 2-(vinyloxyisopropoxyethoxy)propyl (meth)acrylate, 2-(vinyloxyisopropoxyisopropoxy)propyl (meth)acrylate, 2-(vinyloxyethoxyethoxy)isopropyl (meth)acrylate, 2-(vinyloxyethoxyisopropoxy)isopropyl (meth)acrylate, 2-(vinyloxyisopropoxyethoxy)isopropyl (meth)acrylate, 2-(vinyloxyisopropoxyisopropoxy)isopropyl (meth)acrylate, 2-(vinyloxyethoxyethoxyethoxy)ethyl (meth)acrylate, 2-(vinyloxyethoxyethoxyethoxyethoxy)ethyl (meth)acrylate, 2-(isopropenoxyethoxy)ethyl (meth)acrylate, 2-(isopropenoxyethoxyethoxy)ethyl (meth)acrylate, 2-(isopropenoxyethoxyethoxyethoxy)ethyl (meth)acrylate, 2-(isopropenoxyethoxyethoxyethoxyethoxy)ethyl (meth) acrylate, polyethylene glycol monovinyl ether (meth)acrylate, and polypropylene glycol monovinyl ether (meth) acrylate.

Among them, since a viscosity of the ink can be further reduced, a flash point is high, and curability of the ink becomes good, 2-(vinyloxyethoxy)ethyl (meth)acrylate, that is, at least one of 2-(vinyloxyethoxy)ethyl acrylate and 2-(vinyloxyethoxy)ethyl methacrylate is preferable; and 2-(vinyloxyethoxy)ethyl acrylate is more preferable. In particular, since both 2-(vinyloxyethoxy)ethyl acrylate and 2-(vinyloxyethoxy)ethyl methacrylate have a simple structure and a low molecular weight, the viscosity of the ink can be significantly reduced. Examples of 2-(vinyloxyethoxy) ethyl (meth)acrylate include 2-(2-vinyloxyethoxy)ethyl (meth)acrylate and 2-(1-vinyloxyethoxy) (meth)acrylate. Examples of 2-(vinyloxyethoxy)ethyl acrylate include 2-(2-vinyloxyethoxy)ethyl acrylate and 2-(1-vinyloxyethoxy) acrylate. In addition, 2-(vinyloxyethoxy)ethyl acrylate is superior to 2-(vinyloxyethoxy)ethyl methacrylate in terms of the curability.

As the (meth)acrylic acid esters containing a vinyl ether group, one kind may be used alone or two or more kinds may be used in combination.

A content of the (meth)acrylic acid esters containing a vinyl ether group, particularly, 2-(vinyloxyethoxy)ethyl (meth)acrylate is preferably 10 mass % to 70 mass %, more preferably 10 mass % to 60 mass %, and most preferably 20 mass % to 50 mass %, with respect to the total mass (100 mass %) of the ink. If the content is equal to or more than the lower limit value, a viscosity of the ink can be reduced, and the curability of the ink becomes better. On the other hand, if the content is equal to or less than the upper limit value, the preservation stability of the ink can be maintained in a favorable state, and occurrence of curing wrinkles can be more effectively prevented.

A method of preparing the (meth)acrylic acid esters containing a vinyl ether group is not limited to the following, and may include a method of esterifying an (meth)acrylic acid and hydroxyl group-containing vinyl ether (preparation B), a method of esterifying a (meth)acrylic acid halide and hydroxyl group-containing vinyl ether (preparation C), a method of esterifying a (meth)acrylic acid anhydride and hydroxyl group-containing vinyl ether (preparation D), a method of ester-exchanging a (meth)acrylic acid ester and hydroxyl group-containing vinyl ether (preparation E), a method of esterifying (meth)acrylic acid and halogen-containing vinyl ether (preparation F), a method of esterifying a (meth)acrylic acid alkaline (earth) metal salt and halogen-containing vinyl ether (preparation G), a method of vinyl-exchanging a hydroxyl group-containing (meth)acrylic acid ester and a vinyl carboxylate (preparation H), and a method of ether-exchanging a hydroxyl group-containing (meth) acrylic acid ester and alkyl vinyl ether (preparation I).

Among them, the preparation E is preferable since a desired effect can be further achieved in the present embodiment.

1-2. Monofunctional (Meth)Acrylate

The ink of the present embodiment preferably includes a monofunctional (meth)acrylate. Here, in a case where the ink of the present embodiment includes the above-described (meth)acrylic acid esters containing a vinyl ether group (however, limited to monofunctional (meth)acrylates), the (meth)acrylic acid esters containing a vinyl ether group are also included in the monofunctional (meth)acrylates, but a description of the (meth)acrylic acid esters containing a vinyl ether group will be omitted. In the following, monofunctional (meth)acrylates other than the above-described (meth)acrylic acid esters containing a vinyl ether group will be described. The ink contains the monofunctional (meth) acrylate, and thereby a viscosity of the ink can be reduced, and both solubility of a photopolymerization initiator and other additives become good. Further, the solubility of a photopolymerization initiator and other additives and curability of the ink becomes good, and thereby the ejection stability of the ink becomes good, and toughness, heat resistance and chemical resistance of a coated film increase.

The monofunctional (meth)acrylate may include, for example, phenoxyethyl (meth)acrylate, isoamyl (meth)acrylate, stearyl (meth)acrylate, lauryl (meth)acrylate, octyl (meth)acrylate, decyl (meth)acrylate, isomyristyl (meth) acrylate, isostearyl (meth)acrylate, 2-ethylhexyl-diglycol (meth)acrylate, 2-hydroxybutyl (meth)acrylate, 4-hydroxybutyl (meth)acrylate, 2-methoxyethyl (meth)acrylate, butoxyethyl (meth)acrylate, ethoxy-diethylene glycol (meth)acrylate, methoxy diethylene glycol (meth)acrylate, methoxy polyethylene glycol (meth)acrylate, methoxy propylene glycol (meth)acrylate, tetrahydrofurfuryl (meth)acrylate, isobornyl (meth)acrylate, 2-hydroxyethyl (meth)acrylate, 2-hydroxypropyl (meth)acrylate, 2-hydroxy-3-phenoxypropyl (meth)acrylate, lactone-modifiable (meth) acrylate, t-butyl cyclohexyl (meth)acrylate, dicyclopentanyl (meth)acrylate, dicyclopentenyloxyethyl (meth)acrylate, benzyl (meth)acrylate, ethoxylated nonyl phenyl (meth) acrylate, alkoxylated nonyl phenyl (meth)acrylate, and p-cumylphenol EO-modified (meth)acrylate.

Among them, a monofunctional (meth)acrylate having an aromatic ring skeleton in the molecule is preferable since the curability, the preservation stability, and the solubility of a photopolymerization initiator become better. The monofunctional (meth)acrylate having an aromatic ring skeleton is not limited to the following, and may preferably include, for example, phenoxyethyl (meth)acrylate, benzyl (meth)acrylate, 2-hydroxy-phenoxypropyl (meth)acrylate, and phenoxy diethylene glycol (meth)acrylate. Among them, since a viscosity of the ink can be reduced, and the curability, the rubfastness, the adhesion, and the solubility of a photopolymerization initiator all become good, at least one of the phenoxyethyl (meth)acrylate and the benzyl (meth)acrylate is preferable, and the phenoxyethyl (meth)acrylate is more preferable.

As the monofunctional (meth)acrylate other than the (meth)acrylic acid esters containing a vinyl ether group, one kind may be used alone or two or more kinds may be used in combination.

A content of the monofunctional (meth)acrylate other than the (meth)acrylic acid esters containing a vinyl ether group is preferably 10 mass % to 65 mass %, more preferably 20 mass % to 50 mass %, and most preferably 10 mass % to 40 mass %, with respect to the total mass (100 mass %) of the ink. If the content is equal to or more than the lower limit value, the solubility of a photopolymerization initiator becomes better in addition to the curability. On the other hand, if the content is equal to or less than the upper limit value, the adhesion becomes better in addition to the curability.

In addition, in a case where the ink includes the (meth) acrylic acid esters containing a vinyl ether group (however, limited to the monofunctional (meth)acrylate), a total of a content of the monofunctional (meth)acrylate including this is preferably 30 mass % to 90 mass %, and more preferably 40 mass % to 70 mass %, with respect to the total mass (100 mass %) of the ink. If the content is in the above-described range, both an ink viscosity, specifically, an ink viscosity at 28° C. and an ink viscosity at an ejection temperature can be easily set in the above-described desired range.

1-3. Other Polymerizable Compounds

The ink of the present embodiment may further contain polymerizable compounds other than those described above (hereinafter, referred to as "other polymerizable compounds"). The other polymerizable compounds may include the above-described monomers and oligomers, and, among them, bifunctional or higher (meth)acrylates are preferable.

The bifunctional (meth)acrylate may include, for example, diethylene glycol di(meth)acrylate, triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, 1,6-hexanediol di(meth)acrylate, 1,9-nonanediol di(meth)acrylate, neopentyl glycol di(meth) acrylate, dimethylol-tricyclodecane (meth)acrylate, EO (ethylene oxide) adduct of bisphenol A di(meth)acrylate, PO (propylene oxide) adduct of bisphenol A di(meth)acrylate, hydroxypivalic acid neopentyl glycol di(meth)acrylate, and polytetramethylene glycol di(meth)acrylate.

The trifunctional or higher (meth)acrylates may include, for example, trimethylolpropane tri(meth)acrylate, EO-modified trimethylolpropane tri(meth)acrylate, pentaerythritol tri(meth)acrylate, pentaerythritol tetra(meth) acrylate, dipentaerythritol hexa(meth)acrylate, ditrimethylolpropane tetra(meth)acrylate, glycerol propoxy tri(meth) acrylate, caprolactone-modified trimethylolpropane tri (meth)acrylate, pentaerythritol ethoxy tetra(meth)acrylate, and caprolactam-modified dipentaerythritol hexa(meth) acrylate.

As the other polymerizable compounds, one kind may be used alone or two or more kinds may be used in combination.

In a case where the other polymerizable compounds are included in the ink, a content of the other polymerizable compounds is preferably 10 mass % to 50 mass % with respect to the total mass (100 mass %) of the ink. Particularly, in a case where the ink includes a bifunctional (meth) acrylate, a content of the bifunctional (meth)acrylate is preferably 5 mass % to 45 mass %, and more preferably 10 mass % to 30 mass %, with respect to the total mass (100 mass %) of the ink. If the content is in the above-described range, the curability of the ink or the rubfastness of a cured object becomes good, and a viscosity of the ink is likely to be designed to a desired viscosity. In addition, preferably, the monofunctional (meth)acrylates in which a simple polymerizable compound has a relatively low viscosity, and, among them, particularly, the (meth)acrylic acid esters containing a vinyl ether group with a low viscosity and other polymerizable compounds with a relatively high viscosity are combined. Thereby, a viscosity of the ink is likely to be designed to a desired viscosity.

In addition, when a photopolymerizable compound is used as the polymerizable compound, addition of a photopolymerization initiator may be omitted, but it is preferable to use the photopolymerization initiator since the start of polymerization can be easily adjusted.

2. Photopolymerization Initiator

The ink of the present embodiment may include a photopolymerization initiator. The photopolymerization initiator is used to cure an ink on a surface of a recording medium through photopolymerization by performing irradiation with ultraviolet rays and to perform printing. Among light beams, ultraviolet rays (UV) are used, and thereby stability becomes good, and costs of a light source lamp can be suppressed. A photopolymerization initiator is not limited as long as it generates an active species such as a radical or a cation and initiates polymerization of the polymerizable compounds, but a photoradical initiator or a photocationic initiator may be used, and, of them, the photoradical initiator is preferably used.

The photoradical initiators may include, for example, aromatic ketones, acyl phosphine oxide compounds, aromatic onium salt compounds, organic peroxides, thio compounds (thioxanthone compounds, thiophenyl group-containing compounds, and the like), hexaarylbiimidazole compounds, ketoxime ester compounds, borate compounds, azinium compounds, metallocene compounds, active ester compounds, compounds having a carbon-halogen bond, and alkyl amine compounds.

Among them, particularly, the curability of the ink becomes better, and thus the thioxanthone compounds (thioxanthone-based photopolymerization initiator) are preferably used, and the thioxanthone compounds and the acyl phosphine oxide compounds (acyl phosphine oxide-based photopolymerization initiator) are more preferablely used in combination.

Specific examples of the photoradical initiators may include acetophenone, acetophenone benzyl ketal, 1-hydroxy cyclohexyl phenyl ketone, 2,2-dimethoxy-2-phenyl acetophenone, xanthone, fluorenone, benzaldehyde, fluorene, anthraquinone, triphenylamine, carbazole, 3-methylacetophenone, 4-chloro benzophenone, 4,4'-dimethoxy benzophenone, 4,4'-diamino benzophenone, Michler ketone, benzoin propyl ether, benzoin ethyl ether, benzyl dimethyl ketal, 1-(4-isopropylphenyl)-2-hydroxy-2-methyl-propan-1-one, 2-hydroxy-2-methyl-1-phenylpropan-1-one, thioxanthone, diethyl thioxanthone, 2-isopropylthioxanthone, 2-chlorothioxanthone, 2-methyl-1-[4-(methylthio)phenyl]-2-morpholino propan-1-one, bis(2,4,6-trimethyl benzoyl)-phenyl phosphine oxide, 2,4,6-trimethyl benzoyl-diphenylphosphine oxide, 2,4-diethyl thioxanthone, and bis-(2,6-dimethoxybenzoyl)-2,4,4-trimethylpentyl phosphine oxide.

Examples of commercially available products of photoradical initiator includes IRGACURE 651 (2,2-dimethoxy-1,2-diphenylethan-1-one), IRGACURE 184 (1-hydroxy-cyclohexyl-phenyl-ketone), DAROCUR 1173 (2-hydroxy-2-methyl-1-phenyl-propan-1-one), IRGACURE 2959 (1-[4-(2-hydroxyethoxy)-phenyl]-2-hydroxy-2-methyl-propan-1-one), IRGACURE 127 (2-hydroxy-1-{4-[4-(2-hydroxy-2-methyl-propionyl)-benzyl]phenyl]-2-methyl-propan-1-one), IRGACURE 907 (2-methyl-1-(4-methylthiophenyl)-2-morpholinopropan-1-one), IRGACURE 369 (2-benzyl-2-dimethylamino-1-(4-morpholinophenyl)-butanone-1), IRGACURE 379 (2-(dimethylamino)-2-[(4-methylphenyl) methyl]-1-[4-(4-morpholinyl)phenyl]-1-butanone), DAROCUR TPO (2,4,6-trimethylbenzoyl-diphenyl-phosphine oxide), IRGACURE 819 (bis(2,4,6-trimethylbenzoyl)-phenylphosphine oxide), IRGACURE 784 (bis(η5-2,4-cyclopentadien-1-yl)-bis(2,6-difluoro-3-(1H-pyrrol-1-yl)-phenyl)titanium), IRGACURE OXE 01 (1,2-octanedione, 1-[4-(phenylthio)-, 2-(O-benzoyloxime)]), IRGACURE OXE 02 (ethanone, 1-[9-ethyl-6-(2-methylbenzoyl)-9H-carbazol-3-yl]-, 1-(O-acetyloxime)), IRGACURE 754 (mixture of oxyphenyl acetic acid 2-[2-oxo-2-phenylacetoxyethoxy] ethyl ester, and oxyphenylacetic acid, 2-(2-hydroxyethoxy) ethyl ester) (trade names, all of which are manufactured by BASF Japan Ltd.), KAYACURE DETX-S (2,4-diethylthioxanthone) (trade name, manufactured by Nippon Kayaku Co., Ltd.), Speedcure TPO (2,4,6,trimethylbenzoyl-diphenylphosphin oxide), Speedcure DETX (2,4-diethylthioxanthen-9-one) (trade names, all of which are manufactured by Lambson Ltd.), Lucirin TPO, LR8893, LR8970 (trade names, all manufactured by BASF Japan Ltd.), Ubecryl P36 (manufactured by UCB Japan Co., Ltd.), and Quantacure ITX (isopropylthioxanthone) (trade name, manufactured by Biddle Sawyer Corporation).

As the photopolymerization initiator, one kind may be used alone or two or more kinds may be used in combination.

The content of the photopolymerization initiator is preferably equal to or less than 20 mass % with respect to the total mass (100 mass %) of the ink from the viewpoints of improving the curing rate of ultraviolet rays to obtain good curability and of avoiding the remaining of an undissolved photopolymerization initiator and coloring caused by the photopolymerization initiator.

Particularly, when the photopolymerization initiator includes a thioxanthone compound, the content thereof is preferably 0.5 mass % to 4 mass % and more preferably 1 mass % to 3 mass % with respect to the total mass (100 mass %) of the ink from the viewpoints of obtaining more favorable curability. In addition, a dissolved oxygen content of the ink including the thioxanthone compound is preferably 20 ppm or less, and more preferably 1 ppm to 20 ppm, from the viewpoints of maintaining favorable ejection stability.

In addition, when the photopolymerization initiator includes an acylphosphine oxide compound, the content thereof is preferably 5 mass % to 15 mass % and more preferably 7 mass % to 13 mass % with respect to the total mass (100 mass %) of the ink. When the content is greater than or equal to the above-described lower limit, curability is further improved. More specifically, particularly when curing is performed using an LED (preferable emission peak wavelength of 360 nm to 420 nm), a curing rate is sufficiently high, and thus curability becomes better. Meanwhile, if the content is equal to or less than the above-described upper limit value, the solubility of the photopolymerization initiator becomes better.

3. Colorant

The ink of the present embodiment may contain a colorant. As the colorant, at least one of a pigment and a dye can be used.

3-1. Pigment

When a pigment is used as the colorant, the light resistance of the ink can be improved. As the pigment, both an inorganic pigment and an organic pigment can be used.

Examples of the inorganic pigment include carbon blacks (C.I. Pigment Black 7) such as furnace black, lamp black, acetylene black, iron oxide, and titanium oxide.

Examples of the organic pigment include azo pigments such as insoluble azo pigments, condensed azo pigments, azo lakes, and chelate azo pigments; polycyclic pigments such as phthalocyanine pigments, perylene and perinone pigments, anthraquinone pigments, quinacridone pigments, dioxane pigments, thioindigo pigments, isoindolinone pigments, and quinophthalone pigments; dye chelates (for example, basic dye chelates and acidic dye chelates); dye lakes (for example, basic dye lakes and acidic dye lakes); nitro pigments; nitroso pigments; aniline blacks; and daylight fluorescent pigments.

Examples of a pigment used for white ink include C.I. Pigment White 6, 18, and 21.

Examples of a pigment used for yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of a pigment used for magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, and 245; and C.I. Pigment Violet 19, 23, 32, 33, 36, 38, 43, and 50.

Examples of a pigment used for cyan ink include C.I. Pigment Blue 1, 2, 3, 15, 15:1, 15:2, 15:3, 15:34, 15:4, 16, 18, 22, 25, 60, 65, and 66; and C.I. Vat Blue 4 and 60.

In addition, examples of a pigment used for pigments other than magenta, cyan, and yellow include C.I. Pigment Green 7 and 10; C.I. Pigment Brown 3, 5, 25, and 26; and C.I. Pigment Orange 1, 2, 5, 7, 13, 14, 15, 16, 24, 34, 36, 38, 40, 43, and 63.

As the pigment, one kind may be used alone or two or more kinds may be used in combination.

When the pigment is used, the average particle size thereof is preferably equal to or less than 300 nm and more preferably 50 nm to 200 nm. If the average particle size is in the above-described range, the reliability in the ejection stability and dispersion stability of the ink becomes better and a high-quality image can be formed. In the present specification, the average particle size is measured using a dynamic light scattering method.

3-2. Dye

As the colorant, a dye may be used. The dye is not particularly limited, and an acidic dye, a direct dye, a reactive dye, and a basic dye may be used. Examples of the dye include C.I. Acid Yellow 17, 23, 42, 44, 79, and 142; C.I. Acid Red 52, 80, 82, 249, 254, and 289; C.I. Acid Blue 9, 45, and 249; C.I. Acid Black 1, 2, 24, and 94; C.I. Food Black 1 and 2; C.I. Direct Yellow 1, 12, 24, 33, 50, 55, 58, 86, 132, 142, 144, and 173; C.I. Direct Red 1, 4, 9, 80, 81, 225, and 227; C.I. Direct Blue 1, 2, 15, 71, 86, 87, 98, 165, 199, and 202; C.I. Direct Black 19, 38, 51, 71, 154, 168, 171, and 195; C.I. Reactive Red 14, 32, 55, 79, and 249; and C.I. Reactive Black 3, 4, and 35.

As the dye, one kind may be used alone or two or more kinds may be used in combination.

The content of the colorant is preferably 1 mass % to 20 mass % with respect to the total mass (100 mass %) of the ink since good concealment and color reproduction are obtained.

4. Dispersant

When the ink of the present embodiment includes the pigment, a dispersant may be added thereto in order to improve pigment dispersibility. The dispersant is not particularly limited, and may include, for example, a dispersant such as a polymeric dispersant which is usually used for preparing a pigment dispersion. Specific examples thereof include those containing, as a major component, one kind or more kinds of polyoxyalkylene polyalkylene polyamines, vinyl-based polymers and copolymers, acrylic polymers and copolymers, polyesters, polyamides, polyimides, polyurethanes, amine-based polymers, silicon-containing polymers, sulfur-containing polymers, fluorine-containing polymers, and epoxy resins. Examples of commercially available products of the polymeric dispersant include AJISPER series (trade name, manufactured by Ajinomoto Fine-Techno Co., Inc.); SOLSPERSE series (32000 and 36000 [trade name] manufactured by Avecia Co.); DISPERBYK series (trade name, manufactured by BYK Chemie); and DISPARLON series (trade name, manufacturd by Kusmoto Chemicals Ltd.).

As the dispersant, one kind may be used alone or two or more kinds may be used in combination. The content of the dispersant is not particularly limited, and an appropriate amount thereof may be added.

5. Polymerization Inhibitor

The ink of the present embodiment may include a polymerization inhibitor. The ink includes a polymerization inhibitor, and thereby it is possible to prevent a polymerization reaction of the above-described polymerizable compounds before being cured.

The polymerization inhibitor is not particularly limited, and may include, for example, a phenolic polymerization inhibitor. The phenolic polymerization inhibitor is not limited to the following, and may include, for example, p-methoxyphenol, cresol, t-butyl catechol, di-t-butyl-p-cresol, hydroquinone monomethyl ether, α-naphthol, 3,5-di-t-butyl-4-hydroxy toluene, 2,6-di-t-butyl-4-methylphenol, 2,2'-methylene-bis(4-methyl-6-t-butylphenol), 2,2'-methylene-bis(4-ethyl-6-butylphenol), and 4,4'-thio-bis(3-methyl-6-t-butylphenol).

Examples of commercially available products of the phenolic polymerization inhibitor may include, for example, p-Methoxyphenol (trade name, manufactured by Tokyo Chemical Industry Co., Ltd.; p-methoxyphenol), NONFLEX MBP (trade name, manufactured by Seiko Chemical Co., Ltd.; 2,2'-methylene-bis(4-methyl-6-t-butylphenol)), and BHT Swanox (trade name, manufactured by Seiko Chemical Co., Ltd.; 2,6-di-t-butyl-4-methylphenol).

As the polymerization inhibitor, one kind may be used alone or two or more kinds may be used in combination. The content of the polymerization inhibitor is not particularly limited, and an appropriate amount thereof may be added.

6. Surfactant

The ink of the present embodiment may include a surfactant. The surfactant is not particularly limited and may include, for example, a silicone-based surfactant. As the silicone-based surfactant, polyester-modified silicone or polyether-modified silicone is preferably used, and polyether-modified polydimethylsiloxane and polyester-modified polydimethylsiloxane are particularly preferable.

Examples of commercially available products of the surfactant may include BYK-347, BYK-348, BYK-UV3500, 3510, 3530, and 3570 (all of which are manufactured by BYK Chemie).

As the surfactant, one kind may be used along or two or more kinds may be used in combination. The content of the surfactant is not particularly limited, and an appropriate amount thereof may be added.

7. Other Additives

The ink according to the embodiment contains other additives (components) other than the above-described additives. These components are not particularly limited, and may include, for example, well-known materials in the related art such as a fluorescent brightening agent, a polymerization promoter, a penetration enhancer, and a wetting agent (moisturizing agent); and other additives. Specific examples of these additives include well-known additives in the related art such as a fixing agent, an antifungal agent, a preservative, an antioxidant, an ultraviolet absorber, a chelating agent, a pH adjusting agent, and a thickener.

As above-described, according to the present embodiment, it is possible to provide an ultraviolet-ray curable ink capable of achieving good curability and solubility of a photopolymerization initiator, used for an ink jet recording apparatus, in which the durability of a head and the ejection stability of the ultraviolet-ray curable ink become good, and further suppression of curing wrinkles is also good.

EXAMPLES

Hereinafter, the first embodiment will be described more in detail using Examples and Comparative Examples, but the invention is not limited to these Examples.

Materials Used

Materials used in Examples and Comparative Examples are as follows.

Polymerizable Compound

- 2-MTA (2-methoxyethyl acrylate; trade name, manufactured by OSAKA ORGANIC CHEMICAL INDUSTRY LTD.; a monofunctional (meth)acrylate)
- 4-HBA (4-hydroxybutyl acrylate; trade name, manufactured by OSAKA ORGANIC CHEMICAL INDUSTRY LTD.; a monofunctional (meth)acrylate)
- VEEA (2-(2-vinyloxyethoxy)ethyl acrylate; trade name, manufactured by Nippon Shokubai Co., Ltd.; a monofunctional (meth)acrylate)
- NEW FRONTIER PHE (phenoxyethyl acrylate; trade name, manufactured by Dai-ichi Kogyo Seiyaku Co., Ltd; a monofunctional (meth)acrylate; hereinafter, referred to as "PEA")
- V #160 (benzyl acrylate; trade name, manufactured by OSAKA ORGANIC CHEMICAL INDUSTRY LTD.; a monofunctional (meth)acrylate; hereinafter, referred to as "BZA")
- A-DPH (tripropylene glycol diacrylate; trade name, manufactured by SHIN-NAKAMURA CHEMICAL CO., LTD.; a bifunctional (meth)acrylate; hereinafter, referred to as "TPGDA")
- SR295 (pentaerythritol tetraacrylate; a tetrafunctional (meth)acrylate; trade name, manufactured by Sartomer Company Inc.)

Photopolymerization Initiator

- Lucirin TPO (trade name, manufactured by BASF Japan Ltd.; hereinafter, referred to as "TPO")

Fluorescent Brightening Agent

- HOSTALUX KCB (1,4-bis-(2-benzoxazole) naphthalene; trade name, manufactured by Clariant GMbH) Polymerization Inhibitor
- p-Methoxyphenol (trade name, manufactured by Tokyo Chemical Industry Co., Ltd.; p-methoxyphenol; hereinafter, referred to as "MEHQ")

Surfactant

- BYK-UV3500 (polyether-modified polydimethylsiloxane; manufactured by BYK Chemie; hereinafter, referred to as "BYK3500")

Colorant

- Cyanine Blue KRO (C.I. Pigment blue 15:3 (phthalocyanine pigment); trade name, manufactured by SANYO COLOR WORKS Ltd.; pigment average particle size: 80 nm; hereinafter, referred to as "Blue 15:3")

Dispersant

- Solsperse 32000 (trade name, manufactured by Avecia Co.; hereinafter, referred to as "SOL32000") Preparation of Ultraviolet Ray-Curable Inks A to L Materials shown in Table 1 below were added according to contents thereof (unit: mass %) shown in Table 1, and were stirred by a high-speed water-cooling type stirrer. As a result, ultraviolet ray-curable inks A to L were obtained.

Measurement and Evaluation Items

1. Viscosity Rank of Ink at 28° C.

Using a DVM-E type rotary viscometer (manufactured by Tokyo Keiki Inc.), the viscosity of each ink prepared above was measured at 28° C.

As a rotor, a DVM-E type cone rotor having a cone angle of 1°34' and a cone radius of 2.4 cm was used. A rotating speed thereof was 10 rpm.

The evaluation criteria are as follows. The evaluation results are shown in Table 1 below.

A: Less than 8 mPa·s
B: 8 mPa·s or greater and 10 mPa·s or less
C: Greater than 10 mPa·s and 12 mPa·s or less
D: Greater than 12 mPa·s and 15 mPa·s or less
E: Greater than 15 mPa·s 2. Evaluation of Solubility of Photopolymerization Initiator Each ink prepared above was stirred for 30 minutes at room temperature. After the stirring, whether or not there was a remaining of the undissolved photopolymerization initiator was observed visually.

The evaluation criteria are as follows. The evaluation results are shown in Table 1 below. In addition, in Table 1, this evaluation column is abbreviated to "initiator solubility".

A: The remaining of the undissolved photopolymerization initiator was not observed.
B: The remaining of the undissolved photopolymerization initiator was observed.

3. Evaluation of Curability of Ink

Each ink described above was coated on Lumirror #125-E20 (trade name, manufactured by Toray Industries, Inc.; PET film) using a bar coater (manufactured by TESTER SANGYO CO., LTD.). The thickness of the coated film was 10 μm after being cured. Next, the coated ink was irradiated with ultraviolet rays having an irradiation peak intensity of 1000 mW/cm$^2$ emitted from an LED (Firefly (trade name), manufactured by Phoseon Technology) having the peak at the wavelength of 395 nm for a predetermined time. As a result, a cured ink coated film was obtained. After the irradiation, a surface of the ink coated film was rubbed twenty times in a reciprocating manner with a cotton swab (Johnson & Johnson K. K.) under a load of 100 g. The irradiation energy required until the surface was not scratched was measured by changing the predetermined time.

The evaluation criteria are as follows. The evaluation results are shown in Table 1.

A: Equal to or less than 300 mJ/cm$^2$

B: Greater than 300 mJ/cm$^2$ and 400 mJ/cm$^2$ or less

C: Greater than 400 mJ/cm$^2$ volume of the sub-tank was 100 mL. The maximum ink ejection amount D for each head was 10 mL/min, and the maximum ink ejection amount B of the ink supply device was 40 mL/min since four heads were provided. The ink inflow amount A was set to 80 mL/min, and the ink was circulated with this ink inflow amount. The ink outflow amount C when the ink supply device ejected the ink with the maximum ink ejection amount was 40 mL/min.

TABLE 1

| Material Name | ABBREVIATION | Symbol of Ultraviolet-Ray Curable Ink | | | | | | | | | | | |
|---|---|---|---|---|---|---|---|---|---|---|---|---|---|
| | | A | B | C | D | E | F | G | H | I | J | K | L |
| Polymerizable Compound | 2MTA | 10.0 | 10.3 | 10.0 | 4.3 | — | 70.3 | 9.0 | 70.3 | 75.0 | 50.3 | — | 6.0 |
| | 4HBA | 30.0 | 32.3 | 30.0 | 25.0 | 18.3 | 10.0 | 30.0 | 15.0 | 10.0 | 30.3 | — | 31.0 |
| | VEEA | — | — | — | 30.0 | 28.0 | 5.0 | — | — | 8.3 | — | 39.3 | — |
| | PEA | — | 15.0 | 15.0 | — | 15.0 | — | — | — | — | — | — | — |
| | BZA | — | — | — | — | — | — | — | — | — | — | — | 12.0 |
| | TPGDA | 24.3 | 11.7 | 8.3 | — | — | — | 20.3 | — | — | — | 24.0 | 9.6 |
| | SR295 | 21.0 | 16.0 | 22.0 | 26.0 | 24.0 | — | 26.0 | — | — | 5.0 | 22.0 | 27.0 |
| Photopolymerization Initiator | TPO | 12.0 | 12.0 | 12.0 | 12.0 | 12.0 | 12.0 | 12.0 | 12.0 | 4.0 | 12.0 | 12 | 10.0 |
| Fluorescent Brightening Agent | KCB | 0.3 | 0.3 | 0.3 | 0.3 | 0.3 | 0.3 | 0.3 | 0.3 | 0.3 | 0.3 | 0.3 | 2.0 |
| Polymerization Inhibitor | MEHQ | 0.2 | 0.2 | 0.2 | 0.2 | 0.2 | 0.2 | 0.2 | 0.2 | 0.2 | 0.2 | 0.2 | 0.2 |
| Surfactant | BYK3500 | 0.2 | 0.2 | 0.2 | 0.2 | 0.2 | 0.2 | 0.2 | 0.2 | 0.2 | 0.2 | 0.2 | 0.2 |
| Colorant | Blue 15:3 | 1.5 | 1.5 | 1.5 | 1.5 | 1.5 | 1.5 | 1.5 | 1.5 | 1.5 | 1.5 | 1.5 | 1.5 |
| Dispersant | SOL32000 | 0.5 | 0.5 | 0.5 | 0.5 | 0.5 | 0.5 | 0.5 | 0.5 | 0.5 | 0.5 | 0.5 | 0.5 |
| Total | | 100.0 | 100.0 | 100.0 | 100.0 | 100.0 | 100.0 | 100.0 | 100.0 | 100.0 | 100.0 | 100.0 | 100.0 |
| Ink Viscosity Rank At 28° C. | | D | C | D | D | E | B | E | A | A | A | D | D |
| Curability | | B | B | B | A | A | B | B | B | C | B | B | B |
| Initiator Solubility | | A | A | A | A | A | A | A | A | A | A | B | A |

In addition, the ultraviolet-ray curable inks A, B, C, D, E, F, G, K and L correspond to inks which can be used in Examples, and the ultraviolet-ray curable inks H, I and J correspond to inks used in Comparative Examples.

Hereinafter, recording methods according to the respective Examples and Comparative Example will be described.

Examples 1 to 13 and Comparative Examples 2, 4, 5 and 9

The line printer shown in FIG. 2 provided with the ink supply device shown in FIG. 3 was used in which four line heads having a length substantially equal to a width (recording width) of a recording surface, on which an image is to be recorded, were arranged in parallel in the width direction. The nozzle density of the heads was 600 dpi.

A heating temperature of the heater provided in the ink circulating device was adjusted for each Example and Comparative Example such that a temperature (ejection temperature) of an ejected ink became the temperature shown in Tables 2 to 4 on the basis of a temperature of the nozzle plate measured in the thermocouple provided in the nozzle plate of the head, it was checked that an average temperature became each temperature of Examples and Comparative Examples by measuring a temperature every five minutes while the ink was continuously ejected from the head for sixty minutes, and the average temperature was used as an ejection temperature of the ink.

In relation to the ink supply device, both of the diameter of the ink supply tube for supplying an ink to the sub-tank and the diameter of the ink tube of the ink circulation path which connects the sub-tank to the head were 6 mm, the overall length of the ink circulation path was 1 m, and a The head Y of the recording apparatus shown in FIG. 2 was filled with each ink. In addition, the other heads shown in FIG. 2 were not used.

Comparative Examples 1, 3, 6 to 8

Recording was performed in the same manner as in above-described Examples 1 and the like except that a temperature was not adjusted by turning off the heater. At that time, the nozzle temperature was 25° C. (the ink temperature 25° C.).

Examples 14 to 16 and Comparative Example 11

Recording was performed in the same manner as in above-described Examples 1 and the like except that "ink inflow amount A/maximum ink ejection amount B" is set to the numerical values shown in Tables 3 and 4 by changing the ink inflow amount A.

Comparative Example 10

Recording was performed in the same manner as in above-described Examples 1 and the like except that a temperature was not adjusted by turning off the heater, and "ink inflow amount A/maximum ink ejection amount B" is set to the numerical values shown in Table 4 by changing the ink inflow amount A. At that time, the nozzle temperature was 25° C. (the ink temperature 25° C.)

Example 17

Recording was performed in the same manner as in above-described Examples 1 and the like except that the heating device in the circulation path was turned off, and, instead, a heater was mounted in the head, and the ink temperature became 33° C. by heating the head.

In addition, in relation to the heater of the head, as shown in FIG. 2 of JP-A-2003-200559, the heater was installed in the head, and the head including the reservoir was heated.

Example 18

Recording was performed in the same manner as in above-described Examples 1 and the like except that the number of the heads was changed from four to one. Specifically, only one head ejected the ink, and the other three heads did not eject the ink and were blocked from flowing of the ink thereinto. The ink inflow amount A was twice the ejection amount (10 mL/min) of a single head. Therefore, the ink inflow amount A in Example 18 was 20 mL/min.

Examples 19 to 21

Recording was performed in the same manner as in above-described Examples 1 and the like except that the irradiation peak intensity in evaluation of curing wrinkles was changed from 1000 mW/cm$^2$ to 500 mW/cm$^2$.

Measurement and Evaluation Items

1. Viscosity Rank of Ink During Ejection

This viscosity rank was the same as the above-described viscosity rank of the ink at 28° C. except that a measurement temperature was set to the ejection temperature shown in Tables 2 to 4 below, and the viscosity was measured when each ink was ejected.

The evaluation criteria were the same as in the above-described viscosity rank of the ink at 28° C. The evaluation results are shown in Tables 2 to 4 below.

2. Evaluation of Ejection Stability

The evaluation was performed using the number of nozzles which did not eject the ink when all the nozzles of a single head ejected the ink for five minutes.

The evaluation criteria are as follows. The evaluation results are shown in Tables 2 to 4 below.

A: The number of nozzles which did not eject the ink was equal to or less than 2.

B: The number of nozzles which did not eject the ink was 3 to 5.

x: The number of nozzles which did not eject the ink was equal to or more than 6.

3. Evaluation of Short-Term Ejection Amount Stability

The ink was ejected with the maximum ink ejection amount for sixty minutes using all the nozzles. An ink receiver was provided on the lower side of the head, the mass of the ejected ink was measured from the mass of the ink receiver every five minutes during the ejecting, the ejection mass per ink droplet was obtained from the number of ink droplets ejected to the ink receiver, and a difference between the minimum and maximum ejection mass for sixty minutes was calculated in mass % for average ejection mass for sixty minutes.

In addition, four heads were provided, each of the four heads had 600 nozzles, and ejection was performed using all the nozzles of all the heads. However, in Example 18, a single head was an evaluation target. Further, a non-ejection nozzle due to poor ejection was not treated as an ejection nozzle, and a measurement target of ejection mass was a nozzle performing ejection. The evaluation criteria are as follows. The evaluation results are shown in Tables 2 to 4 below.

A: Equal to or less than 3 mass %

B: Grater than 3 mass % and 5 mass % or less

C: Greater than 5 mass %

4. Evaluation of Long-Term Ejection Amount Stability

The short-term evaluation was performed for ten days once a day, that is, ten times. In addition, a difference between the minimum and maximum ejection mass of the evaluations (tests) of ten times was calculated in mass % for an average of ejection mass of ten times.

The evaluation criteria are as follows. The evaluation results are shown in Tables 2 to 4 below.

A: Equal to or less than 3 mass %

B: Grater than 3 mass % and 5 mass % or less

C: Greater than 5 mass %

5. Evaluation of Durability of Head

The durability of the head was evaluated by measuring and calculating a swelling ratio of the adhesive.

The adhesive (EPIKOTE 828 which an epoxy resin manufactured by Shell in Japan was mixed with VERSAMID 125 which is a curing agent manufactured by COGNIS Japan Ltd. with an equal amount) of an epoxy resin of about 0.2 g was cured, the adhesive piece was created, and the weight thereof was measured. Then, the adhesive piece was immersed into each ink which was in the screw tube, was covered, and was left for six months. A temperature during being left was set to the ejection temperature of each ink shown in Tables 2 to 4 below. After being left, the adhesive piece was extracted, the ink was cleared away and flowed, and the weight thereof was measured. In addition, the swelling rate was calculated from the following equation.

Rate of change of weight (%)={(weight after being immersed−weight before being immersed)/weight before being immersed}×100

The evaluation criteria are as follows. The evaluation results are shown in Tables 2 to 4 below.

A: Lower than 50%

B: 50% or more

6. Evaluation of Curing Wrinkles

The heads and the temporary curing light sources 42*a* to 42*d* shown in FIG. 2 were not used, an LED with the peak wavelength of 395 nm and the irradiation peak intensity of 1000 mW/cm$^2$ was disposed in the main curing light source, the ink was coated on the film in the same as in the above-described evaluation of curability of the ink, and the film was transported to the main curing light source, and the ink was irradiated. The irradiation time was adjusted so as to set such irradiation energy where irradiation is performed until the ink is cured using the same method as in the curability test. Here, the film thickness of the ink after being cured was 12 μm.

In addition, the surface of the cured film was observed visually. The evaluation criteria are as follows. The evaluation results are shown in Tables 2 to 4 below.

A: No wrinkles were observed

B: Wrinkles were observed on a partial region of the cured film

C: Wrinkles were observed on the entire surface of the cured film

TABLE 2

| | Example No. | | | | | | | | | | |
|---|---|---|---|---|---|---|---|---|---|---|---|
| Item | 1 | 2 | 3 | 4 | 5 | 6 | 7 | 8 | 9 | 10 | 11 |
| Ink | A | A | A | A | B | C | D | E | F | F | G |
| Ejection | 28 | 33 | 37 | 40 | 33 | 33 | 33 | 33 | 28 | 33 | 39 |

TABLE 2-continued

| Item | Example No. 1 | 2 | 3 | 4 | 5 | 6 | 7 | 8 | 9 | 10 | 11 |
|---|---|---|---|---|---|---|---|---|---|---|---|
| Temperature ° C. | | | | | | | | | | | |
| Viscosity Rank During Ejection | D | C | B | B | B | C | C | D | B | A | D |
| Ink Inflow Amount/Maximum Ink Ejection Amount (Times) | 2 | 2 | 2 | 2 | 2 | 2 | 2 | 2 | 2 | 2 | 2 |
| Evaluation Result | | | | | | | | | | | |
| Ejection Stability | B | A | A | A | A | A | A | B | A | A | B |
| Ejection Amount Stability (Short Term) | B | A | A | A | A | A | A | B | A | A | B |
| Ejection Amount Stability (Long Term) | B | A | A | A | A | A | A | B | A | A | B |
| Durability Of Head | A | A | A | A | A | A | A | A | A | A | A |
| Curing Wrinkles | B | B | B | B | B | B | A | A | B | B | A |

TABLE 3

| Item | Example No. 12 | 13 | 14 | 15 | 16 | 17 | 18 | 19 | 20 | 21 |
|---|---|---|---|---|---|---|---|---|---|---|
| Ink | K | L | A | E | G | A | A | A | G | D |
| Ejection Temperature ° C. | 33 | 33 | 33 | 33 | 39 | 33 | 28 | 33 | 39 | 33 |
| Viscosity Rank During Ejection | C | C | C | D | D | C | D | C | D | C |
| Ink Inflow Amount/Maximum Ink Ejection Amount (Times) | 2 | 2 | 1.5 | 2.5 | 2.5 | 2 | 2 | 2 | 2 | 2 |
| Evaluation Result | | | | | | | | | | |
| Ejection Stability | B | A | A | B | B | A | B | A | B | A |
| Ejection Amount Stability (Short Term) | A | A | B | A | A | B | A | A | B | A |
| Ejection Amount Stability (Long Term) | A | A | B | A | A | B | A | A | B | A |
| Durability Of Head | A | A | A | A | A | A | A | A | A | A |
| Curing Wrinkles | B | B | B | A | A | B | B | C | A | C |

TABLE 4

| Item | Comparative Example No. 1 | 2 | 3 | 4 | 5 | 6 | 7 | 8 | 9 | 10 | 11 |
|---|---|---|---|---|---|---|---|---|---|---|---|
| Ink | A | A | F | G | G | H | I | J | J | F | G |
| Ejection Temperature ° C. | 25 | 44 | 25 | 33 | 45 | 25 | 25 | 25 | 28 | 25 | 45 |
| Viscosity Rank During Ejection | E | A | B | E | C | A | A | B | A | B | C |
| Ink Inflow Amount/Maximum Ink Ejection Amount (Times) | 2 | 2 | 2 | 2 | 2 | 2 | 2 | 2 | 2 | 1.5 | 2.5 |
| Evaluation Result | | | | | | | | | | | |
| Ejection Stability | x | A | A | x | A | A | A | A | A | A | A |
| Ejection Amount Stability (Short Term) | — | C | A | — | C | A | A | A | A | A | C |
| Ejection Amount Stability (Long Term) | — | C | C | — | C | C | C | C | A | C | C |
| Durability Of Head | A | B | A | A | B | B | B | B | B | A | B |
| Curing Wrinkles | B | B | B | A | A | C | C | C | C | B | A |

It was found from the above-described results that good ejection stability, ejection amount stability, and durability of the head were obtained, and, further, solubility of the photopolymerization initiator included in the ink, curability of the ink, and suppression of curing wrinkles were also good when an ink jet recording method (Examples) is compared with the other recording methods (Comparative Examples), the ink jet recording method including: an ejecting step of ejecting an ultraviolet ray-curable ink, which has a viscosity at 28° C. of 8 mPa·s or more; and a curing step of curing the ink, wherein, in the curing step, a temperature of the ejected ultraviolet-ray curable ink is 28° C. to 40° C., and a viscosity of the ultraviolet-ray curable ink at the temperature is 15 mPa·s or less. Here, there was no difference between the curability and the curing wrinkles depending on a heating temperature. In addition, it was found that, the greater the value of "ink inflow amount/maximum ink ejection amount" in the ink supply device, the better the ejection amount stability, and, if the value was two or more, a variation in the ejection amount could be effectively suppressed. Hereinafter, discussion will be made based on the above-described results. However, the scope of the invention is not limited to the following discussion.

First, it is estimated that, when a viscosity of the ink during ejection is 8 mPa·s to 12 mPa·s, that is, the evaluation result of the viscosity is "B" or "C", a recording method using the ink achieves better ejection stability. However, it was observed that the ultraviolet-ray curable ink K had a tendency in which time is taken for the photopolymerization initiator to be dissolved, and thus solubility of the photopolymerization initiator a little worsened. For this reason, it is estimated that a recording method using the ultraviolet-ray curable ink K produces a result in which the ejection stability a little worsens since the photopolymerization initiator is precipitated.

In addition, it is estimated from the comparison between Example 9 and Comparative Example 9 that, when a viscosity at 28° C. is 8 mPa·s or more, durability of the head becomes good. Further, it is estimated from the comparison between Example 2 and Example 14, between Example 8 and Example 15, and between Example 11 and Example 16 that, although the ink and ejection temperatures which are used are the same, the greater value of "ink inflow amount/maximum ink ejection amount" achieves good ejection amount stability. On the other hand, in Comparative Example 3 and Comparative Example 10, the ink and ejection temperatures are the same and "ink inflow amount/maximum ink ejection amount" is different, but the evaluation results were the same. It is estimated from this that, if the ink is not heated, an evaluation result is not influenced even if "ink inflow amount/maximum ink ejection amount" is different.

In addition, in Comparative Example 5 and Comparative Example 11, the ink and ejection temperatures are the same, but "ink inflow amount/maximum ink ejection amount" is different, and thus the evaluation results were equal. It is estimated from this that, when the ejection temperature is higher than 40° C., a fluctuation in the ink temperature in the circulation path is great, and, even if "ink inflow amount/maximum ink ejection amount" is increased to 2.5 times, this is insufficient to achieve more favorable evaluation results. Therefore, it is estimated that, when the ejection temperature is 40° C. or less, the larger "ink inflow amount/maximum ink ejection amount", the better the ejection amount stability.

In addition, in Example 2 and Example 17, the circulation path and the heater mounted in the head were used as ink heating positions, respectively. It was found that using the circulation path as an ink heating position gives more favorable fluctuation in an ejection amount.

In addition, in Example 1 and Example 18, the number of the heads was 4 and 1, respectively. It was found that a single head gives better ejection amount stability (short term and long term), but a recordable width was reduced. In other words, it was found that a recording method of the invention achieves good ejection amount stability by setting an ink inflow amount to a predetermined value even if a plurality of heads are provided so as to increase a recordable width.

In addition, Example 2 and Example 19 are different from each other in that irradiation peak intensities are different, but it is estimated that the greater the irradiation peak intensity is, the more effectively the occurrence of curing wrinkles is prevented. Further, Example 11 and Example 20 are also different from each other in that irradiation peak intensities are different, but it is estimated that occurrence of curing wrinkles is prevented regardless of the magnitude of the irradiation peak intensity since the high viscosity ink is used unlike in a case of above-described Example 2 and Example 19. Furthermore, Example 7 and Example 21 are different from each other in that irradiation peak intensities are different, but it is estimated that the ink including the (meth)acrylic acid esters containing a vinyl ether group expressed in Formula (I) can prevent occurrence of curing wrinkles when the irradiation peak intensity is great.

In Comparative Examples 6 to 9 using any one of the inks H, I and J in which the ink viscosity rank at 28° C. is A, the evaluation of curing wrinkles was not good.

In addition, from Examples 19 to 21, when discussed from the viewpoints of a light source, the LED in which the irradiation peak intensity was changed from 1000 mW/cm$^2$ to 500 mW/cm$^2$, was used, and the evaluation of curing wrinkles was not good.

Although not shown as Example, as a light source, instead of an LED, curing was performed using a metal halide lamp with the irradiation peak intensity of 1000 mW/cm$^2$. As a result, it was found that, of Example and Comparative Example, in an example in which an evaluation result of curing wrinkles is B or C, the evaluation of curing wrinkles becomes better by one rank, and a result of curability also becomes better. However, the film was observed to be deformed due to heat generation of the metal halide lamp, or an installation space was necessary since it is a large-sized light source as compared with the LED. In other words, it was found that to use the LED is preferable from the viewpoints of implementing a recording apparatus which has low heat generation and saves a space, and to increase the irradiation peak intensity of the LED is more preferable from the viewpoints of curing wrinkles.

In addition, although not shown as Example, recording was performed in the same manner as in Example 1 except that the line printer was changed to a serial printer in which an LED with the peak intensity of 500 mW/cm$^2$ was mounted horizontally to the carriage as a light source. The serial printer which was used is an ink jet printer disclosed in FIG. 2 of JP-A-2010-167677. Dots were formed on the same recording region of a recording medium in 4 passes (2 passes in the main scanning direction×2 passes in the sub-scanning direction) under conditions of a nozzle density of the head of 300 dpi; a recording resolution of 600 dpi×600 dpi (a recording resolution per pass of 300 dpi×300 dpi). As a result, an evaluation result of curing wrinkles was A; however, it was found that recording speed was low since a printer was the serial printer. In other words, according to the recording method of the invention, it was found that it is possible to perform recording capable of effectively preventing occurrence of curing wrinkles by using an LED and increasing an irradiation peak intensity even if high-speed printing is performed using the line printer.

Hereinafter, the second embodiment will be described more in detail using Examples and Comparative Examples, but the invention is not limited to these Examples. Materials Used Materials used in Examples and Comparative Examples are as follows.

Polymerizable Compound

- 2-MTA (2-methoxyethyl acrylate; trade name, manufactured by OSAKA ORGANIC CHEMICAL INDUSTRY LTD.; a monofunctional (meth)acrylate)
- 4-HBA (4-hydroxybutyl acrylate; trade name, manufactured by OSAKA ORGANIC CHEMICAL INDUSTRY LTD.; a monofunctional (meth)acrylate)
- VEEA (2-(2-vinyloxyethoxy)ethyl acrylate; trade name, manufactured by Nippon Shokubai Co., Ltd.; a monofunctional (meth)acrylate)
- NEW FRONTIER PHE (phenoxyethyl acrylate; trade name, manufactured by Dai-ichi Kogyo Seiyaku Co., Ltd; a monofunctional (meth)acrylate; hereinafter, referred to as "PEA")
- V #160 (benzyl acrylate; trade name, manufactured by OSAKA ORGANIC CHEMICAL INDUSTRY LTD.; a monofunctional (meth)acrylate; hereinafter, referred to as "BZA")
- IBXA (isobornyl acrylate; trade name, manufactured by OSAKA ORGANIC CHEMICAL INDUSTRY LTD.; hereinafter, referred to as "IBX")
- A-DPH (tripropylene glycol diacrylate; trade name, manufactured by SHIN-NAKAMURA CHEMICAL CO., LTD.; a bifunctional (meth)acrylate; hereinafter, referred to as "TPGDA")
- SR295 (pentaerythritol tetraacrylate; a tetrafunctional (meth)acrylate; trade name, manufactured by Sartomer Company Inc.)

Photopolymerization Initiator

- Lucirin TPO (trade name, manufactured by BASF Japan Ltd.; hereinafter, referred to as "TPO")
- Speedcure DETX (trade names, manufactured by Lambson Ltd.; hereinafter, referred to as "DETX")
- Quantacure ITX (trade name, manufactured by Biddle Sawyer Corporation; hereinafter, referred to as "ITX")
- IRGACURE 369 (trade name, manufactured by BASF Japan Ltd.; hereinafter, referred to as "369")

Polymerization Inhibitor

- p-Methoxyphenol (trade name, manufactured by Tokyo Chemical Industry Co., Ltd.; p-methoxyphenol; hereinafter, referred to as "MEHQ")

Surfactant

- BYK-UV3500 (polyether-modified polydimethylsiloxane; manufactured by BYK Chemie; hereinafter, referred to as "BYK3500")

Colorant

- Cyanine Blue KRO (C.I. Pigment blue 15:3 (phthalocyanine pigment); trade name, manufactured by SANYO COLOR WORKS Ltd.; pigment particle size: 80 nm; hereinafter, referred to as "Blue 15:3")

Dispersant

- Solsperse 32000 (trade name, manufactured by Avecia Co.; hereinafter, referred to as "SOL32000") Preparation of Ultraviolet Ray-Curable Inks A to O Materials shown in Table 5 below were added according to contents thereof (unit: mass %) shown in Tables, and were stirred by a high-speed water-cooling type stirrer. As a result, ultraviolet ray-curable inks A to O were obtained.

Measurement and Evaluation Items

1. Viscosity Rank of Ink at 28° C.

Using a DVM-E type rotary viscometer (manufactured by Tokyo Keiki Inc.), the viscosity of each ink prepared above was measured at 28° C.

As a rotor, a DVM-E type cone rotor having a cone angle of 1°34' and a cone radius of 2.4 cm was used. A rotating speed thereof was 10 rpm.

The evaluation criteria are as follows. The evaluation results are shown in Table 5 below.

A: Less than 8 mPa·s
B: 8 mPa·s or greater and 10 mPa·s or less
C: Greater than 10 mPa·s and 12 mPa·s or less
D: Greater than 12 mPa·s and 15 mPa·s or less
E: Greater than 15 mPa·s 2. Evaluation of Solubility of Photopolymerization Initiator Each ink prepared above was stirred for 30 minutes at room temperature. After the stirring, whether or not there was a remaining of the undissolved photopolymerization initiator was observed visually.

The evaluation criteria are as follows. The evaluation results are shown in Table 5 below. In addition, in Table 5, this evaluation column is abbreviated to "initiator solubility".

A: The remaining of the undissolved photopolymerization initiator was not observed.
B: The remaining of the undissolved photopolymerization initiator was observed.

3. Evaluation of Curability of Ink

Each ink described above was coated on Lumirror #125-E20 (trade name, manufactured by Toray Industries, Inc.; PET film) using a bar coater (manufactured by TESTER SANGYO CO., LTD.). The thickness of the coated film was 10 m after being cured. Next, the coated ink was irradiated with ultraviolet rays having an irradiation peak intensity of 1000 mW/cm$^2$ emitted from an LED (Firefly (trade name), manufactured by Phoseon Technology) having a peak at the wavelength of 395 nm for a predetermined time. As a result, a cured ink coated film was obtained. After the irradiation, a surface of the ink coated film was rubbed twenty times in a reciprocating manner with a cotton swab (Johnson & Johnson K. K.) under a load of 100 g. The irradiation energy required until the surface was not scratched was measured by changing the predetermined time.

The evaluation criteria are as follows. The evaluation results are shown in Table 5.

A: Equal to or less than 300 mJ/cm$^2$
B: Greater than 300 mJ/cm$^2$ and 400 mJ/cm$^2$ or less
C: Greater than 400 mJ/cm$^2$ 4. Evaluation of Curing Wrinkles The heads and the temporary curing light sources 42*a* to 42*d* shown in FIG. 2 were not used, an LED with the peak wavelength of 395 nm and the irradiation peak intensity of 1000 mW/cm$^2$ was disposed in the main curing light source, the ink was coated on the film in the same manner as in the above-described evaluation of curability of the ink, and the film was transported to the main curing light source, and the ink was irradiated. The irradiation time was adjusted so as to set such irradiation energy where irradiation is performed until the ink is cured using the same method as in the curability test. Here, the film thickness of the ink after being cured was 12 μm.

In addition, the surface of the cured film was observed visually. The evaluation criteria are as follows. The evaluation results are shown in Table 5 below.

A: No wrinkles were observed

B: Wrinkles were observed on a partial region of the cured film

C: Wrinkles were observed on the entire surface of the cured film

TABLE 5

| Material Name | Abbreviation | Symbol of Ultraviolet-Ray Curable Ink | | | | | | | | | | | | | | |
|---|---|---|---|---|---|---|---|---|---|---|---|---|---|---|---|---|
| | | A | B | C | D | E | F | G | H | I | J | K | L | M | N | O |
| POLYMERIZABLE COMPOUND | 2MTA | 10.0 | 10.3 | 10.0 | 4.6 | — | 61.6 | 9.3 | 68.3 | 70.0 | 50.3 | — | 10.0 | 10.0 | 9.3 | 6.0 |
| | 4HBA | 30.0 | 32.3 | 30.0 | 25.0 | 20.0 | — | 30.0 | 12.0 | 14.3 | 30.3 | — | 30.0 | 30.0 | 30.0 | 31.0 |
| | VEEA | — | — | — | 30.0 | 25.0 | 24.0 | — | 5.3 | 8.3 | — | 40.0 | — | — | — | — |
| | PEA | — | 15.0 | 15.0 | — | 16.6 | — | — | — | — | — | — | — | — | — | — |
| | BZA | — | — | — | — | — | — | — | — | — | — | — | — | — | — | 12.0 |
| | IBX | — | — | — | — | — | — | — | — | — | — | — | — | — | — | — |
| | TPGDA | 24.6 | 12.0 | 8.6 | — | — | — | 20.3 | — | — | — | 24.0 | 24.6 | 24.6 | 20.3 | 9.6 |
| | SR295 | 21.0 | 16.0 | 22.0 | 26.0 | 24.0 | — | 26.0 | — | — | 5.0 | 22.0 | 21.0 | 21.0 | 26.0 | 27.0 |
| Photopolymerization Initiator | TPO | 10.0 | 10.0 | 10.0 | 10.0 | 10.0 | 10.0 | 10.0 | 10.0 | 4.0 | 10.0 | 10.0 | 10.0 | 10.0 | 10.0 | 10.0 |
| | DETX | 2.0 | 2.0 | 2.0 | 2.0 | 2.0 | 2.0 | 2.0 | 2.0 | 1.0 | 2.0 | 2.0 | — | — | — | 2.0 |
| | ITX | — | — | — | — | — | — | — | — | — | — | — | 2.0 | — | — | — |
| | 369 | — | — | — | — | — | — | — | — | — | — | — | — | 2.0 | 2.0 | — |
| Polymerization Inhibitor | MEHQ | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |
| Surfactant | BYK3500 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |
| Colorant | Blue 15:3 | 1.5 | 1.5 | 1.5 | 1.5 | 1.5 | 1.5 | 1.5 | 1.5 | 1.5 | 1.5 | 1.5 | 1.5 | 1.5 | 1.5 | 1.5 |
| Dispersant | SOL32000 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 |
| Total | | 100.0 | 100.0 | 100.0 | 100.0 | 100.0 | 100.0 | 100.0 | 100.0 | 100.0 | 100.0 | 100.0 | 100.0 | 100.0 | 100.0 | 100.0 |
| Ink Viscosity Rant At 28° C. | | D | C | D | D | E | B | E | A | A | A | D | D | D | E | D |
| Curability | | B | B | B | A | A | B | B | B | C | B | B | C | C | C | B |
| Curing Wrinkles | | B | B | B | A | A | B | A | C | C | C | A | B | B | A | B |
| Initiator Solubility | | A | A | A | A | A | A | A | A | A | A | B | A | A | A | A |

In addition, the ultraviolet-ray curable inks A, B, C, D, E, F, G, K, L, M and O correspond to inks which can be used in Examples, and the ultraviolet-ray curable inks H, I and J correspond to inks used in Comparative Examples.

Hereinafter, recording methods according to the respective Examples and Comparative Example will be described.

Examples 1 to 18 and Comparative Examples 2, 5, 6, 10, 13 and 14

The line printer shown in FIG. 2, provided with the ink supply device shown in FIG. 3, was used in which four line heads 60 having a length substantially equal to a width (recording width) of a recording surface, on which an image is to be recorded, were arranged in parallel in the width direction. The nozzle density of the heads was 600 dpi. In addition, the dissolved oxygen content of the ink of the ink cartridge was 20 ppm. The measurement of the dissolved oxygen content was performed using methods described later.

A heating temperature of the heater provided in the ink circulating device was adjusted for each Example and Comparative Example such that a temperature (ejection temperature) of an ejected ink became the temperature shown in Tables 6 and 7 on the basis of a temperature of the nozzle plate measured in the thermocouple provided in the nozzle plate of the head, it was checked that an average temperature became each temperature of Examples and Comparative Examples by measuring a temperature every five minutes while the ink was continuously ejected from the head for sixty minutes, and the average temperature was used as an ejection temperature of the ink.

In relation to the ink supply device, both of the diameter of the ink supply tube for supplying an ink to the sub-tank and the diameter of the ink tube of the ink circulation path which connects the sub-tank to the head were 6 mm, the overall length of the ink circulation path was 1 m, and a volume of the sub-tank was 100 mL. The maximum ink ejection amount D for each head was 10 mL/min, and the maximum ink ejection amount B of the ink supply device was 40 mL/min since four heads were provided. The ink inflow amount A was set to 80 mL/min, and the ink was circulated with this ink inflow amount. The inks were ejected for sixty minutes with the maximum ink ejection amount from the four heads. The ink outflow amount C was 40 mL/min.

The head Y of the recording apparatus shown in FIG. 2 was filled with each ink. In addition, the other heads shown in FIG. 2 were not used.

Examples 19 to 21 and Comparative Example 17

Recording was performed in the same manner as in above-described Examples 1 and the like except that "ink inflow amount A/maximum ink ejection amount B" is set to the numerical values shown in Tables 6 and 7.

Example 22

Recording was performed in the same manner as in above-described Examples 1 and the like except that the heating mechanism 90 and the degassing mechanism 100 are replaced with each other (the heating mechanism 90 is located on the downstream side of the degassing mechanism 100) in FIG. 3.

Examples 23 to 25

Recording was performed in the same manner as in above-described Examples 1 and the like except that the irradiation peak intensity in evaluation of curing wrinkles was changed from 1000 mW/cm$^2$ to 500 mW/cm$^2$.

Comparative Examples 1, 4, 7 to 9, 11 and 12

Recording was performed in the same manner as in above-described Examples 1 and the like except that a temperature was not adjusted by turning off the heater. At that time, the nozzle temperature (the "ejection temperature" in Tables 6 and 7 below) was 25° C.

Comparative Example 3

The evaluation was performed in the same manner as in Example 2 except that the pump of the degassing mechanism 100 stops so as not to perform degassing.

Comparative Examples 15 and 16

Recording was performed in the same manner as in above-described Examples 1 and the like except that "ink inflow amount A/maximum ink ejection amount B" is set to the numerical values shown in Tables 6 and 7 by changing the ink inflow amount A, and a temperature was not adjusted by turning off the heater. At that time, the nozzle temperature (the "ejection temperature" in Tables 6 and 7 below) was 25° C.

Comparative Example 18

Recording was performed in the same manner as in above-described Example 1 and the like except that a temperature was not adjusted by turning off the heater, and the heating mechanism 90 and the degassing mechanism 100 are replaced with each other (the heating mechanism 90 is located on the downstream side of the degassing mechanism 100) in FIG. 3. At that time, the nozzle temperature (the "ejection temperature" in Tables 6 and 7 below) was 25° C.

Measurement and Evaluation Items

1. Viscosity Rank of Ink During Ejection

This viscosity rank was the same as the above-described viscosity rank of the ink at 28° C. except that a measurement temperature was set to the ejection temperature shown in Tables 6 and 7 below, and the viscosity was measured when each ink was ejected.

The evaluation criteria were the same as in the above-described viscosity rank of the ink at 28° C. The evaluation results are shown in Tables 6 and 7 below.

2. Measurement of Dissolved Oxygen Content

Each ink prepared above was gathered from the inside of the head of the line printer. The dissolved oxygen content of each ink was measured using Gas Chromatograph Agilent 6890 (manufactured by Agilent Technologies, Inc.). A helium (He) gas was used as a carrier gas. In addition, the measurement of the dissolved oxygen content was to measure a degassing degree. The measurement results are shown in Tables 6 and 7.

3. Evaluation of Ejection Stability

The evaluation was performed using the number of nozzles which did not eject the ink when all the nozzles of a single head ejected the ink for five minutes.

The evaluation criteria are as follows. The evaluation results are shown in Tables 6 and 7 below.

A: The number of nozzles which did not eject the ink was equal to or less than 2.

B: The number of nozzles which did not eject the ink was 3 to 5.

C: The number of nozzles which did not eject the ink was 6 to 8.

x: The number of nozzles which did not eject the ink was equal to or more than 9.

4. Evaluation of Durability of Head

The durability of the head was evaluated by measuring and calculating a swelling ratio of the adhesive.

The adhesive (EPIKOTE 828 which an epoxy resin manufactured by Shell in Japan was mixed with VERSAMID 125 which is a curing agent manufactured by COGNIS Japan Ltd. with an equal amount) of an epoxy resin of about 0.2 g was cured, the adhesive piece was created, and the weight thereof was measured. Then, the adhesive piece was immersed into each ink which was in the screw tube, was covered, and was left for six months. A temperature during being left was set to the ejection temperature of each ink shown in Tables 6 and 7 below. After being left, the adhesive piece was extracted, the ink was cleared away and flowed, and the weight thereof was measured. In addition, the swelling rate was calculated from the following equation.

$$\text{Rate of change of weight (\%)} = \{(\text{weight after being immersed} - \text{weight before being immersed}) / \text{weight before being immersed}\} \times 100$$

The evaluation criteria are as follows. The evaluation results are shown in Tables 6 and 7 below.

A: Lower than 50%

B: 50% or more

5. Evaluation of Curing Wrinkles

The heads and the temporary curing light sources 42*a* to 42*d* shown in FIG. 2 were not used, an LED with the peak wavelength of 395 nm and the irradiation peak intensity of 1000 mW/cm$^2$ was disposed in the main curing light source, the ink was coated on the film in the same manner as in the above-described evaluation of curability of the ink, and the film was transported to the main curing light source, and the ink was irradiated. The irradiation time was adjusted so as to set such irradiation energy where irradiation is performed until the ink is cured using the same method as in the curability test. Here, the film thickness of the ink after being cured was 12 μm.

In addition, the surface of the cured film was observed visually. The evaluation criteria are as follows. The evaluation results are shown in Tables 6 and 7 below.

A: No wrinkles were observed

B: Wrinkles were observed on a partial region of the cured film

C: Wrinkles were observed on the entire surface of the cured film

TABLE 6

[Examples 1 to 25]

| Item | Example No. 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Ink | A | A | A | A | B | C | D | E | F | F | G | K | L | L |
| Ejection Temperature ° C. | 28 | 33 | 37 | 40 | 33 | 33 | 33 | 33 | 28 | 33 | 39 | 33 | 28 | 33 |

TABLE 6-continued

[Examples 1 to 25]

| | | | | | | | | | | | | | | |
|---|---|---|---|---|---|---|---|---|---|---|---|---|---|---|
| Viscosity Rank During Ejection | D | C | B | B | B | C | C | D | B | A | D | C | D | C |
| Ink Inflow Amount/Maximum Ink Ejection Amount (Times) | 2 | 2 | 2 | 2 | 2 | 2 | 2 | 2 | 2 | 2 | 2 | 2 | 2 | 2 |
| DISSOLVED OXYGEN CONTENT (Ppm) | 20 | 17 | 13 | 8 | 15 | 16 | 18 | 18 | 15 | 10 | 18 | 18 | 20 | 17 |
| Evaluation Result | | | | | | | | | | | | | | |
| Durability Of Head | A | A | A | A | A | A | A | A | A | A | A | A | A | A |
| Ejection Stability | B | A | A | A | A | A | A | B | A | A | B | A | B | A |
| Curing Wrinkles | B | B | B | B | B | B | A | A | B | B | A | B | B | B |

| | Example No. | | | | | | | | | | |
|---|---|---|---|---|---|---|---|---|---|---|---|
| Item | 15 | 16 | 17 | 18 | 19 | 20 | 21 | 22 | 23 | 24 | 25 |
| Ink | M | M | N | O | A | E | G | A | A | G | D |
| Ejection Temperature ° C. | 28 | 33 | 39 | 33 | 33 | 33 | 39 | 33 | 33 | 39 | 33 |
| Viscosity Rank During Ejection | D | C | D | C | C | D | D | C | C | D | C |
| Ink Inflow Amount/Maximum Ink Ejection Amount (Times) | 2 | 2 | 2 | 2 | 1.5 | 2.5 | 2.5 | 2 | 2 | 2 | 2 |
| DISSOLVED OXYGEN CONTENT (Ppm) | 20 | 17 | 18 | 16 | 19 | 15 | 15 | 20 | 17 | 18 | 18 |
| Evaluation Result | | | | | | | | | | | |
| Durability Of Head | A | A | A | A | A | A | A | A | A | A | A |
| Ejection Stability | A | A | A | A | B | A | A | B | A | B | A |
| Curing Wrinkles | B | B | A | B | B | A | A | B | C | A | C |

TABLE 7

[Comparative Examples 1 to 18]

| | Comparative Example No. | | | | | | | | | | | | | | | | | |
|---|---|---|---|---|---|---|---|---|---|---|---|---|---|---|---|---|---|---|
| Item | 1 | 2 | 3 | 4 | 5 | 6 | 7 | 8 | 9 | 10 | 11 | 12 | 13 | 14 | 15 | 16 | 17 | 18 |
| Ink | A | A | A | F | G | G | H | I | J | J | L | M | N | N | F | F | G | A |
| Ejection Temperature ° C. | 25 | 44 | 33 | 25 | 33 | 45 | 25 | 25 | 25 | 28 | 25 | 25 | 33 | 45 | 25 | 25 | 33 | 25 |
| Viscosity Rank During Ejection | E | A | C | B | E | C | A | A | B | A | E | E | E | C | B | B | E | E |
| Ink Inflow Amount/Maximum Ink Ejection Amount (Times) | 2 | 2 | 2 | 2 | 2 | 2 | 2 | 2 | 2 | 2 | 2 | 2 | 2 | 2 | 1.5 | 2.5 | 2.5 | 2 |
| DISSOLVED OXYGEN CONTENT (Ppm) | 25 | 6 | 28 | 23 | 25 | 13 | 19 | 20 | 21 | 18 | 25 | 25 | 25 | 13 | 25 | 23 | 24 | 25 |
| Evaluation Result | | | | | | | | | | | | | | | | | | |
| Durability Of Head | A | B | A | A | A | B | B | B | B | B | A | A | A | B | A | A | A | A |
| Ejection Stability | x | A | C | C | x | A | B | B | C | B | x | C | C | A | C | C | x | x |
| Curing Wrinkles | B | B | B | B | A | A | C | C | C | C | B | B | A | A | B | B | A | B |

It was found from the above-described results that good ejection stability, and durability of the head were obtained, and, further, solubility of the photopolymerization initiator included in the ink, curability of the ink, and suppression of curing wrinkles were also good when an ink jet recording apparatus (Examples) is compared with the other recording apparatuses (Comparative Examples), the ink jet recording apparatus including: a head which ejects an ultraviolet-ray curable ink to a recording medium so as to be attached to the recording medium; an ink path which supplies the ink to the head; a heating mechanism which heats the ink of which a viscosity at 28° C. is 8 mPa·s or more, enables a temperature of the ejected ink to be 28° C. to 40° C., and enables a viscosity of the ink at the temperature to be 15 mPa·s or less; a degassing mechanism which degases the ink and supplies the degassed ink to the head; and a light source which irradiates the ink attached to the recording medium with ultraviolet rays so as to cure the ink. Here, there was no difference in the curability and the curing wrinkles depending on a heating temperature. Hereinafter, discussion will be made based on the above-described results. However, the scope of the invention is not limited to the following discussion.

First, when a viscosity of the ink during ejection is 8 mPa·s to 12 mPa·s, that is, the evaluation result of the viscosity is "B" or "C", recording performed by the recording apparatus having the ink mounted therein achieves better ejection stability. In addition, it is estimated that, when the viscosity is greater than 15 mPa·s, that is, the evaluation result of the viscosity is "E", the ejection stability deteriorates due to the high viscosity. Further, it is estimated that, when the ejection temperature of the ink is higher than 40° C., or the ejection viscosity during ejection is lower than 8 mPa·s, observation of a tendency in which the head durability worsens is because the ink in a high temperature state or a low viscosity state easily erodes the head.

Successively, discussion will be made for each Example and Comparative Example. From the comparison of each Example with Comparative Examples 7 to 10, when a viscosity at 28° C. was 8 mPa·s or more, durability of the head and suppression of curing wrinkles were good. Specifically, Example 9 is an example in which the viscosity at 28° C. was 8 mPa·s, and the head durability was good. On the other hand, in Comparative Examples 7 to 10 using any one of the inks H, I and J in which the ink viscosity rank at 28° C. was A, the evaluation of curing wrinkles was not good.

In addition, from the comparison of Examples 1 and 2 with Comparative Example 1 and the comparison of Examples 9 and 10 with Comparative Example 4, when the ejection temperature was 28° C. or more, the ejection stability of the ink was good. Further, from the comparison of Examples 3 and 4 with Comparative Example 2, the comparison of Example 11 with Comparative Example 6, and the comparison of Example 17 with Comparative Example 14, when the ejection temperature was 40° C. or less, the durability of the head was good. In addition, Comparative Example 3 is an example in which the ink was not degassed since decompression was not performed using the degassing mechanism, and, from the comparison between Example 2 and Comparative Example 3, the degassed ink (preferably, up to the dissolved oxygen content 20 ppm or less) showed good ejection stability. Furthermore, from the comparison of Example 11 with Comparative Example 5, the comparison of Examples 13 and 14 with Comparative Example 11, the comparison of Examples 15 and 16 with Comparative Example 12, and the comparison of Example 17 with Comparative Example 13, when the viscosity at 28° C. to 40° C. was 15 mPa·s or less, the ejection stability of the ink was good. In addition, from the comparison of Example 1 with Comparative Example 1, the comparison of Example 13 with Comparative Example 11, the comparison of Example 15 with Comparative Example 12, and the comparison of Example 17 with Comparative Example 13, the ink including a thioxanthone-based photopolymerization initiator had better curability than the ink not having this, whereas the ejection stability was observed to tend to considerably worsen when the dissolved oxygen content of the ink was high.

From the respective comparison between Examples 2 and 19, Examples 8 and 20, and Examples 11 and 21, the larger "ink inflow amount/maximum ink ejection amount", that is, the higher the circulation speed (a circulation rate is high), the higher the degassing degree (a dissolved oxygen content is reduced), and thus the ejection stability of the ink was good. Further, from the comparison between Examples 4, 15 and 16, when the ink ejection temperature was low, the ejection temperature did not vary even if "ink inflow amount/maximum ink ejection amount" was changed.

In addition, from Comparative Example 18, even if the heating mechanism was disposed on the downstream side of the degassing mechanism, the ejection stability was reduced when the ejection temperature was low. Further, from Example 22, when the heating mechanism was disposed on the downstream side of the degassing mechanism, the dissolved oxygen content slightly increased (the ejection stability tended to be slightly reduced).

In addition, from Examples 23 to 25, when discussed from the viewpoints of a light source, the LED in which the irradiation peak intensity was changed from 1000 mW/cm$^2$ to 500 mW/cm$^2$, was used, and the evaluation of curing wrinkles was not good. Specifically, Example 2 and Example 23 are different from each other in that irradiation peak intensities are different, but it is estimated that the greater the irradiation peak intensity is, the more effectively the occurrence of curing wrinkles is prevented. Further, Example 11 and Example 24 are also different from each other in that irradiation peak intensities are different, but it is estimated that occurrence of curing wrinkles is prevented regardless of the magnitude of the irradiation peak intensity since the higher viscosity ink is used than in a case of above-described Example 2 and Example 23. Furthermore, Example 7 and Example 25 are different from each other in that irradiation peak intensities are different, but it is estimated that the ink including the (meth)acrylic acid esters containing a vinyl ether group expressed in Formula (I) can prevent occurrence of curing wrinkles when the irradiation peak intensity is great.

Although not shown as Example, as a light source, instead of an LED, curing was performed using a metal halide lamp with the irradiation peak intensity of 1000 mW/cm$^2$. As a result, it was found that, of Example and Comparative Example, in an example in which an evaluation result of curing wrinkles is B or C, the evaluation of curing wrinkles becomes better by one rank, and a result of curability also becomes better. However, the film was observed to be deformed due to heat generation of the metal halide lamp, or an installation space was necessary since it is a large-sized light source as compared with the LED. In other words, it was found that to use the LED is preferable from the viewpoints of implementing a recording apparatus which has low heat generation and saves a space, and to increase the irradiation peak intensity of the LED is more preferable from the viewpoints of curing wrinkles.

In addition, although not shown as Example, recording was performed in the same manner as in Example 1 except that the line printer was changed to a serial printer in which an LED with the peak intensity of 500 mW/cm$^2$ was mounted horizontally to the carriage as a light source. The serial printer which was used is an ink jet printer disclosed in FIG. 2 of JP-A-2010-167677. Dots were formed on the same recording region of a recording medium in 4 passes (2 passes in the main scanning direction×2 passes in the sub-scanning direction) under conditions of a nozzle density of the head of 300 dpi; a recording resolution of 600 dpi×600 dpi (a recording resolution per pass of 300 dpi×300 dpi). As a result, an evaluation result of curing wrinkles was A; however, it was found that recording speed was low since a printer was the serial printer. In other words, according to the recording apparatus of the invention, it was found that it is possible to perform recording capable of effectively preventing occurrence of curing wrinkles by using an LED and increasing an irradiation peak intensity even if high-speed printing is performed using the line printer.

What is claimed is:

1. An ink jet recording method comprising:

ejecting an ultraviolet-ray curable ink of which a viscosity at 28° C. is 8 mPa·s or more from a head to a recording medium; and curing the ultraviolet-ray curable ink attached to the recording medium, wherein the ultraviolet-ray curable ink is heated such that a temperature of the ejected ultraviolet-ray curable ink becomes in a range of 28° C. to 39° C., and a viscosity of the ultraviolet-ray curable ink at the heated temperature of the ejected ultraviolet-ray curable ink is in a range of 15 mPa·s or less, wherein the ultraviolet-ray curable ink includes a monofunctional (meth) acrylate and a bifunctional or higher (meth) acrylate, a content of the monofunctional (meth) acrylate being from 35 mass % to 90 mass % of the ink.

2. The ink jet recording method according to claim 1, wherein recording is performed using a line type ink jet recording apparatus which includes a line head with a length equal to or more than a length corresponding to a width of a recording medium as the head.

3. The ink jet recording method according to claim 1, wherein recording is performed using an ink jet recording apparatus in which at least a part of an ink path for supplying the ultraviolet-ray curable ink from an ink container to the head is an ink circulation path for circulating the ultraviolet-ray curable ink.

4. The ink jet recording method according to claim 3, wherein an ink inflow amount of the ultraviolet-ray curable ink which is supplied from the ink circulation path to the head is twice or more the maximum ink ejection amount in which the ultraviolet-ray curable ink is ejected from the head.

5. The ink jet recording method according to claim 3, wherein a heating mechanism which heats the ultraviolet-ray curable ink is provided at a position other than a position which is connected to at least the head in the ink circulation path.

6. The ink jet recording method according to claim 3, wherein there are a plurality of heads to which the ultraviolet-ray curable ink is supplied from the ink circulation path, and the ultraviolet-ray curable ink is ejected from the plurality of heads.

7. The ink jet recording method according to claim 1, wherein the ultraviolet-ray curable ink includes (meth) acrylic acid esters containing a vinyl ether group expressed in the following Formula (I):

$$CH_2{=}CR^1{-}COOR^2{-}O{-}CH{=}CH{-}R^3 \quad (I)$$

(wherein $R^1$ indicates a hydrogen atom or a methyl group, $R^2$ indicates a divalent organic residue having 2 to 20 carbon atoms, and $R^3$ indicates a hydrogen atom or a monovalent organic residue having 1 to 11 carbon atoms).

8. The ink jet recording method according to claim 7, wherein the ultraviolet-ray curable ink further includes a monofunctional (meth)acrylate (here, excluding (meth) acrylic acid esters containing a vinyl ether group expressed in Formula (I)).

9. The ink jet recording method according to claim 1, wherein a light source used for the curing of the ultraviolet-ray curable ink is a light emitting diode.

10. The ink jet recording method according to claim 9, wherein the light emitting diode applies ultraviolet rays which have a peak intensity of 800 mW/cm$^2$ or more.

11. The ink jet recording method according to claim 1, wherein an epoxy resin is used for the head.

12. The ink jet recording method according to claim 1, wherein a content of the bifunctional (meth)acrylate is from 5 mass % to 50 mass % of the ink, and wherein the monofunctional (meth)acrylate includes a monofunctional (meth)acrylate having an aromatic ring skeleton in a molecule, the temperature of the ejected ink being in a range of 33° C. to 39° C.

* * * * *